US006598963B1

(12) United States Patent
Yamamoto et al.

(10) Patent No.: US 6,598,963 B1
(45) Date of Patent: Jul. 29, 2003

(54) LIQUID SUPPLYING SYSTEM AND LIQUID SUPPLY CONTAINER

(75) Inventors: Hajime Yamamoto, Yokohama; Shozo Hattori, Tokyo; Eiichiro Shimizu, Yokohama; Hiroshi Koshikawa, Kawasaki; Hiroki Hayashi, Kawasaki; Kenji Kitabatake, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/559,389

(22) Filed: Apr. 27, 2000

(30) Foreign Application Priority Data

| | | |
|---|---|---|
| Apr. 27, 1999 | (JP) | 11-120791 |
| Jun. 24, 1999 | (JP) | 11-178572 |
| Jun. 24, 1999 | (JP) | 11-179054 |
| Apr. 6, 2000 | (JP) | 12-104851 |

(51) Int. Cl.[7] ..... B41J 2/175
(52) U.S. Cl. ..... 347/85
(58) Field of Search ..... 347/84, 85, 86, 347/87; 340/618

(56) References Cited

U.S. PATENT DOCUMENTS 4,415,886 A * 11/1983 Kyogoku et al. ..... 340/618
6,022,102 A * 2/2000 Ikkatai et al. ..... 347/85

FOREIGN PATENT DOCUMENTS

| | | |
|---|---|---|
| EP | 580433 | 1/1994 |
| EP | 581531 | 2/1994 |
| EP | 672528 | 9/1995 |
| EP | 738605 | 10/1996 |
| EP | 803364 | 10/1997 |
| FR | 2765330 | 12/1998 |
| JP | 10-109430 | 4/1998 |
| WO | 98/55325 | 12/1998 |

* cited by examiner

*Primary Examiner*—Anh T. N. Vo
(74) *Attorney, Agent, or Firm*—Fitzpatrick, Cella, Harper & Scinto

(57) ABSTRACT

A liquid supply system includes a liquid supply container provided with a liquid supply portion for supplying liquid to outside; and a detector which detects presence or absence of the liquid in the liquid supply container, using an electrostatic capacity between the liquid in the liquid supply container and the electrode. The electrode is disposed to be parallel with and spaced from a bottom surface of the liquid supply container, and the bottom surface is inclined relative to a horizontal plane from one end to another end of the liquid supply container, and has a connecting portion at a lower side end.

21 Claims, 37 Drawing Sheets

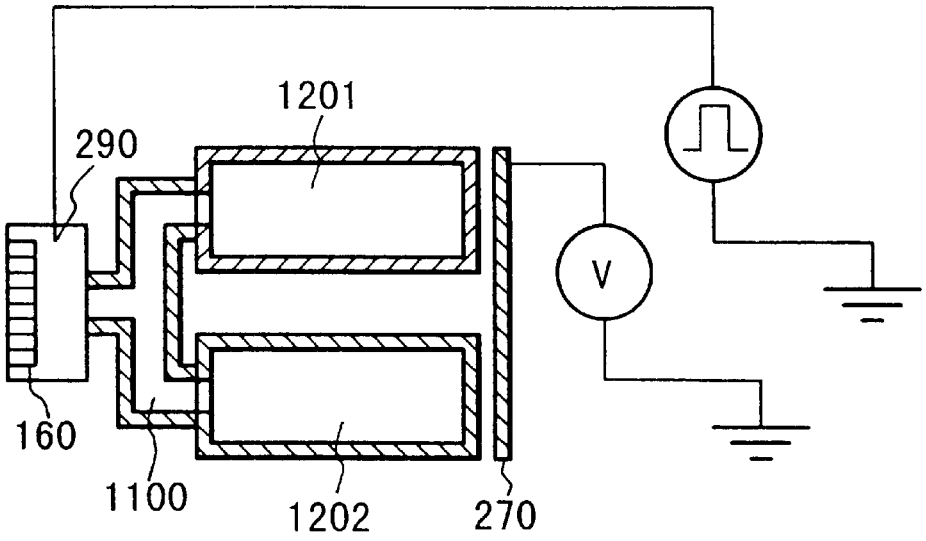
FIG. 45(a)
FIG. 45(b)
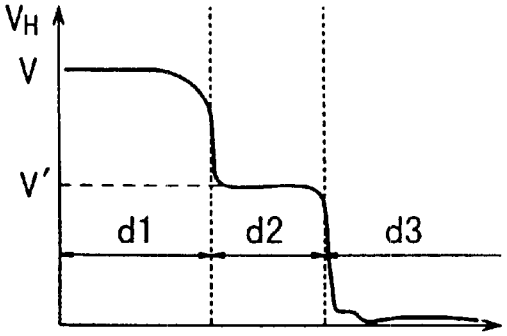
FIG. 45(c)
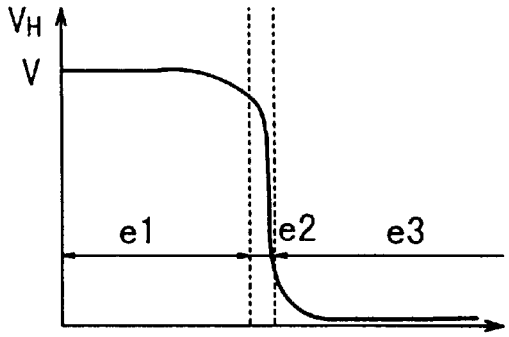
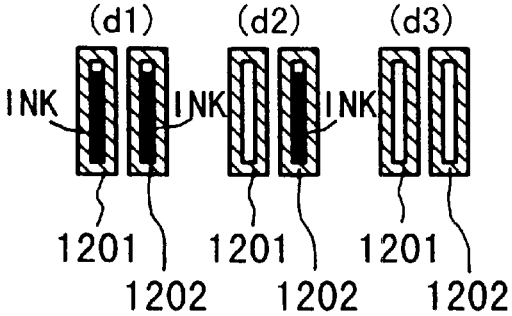
FIG. 45(d)
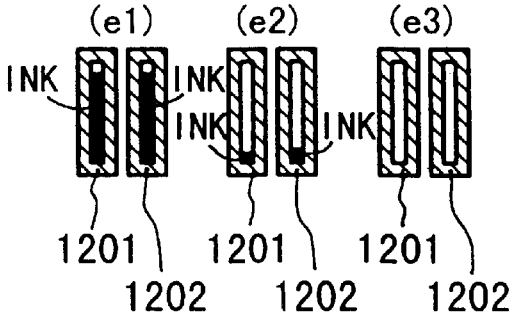
FIG. 45(e)

LIQUID SUPPLYING SYSTEM AND LIQUID SUPPLY CONTAINER

FIELD OF THE INVENTION AND RELATED ART

The present invention relates to a liquid supplying system for supply liquid to outside with a negative pressure, more particularly, a liquid supplying system and a liquid supply container in which a remaining amount of the liquid in a liquid containing portion.

Heretofore, in a field of ink jet recording apparatus, for example, a liquid supply method for supplying the liquid part with negative pressure, is used in an ink container which is integral with a recording head. The head cartridge is classified into a type in which the recording head and the ink container (ink accommodating portion) are normally integral and a type in which the recording means and the ink reservoir portion are separate parts both of which are separable from the recording device, respectively and are integral in use.

One of the easiest ways of supplying the liquid with negative pressure is the use of a capillary force of a porous material. The ink container using the method includes a porous material such as sponge accommodated or preferably compressed and accommodated in the entirety of the ink container, an air vent capable of introducing air into the ink reservoir portion to permit smooth ink supply during printing. However, the use of the porous member as an ink retaining member involves a problem that ink accommodating efficiency per unit volume is low. In order to solve this problem, EP0580433 which has been assigned to assignee of the present application has proposed an ink container comprising a negative pressure producing member accommodating chamber and an ink reservoir chamber which is substantially sealed except for a communicating portion therebetween, and the negative pressure producing member accommodating chamber is open to the ambience or atmosphere. In EP0581531, a proposal has been made in which the ink reservoir chamber is exchangeable. With such a structure, when the container becomes empty, only the ink reservoir chamber is exchanged, so that amount of waste can be reduced, which is advantageous in terms of environmental health.

In this ink container, the ink is supplied from the ink reservoir chamber into the negative pressure producing member accommodating chamber with gas-liquid exchanging operation involving introduction of the gas into the ink reservoir chamber with a discharge of the ink from the ink reservoir chamber, and therefore, the ink can be supplied out with substantially constant negative pressure when the gas-liquid exchanging operation occurs.

EP0738605 which has been assigned to the assignee of the present application has proposed a liquid container including a substantially prism configuration casing, and an accommodating portion deformable with discharge of the liquid accommodated and having an outer surface which is similar or equivalent to the inner surface of the casing, wherein the thickness of the accommodating portion is such that it is thinner at corner portion than at the central region at each side of the substantially prism configuration. The liquid container is able to supply the liquid with a negative pressure by proper contraction of the accommodating portion with discharge of the liquid (without gas-liquid exchange in the phenomenon). Therefore, the limitation to the location of the container is smaller than a conventional bladder type ink reservoir member, and can be disposed on a carriage. Since the ink is directly accommodated in the accommodating portion, the ink accommodating efficiency is improved. As mentioned above, the liquid supplying system including the negative pressure producing member accommodating chamber and the ink reservoir chamber is good in the improvement of the ink accommodating efficiency and the stability of the ink supply property, and particularly the type in which ink reservoir chamber is exchangeable is good in terms of the environmental health.

However, in the conventional gas-liquid exchanging operation, the ink discharge from the ink reservoir chamber into the negative pressure producing member accommodating chamber is interrelated with the introduction of the ambience through the communicating portion, and therefore, when a large amount of the ink is to be discharged in a short time from the negative pressure producing member accommodating chamber to the outside such as liquid ejecting head, for example, there is a liability at the ink supply from the ink reservoir chamber into the negative pressure producing member accommodating chamber involving the gas-liquid exchanging operation is not sufficient relative to the high rate ink consumption from the negative pressure producing member accommodating chamber. Therefore, in order to solve the problem of the insufficient ink supply, the state in the ink reservoir chamber is important.

As for a method for detecting reduction of the ink remaining amount or the ink remaining amount per se, there is a system in which two electrodes are provided in the ink container, and an electric resistance or the conduction state between the electrodes is detected. In another method, the ink container is made of a light-transmissive material, and an optical sensor is disposed adjacent the ink container to detect the amount of the light transmitted through the ink container.

However, in the type using the electrodes in the ink container, when the ink container is exchanged (exchangeable type), the parts concerned with a detecting means such as electrodes or the like provided in the ink container have to be exchanged with the result of increase of the manufacturing cost of the ink container and increase of the running cost. In the method detecting the quantity of light passing through the ink container, the erroneous detection tends to occur for the light ink such as yellow ink.

In order to solve the program, Japanese Laid-open Patent Application No. HEI 10-109430 has proposed that first electrode is provided in the recording head, and a second electrode of non-contact type is disposed adjacent the ink container without contacting to the ink container, in which a pulse voltage is applied to the first electrode, and the voltage produced at the second electrode is detected, on the basis of which the remaining amount of the ink in the ink container is detected. In the detection system, the input signal to the first electrode is transmitted through the ink from the recording head to the ink container, and a detection signal is obtained on the basis of the capacitive coupling between the ink container and the second electrode.

In the above-described without, the electrostatic capacity provided by the capacitive coupling changes in accordance with an area of the second electrode opposed to the ink. Therefore, if the ink remains in the form of film at a position opposed to the electrode in the ink reservoir chamber, the erroneous detection results, that is, the existence of the ink is detected despite the fact that it does not exist.

The electrostatic capacity provided by the capacitive coupling described above generally changes with the opposing area retained second electrode and the ink, the distance between the second electrode and the ink or the like, and therefore, by regulating these factors, the electrostatic capacity is fundamentally stabilized so that time constant of the detection system for the detection of the ink remaining amount. In the case that plurality of ink reservoir chambers as in an ink jet recording apparatus for color recording or the like, the electrostatic capacity changes with the amount of the ink in the adjacent ink reservoir chamber, and therefore, the time constant of the detection system is influenced. The change of the time constant causes change of the gain of detection signal so that detection accuracy of the ink remaining amount is deteriorated.

SUMMARY OF THE INVENTION

Accordingly, it is a principal object of the present invention to provide a liquid supplying system and an ink container usable with the system which is usable with the ink container disclosed in EP0738605 and/or EP0581531, and into which the presence or absence of the ink in the ink container can be easily and assuredly detected so that spindle liquid supply is carried out.

It is another object of the present invention to provide a liquid supplying system and a liquid supply container in which a plurality of liquid containing chambers are juxtaposed, the remaining amount of the liquid in the liquid containing chambers are detected with high accuracy so that ink can be supplied stably, in addition to the first object or solely.

It is a further object of the present invention to provide a liquid supplying system and a liquid supply container in which the amount of the remaining liquid can be detected with high accuracy so that liquid can be supply stably, in addition to the first or second object or solely.

According to a first aspect of the present invention, there is provided a liquid supply system comprising: a liquid supply container provided with a liquid supply portion for supplying liquid to outside; detecting means for detecting presence or absence of the liquid in said liquid supply container, using an electrostatic capacity between the liquid in said liquid supply container and said electrode; wherein said electrode is disposed to be parallel with and spaced from a bottom surface of said liquid supply container, and the bottom surface is inclined relative to a horizontal plane from one end to another end of said liquid supply container, and has a connecting portion at a lower side end.

According to this aspect, the bottom surface of the liquid supply container is inclined relative to the horizontal plan, and the connecting portion is provided at a lower end, and then if the amount of the remaining liquid in the liquid containing portion is lower than the inclined surface, the area of the ink opposed to the electrode decreases with reduction of the liquid. With this, the electrostatic capacity detected by the detecting means decreases so that reduction of the amount of the remaining liquid can be assuredly detected.

The present invention provides a liquid supply system comprising: a negative pressure producing member accommodating chamber accommodating therein a negative pressure producing member and having a liquid supply portion for supplying liquid to outside; a liquid supply container connected with said negative pressure producing member accommodating chamber through a connecting portion and having a liquid reservoir portion which defines a substantially sealed space except for the connecting portion; an electrode extended parallel with a bottom surface of said liquid supply container, provided at least below said liquid supply container; detecting means for detecting an amount of the remaining liquid in said liquid containing portion on the basis of an electrostatic capacity between said electrode and the liquid in the liquid containing portion, wherein a configuration of said liquid reservoir portion is substantially similar to an inner configuration of said liquid supply container, and is capable of providing a negative pressure corresponding to deformation of the part corresponding to the bottom surface portion of said liquid supply container.

According to this system, the liquid containing portion deforms inwardly during consumption of the liquid from the liquid supply portion so that balance between the supply negative pressure producing member accommodating chamber and the ink supply is provided, the deformation occurs in the bottom surface of the liquid containing portion. Therefore, the remaining amount in the liquid containing portion reaches the bottom portion of the liquid containing portion, the area of the liquid opposed to the electrode decreases, the reduction of the amount of the remaining liquid can be easily and assuredly detected by detecting the change.

According to a second aspect of the present invention, there is provided a liquid supply system comprising a plurality of such liquid supply containers each having the liquid supply portion, wherein amounts of the remaining liquid in said liquid supply container is detected on the basis of impedances between the liquids and the electrode; wherein said liquid supply containers are disposed adjacent to one another, and each of said liquid supply containers has a side wall having a thickness which is smaller than a thickness of the bottom wall opposed to said electrode.

The inventors have particularly noted the electrostatic capacity between adjacent liquid containers when the remaining amount of the liquid in the liquid container is detected.

According to this aspect, the amount of the remaining liquid in the liquid supply container can be detected by detecting the change of the impedance between the electrode and the liquid in the liquid supply container (liquid containing portion). The thickness of the wall of the liquid supply container (liquid containing portion) is such that thickness of the side wall opposing to the adjacent liquid supply container is larger than a thickness of the bottom wall opposed to the electrode, and therefore, the influence of the electrostatic capacity produced between the adjacent liquid supply containers can be suppressed so that remaining amount of the liquid in the liquid supply container intended can be detected with high accuracy.

According to a third aspect of the present invention, there is provided a liquid supply system comprising a liquid supply container having a liquid supply portion for supplying liquid to outside; an electrode, disposed below said liquid supply container, for detecting an amount of the remaining liquid in inner on the basis of an impedance between the liquid and the electrode; a separating structure, provided in a region of said liquid supply container at a liquid supply portion side beyond a portion opposed the electrode, for separating the liquid in a region opposed to said electrode from a liquid supply portion side when a remaining amount of the liquid in said liquid supply container is a predetermined amount to be detected.

According to this aspect of the present invention, the change of the impedance between the electrode and the liquid in the liquid supply container (liquid containing portion), by which amount of the remaining liquid is detected. Here, the bottom wall of the liquid supply container (liquid containing portion) is provided with a separating structure, and therefore, when the remaining amount of the liquid in the liquid supply container, the liquid in the region opposed to the electrode is assuredly separated from the connecting portion (liquid discharge portion) side even if the liquid remains in the form of film on the bottom wall of the liquid supply container. Accordingly, the electrical circuit gained liquid and the electrode through the bottom wall of the liquid supply container is separated with the result of increased impedance. By detecting the event, the reduction of the amount of the remaining liquid in the liquid supply container can be detected.

The separating structure may be a protection extended in an entire area in the direction crossing with the direction toward the liquid discharge portion from the region opposing to the electrode, or it may be a step. The projection may include a first surface at a liquid discharging side and a second surface opposed to said electrode, and wherein an angle of the first surface relative to a horizontal plane in use is larger than an angle of the second surface relative to a horizontal plane. With this, the liquid separated by the projection can move toward the liquid discharge portion easily, whereas it is not easily moved toward the electrode opposing side.

The liquid supply container may be provided with recess. With this, the correct positioning of the liquid supply container is accomplished relative to the holder having a projection corresponding to the recess.

The present invention provides a liquid supply container per se.

The present invention provides a liquid container comprising: a liquid containing portion for accommodating liquid; a liquid discharge portion for discharging the liquid to outside; wherein said liquid supply container is provided with a bottom surface which is opposed to an electrode disposed below said liquid supply container, for detecting remaining amount of the liquid in said liquid containing portion on the basis of an electrostatic capacity between said electrode and the liquid.

The present invention provides a liquid supply container comprising: a plurality of liquid containing portions for accommodating liquid; a liquid discharge portions for discharging the liquid to outside; wherein said liquid containing portions are disposed adjacent to one another; wherein said liquid containing portion is provided with a bottom wall to which an electrode for detecting a remaining amount of the liquid in said liquid containing portion on the basis of an impedance between the liquid and said electrode; wherein said liquid containing portion includes a side wall opposed to the liquid containing portion adjacent thereto, said side walls having a thickness larger than that of said bottom wall.

The present invention provides a liquid container comprising: a liquid containing portion for accommodating liquid; a liquid discharge portion for discharging the liquid to outside; wherein said liquid containing portion is provided with a bottom wall to which an electrode for detecting a remaining amount of the liquid in said liquid containing portion on the basis of an impedance between the liquid and said electrode; a separating structure, provided in a region of said liquid supply container at a liquid supply portion side beyond a portion opposed the electrode, for separating the liquid in a region opposed to said electrode from a liquid supply portion side when a remaining amount of the liquid in said liquid supply container is a predetermined amount to be detected.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIGS. 45(*a*)through (*e*) illustrations of a sixth modified example.

DESCRIPTION OF THE PREFERRED EMBODIMENTS

Hereinafter, the embodiments of the present invention will be described with reference to the appended drawings.

In the following description of the embodiments of the present invention, "hardness" of a capillary force generating portion means the "hardness" of the capillary force generating portion when the capillary force generating member is in the liquid container. It is defined by the inclination of the amount of resiliency of the capillary force generating member relative to the amount of deformation. As for the difference in hardness between two capillary force generating members, a capillary force generating member which is greater in the inclination in the amount of resiliency relative to the amount of deformation is considered to be "harder capillary force generating member".

General Structure

Figure 1:
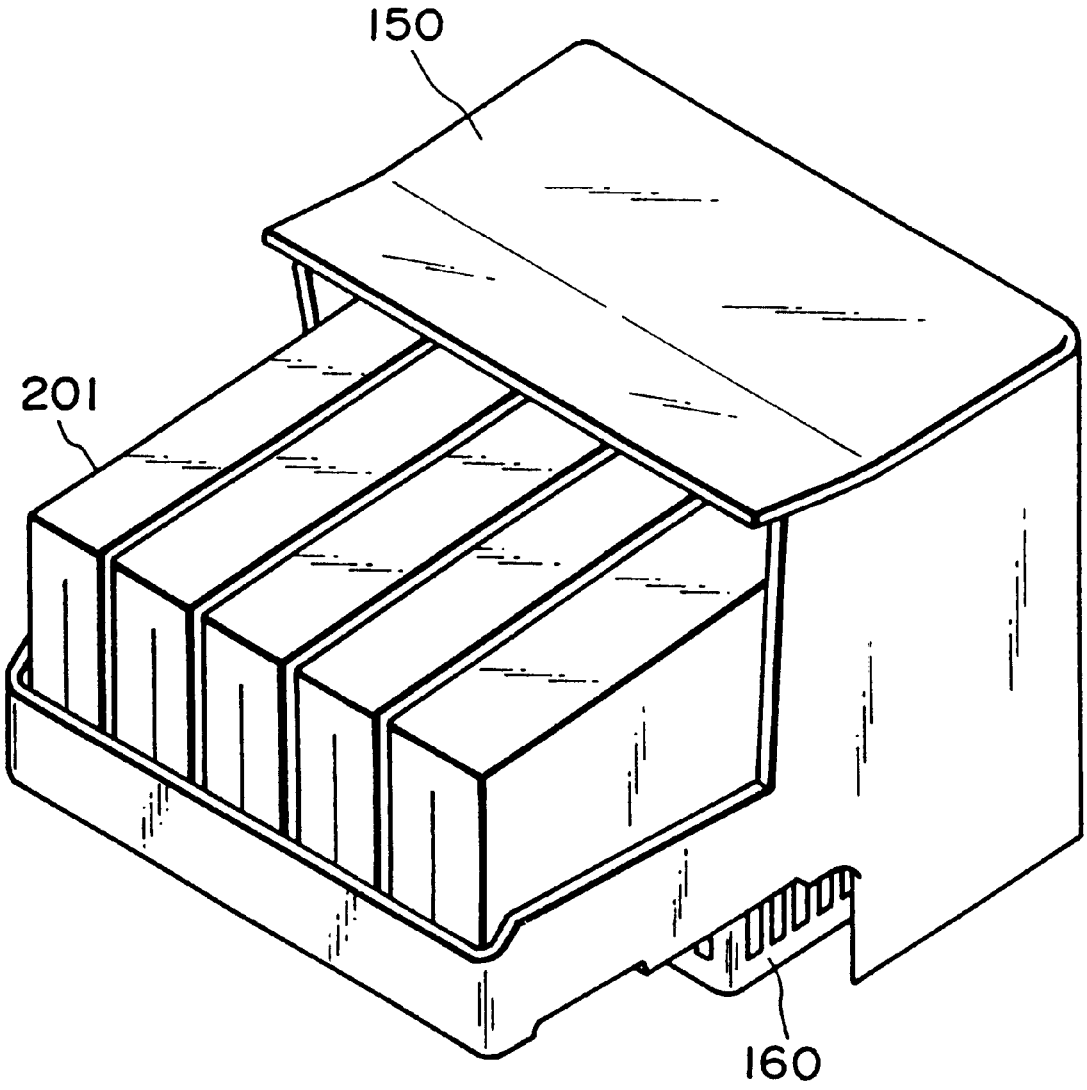
FIG. 1 is a perspective view of the ink jet head cartridge in one of the embodiments of the present invention.
Figure 2:
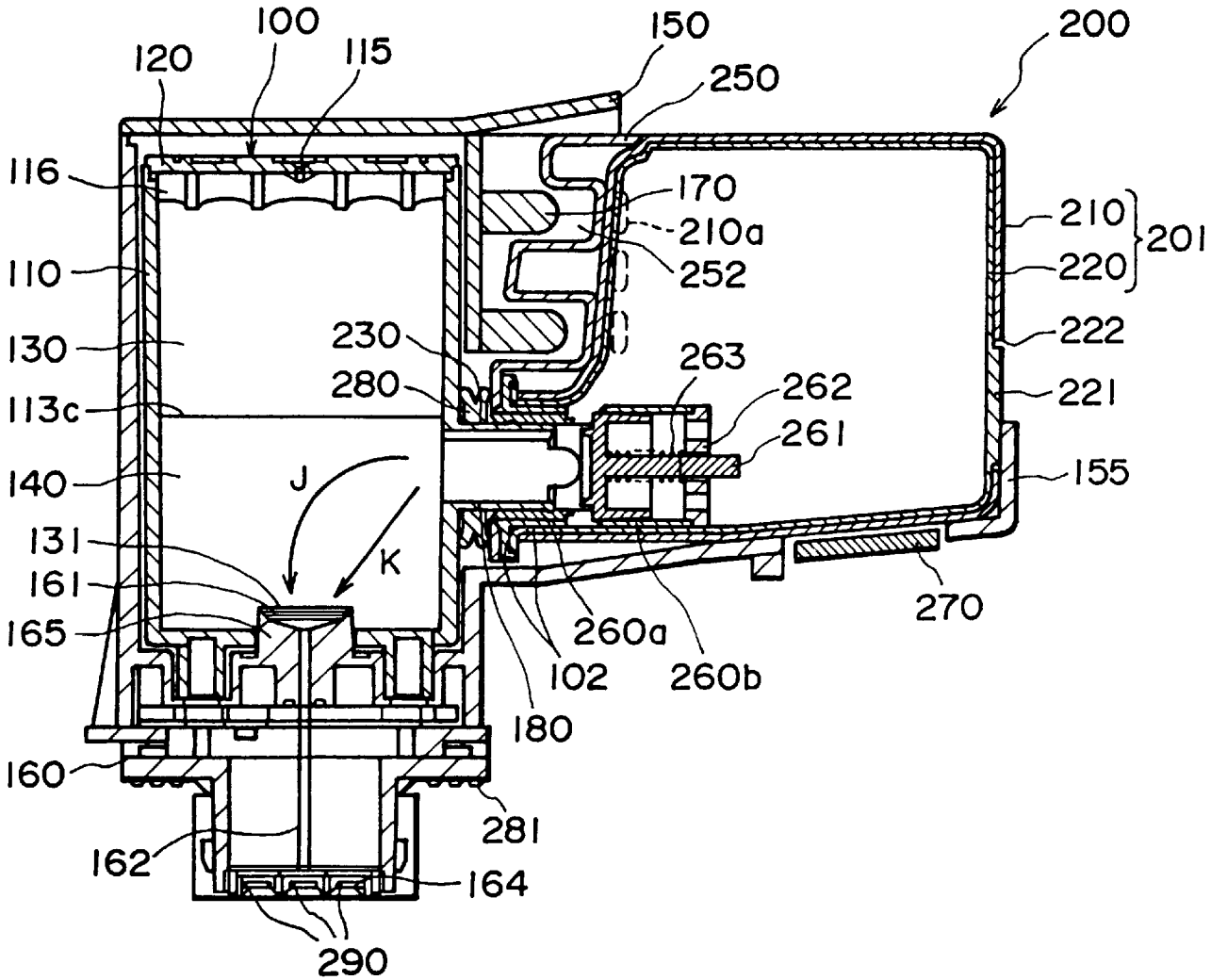
FIG. 2 is a sectional view of the cartridge in FIG. 1.

FIG. 1 is a perspective view of the ink jet head cartridge in the first of the embodiments of the present invention, and FIG. 2 is a sectional view of the same ink jet head cartridge.

In this embodiment, each of the structural components of the ink jet head cartridge in accordance with the present invention, and the relationship among these components, will be described. Since the ink jet head cartridge in this embodiment was structured so that a number of innovative technologies, which were developed during the making of the present invention, could be applied to the ink jet cartridge which was being invented, the innovative structures will also be described as the overall description of this ink jet head cartridge is given.

Referring to FIGS. 1 and 2, the ink jet head cartridge in this embodiment comprises an ink jet head unit 160, a holder 150, a negative pressure controlling chamber unit 100, an ink container unit 200, and the like. The negative pressure controlling chamber unit 100 is fixed to the inward side of the holder 150. Below the negative pressure controlling chamber unit 100, the ink jet head is attached to the outward side of the bottom wall portion of the holder 150. Using screws or interlocking structures, for ease of disassembly, to fix the negative pressure controlling chamber unit 100 and ink jet head unit 160 to the holder 150 is desirable in terms of recycling, and also is effective for reducing the cost increase which is incurred by the structural modification or the like. Further, since the various components are different in the length of service life, the aforementioned ease of disassembly is also desirable because it makes it easier to replace only the components which need to be replaced. It is obvious, however, that they may be permanently connected to each other by welding, thermal crimping, or the like. The negative pressure controlling chamber unit 100 comprises: a negative pressure controlling chamber shell 110, which is open at the top; a negative pressure controlling chamber cover 120 which is attached to the top portion of the negative pressure controlling chamber shell 110 to cover the opening of the negative pressure controlling chamber shell 110; two pieces of absorbent material 130 and 140 which are placed in the negative pressure controlling chamber shell 110 to hold ink by impregnation. The absorbent material pieces 130 and 140 are filled in vertical layers in the negative pressure controlling chamber shell 110, with the absorbent material piece 130 being on top of the absorbent material piece 140, so that when the ink jet head cartridge is in use, the absorbent material pieces 130 and 140 remain in contact with each other with no gap between them. The capillary force generated by the absorbent material piece 140, which is at the bottom, is greater than the capillary force generated by the absorbent material piece 130 which is at the top, and therefore, the absorbent material piece 140 which is at the bottom is greater in ink retainment. To the ink jet head unit 160, the ink within the negative pressure controlling chamber unit 100 is supplied through an ink supply tube 165.

The opening 131 of the ink supply tube 160, on the absorbent material piece 140 side, is provided with a filter 161; which is in contact with the absorbent material piece 140, being under the pressure from the elastic member. The ink container unit 200 is structured so that it can be removably mounted in the holder 150. A joint pipe 180, which is a portion of the negative pressure controlling chamber shell 110 and is located on the ink container unit 200 side, is connected to the joint opening 230 of the ink container unit 200 by being inserted thereinto. The negative pressure controlling chamber unit 100 and ink container unit 200 are structured so that the ink within the ink container unit 200 is supplied into the negative pressure controlling chamber unit 100 through the joint portion between the joint pipe 180 and joint opening 230. Above the joint pipe 180 of the negative pressure controlling chamber shell 110, on the ink container unit 200 side, there is an ID member 170 for preventing the ink container unit 200 from being incorrectly installed, which projects from the surface of the holder 150, on the ink container unit 200 side.

The negative pressure controlling chamber cover 120 is provided with an air vent 115 through which the internal space of the negative pressure controlling chamber shell 110 is connected to the outside; more precisely, the absorbent material piece 130 filled in the negative pressure controlling chamber shell 110 is exposed to the outside air. Within the negative pressure controlling chamber shell 110 and adjacent to the air vent, there is a buffering space 116, which comprises an empty space formed by a plurality of ribs projecting inwardly from the inward surface of the negative pressure controlling chamber cover 120, on the absorbent material piece 130 side, and a portion of the absorbent material piece 130, in which no ink (liquid) is present.

On the inward side of the joint opening 230, a valve mechanism is provided, which comprises a first valve body (or frame) 260*a*, a second valve body 260*b*, valve plug (or member) 261, a valve cover (or cap) 262, and a resilient member 263. The valve plug 261 is held within the second valve body 260*b*, being allowed to slide within the second valve body 260*b* and also being kept under the pressure generated toward the first valve body 260*a* by the resilient member 263. Thus, unless the joint pipe 180 is inserted through the joint opening 230, the edge of the first valve plug 261, on the first valve body 260*a* side, is kept pressed against the first valve body 260*a* by the pressure generated by the resilient member 263, and therefore, the ink container unit 200 remains airtightly sealed.

As the joint pipe 180 is inserted into the ink container unit 200 through the joint opening 230, the valve plug 261 is moved by the joint pipe 180 in the direction to separate it from the first valve body 260*a*. As a result, the internal space of the joint pipe 180 is connected to the internal space of the ink container unit 200 through the opening provided in the side wall of the second valve body 260*b*, breaking the airtightness of the ink container unit 200. Consequently, the ink container unit 200 begins to be supplied into the negative pressure controlling chamber unit 100 through the joint opening 230 and joint pipe 180. In other words, as the valve on the inward side of the joint opening 230 opens, the internal space of the ink holding portion of the ink container unit 200, which remained airtightly sealed, becomes connected to the negative pressure controlling chamber unit 100 only through the aforementioned opening.

It should be noted here that fixing the ink jet head unit 160 and negative pressure controlling chamber unit 100 to the holder 150 with the use of easily reversible means, such as screws, as is done in this embodiment, is desirable because the two units 160 and 100 can be easily replaced as their service lives end.

More specifically, in the case of the ink jet head cartridge in this embodiment, the provision of an ID member on each ink container makes it rare that an ink container for containing one type of ink is connected to a negative pressure controlling chamber for an ink container for containing another type of ink. Further, should the ID member provided on the negative pressure controlling chamber unit 100 be damaged, or should a user deliberately connect an ink container to a wrong negative pressure controlling chamber unit 100, all that is necessary is to replace only the negative pressure control chamber unit 100 as long as it is immediately after the incident. Further, if the holder 150 is damaged by falling or the like, it is possible to replace only the holder 150.

It is desirable that the points, at which the ink container unit 200, negative pressure controlling chamber unit 100, holder 150, and ink jet head unit 160, are interlocked to each other, are chosen to prevent ink from leaking from any of these units when they are disassembled from each other.

In this embodiment, the ink container unit 200 is held to the negative pressure controlling chamber unit 100 by the ink container retaining portion 155 of the holder 150. Therefore, it does not occur that only the negative pressure controlling chamber unit 100 becomes disengaged from the other units, inclusive of the negative pressure controlling chamber unit 100, interlocked among them. In other words, the above components are structured so that unless at least the ink container unit 200 is removed from the holder 150, it is difficult to remove the negative pressure controlling chamber unit 100 from the holder 150. As described above, the negative pressure controlling chamber unit 100 is structured so that it can be easily removed only after the ink container unit 200 is removed from the holder 150. Therefore, there is no possibility that the ink container unit 200 will inadvertently separate from the negative pressure controlling chamber unit 100 and ink leak from the joint portion.

The end portion of the ink supply tube 165 of the ink jet head unit 160 is provided with the filter 161, and therefore, even after the negative pressure controlling chamber unit 100 is removed, there is no possibility that the ink within the ink jet head unit 160 will leak out. In addition, the negative pressure controlling chamber unit 100 is provided with the buffering space 116 (inclusive of the portions of the absorbent material piece 130 and the portions of the absorbent material piece 140, in which no ink is present), and also, the negative pressure controlling chamber unit 100 is designed so that when the attitude of the negative pressure controlling chamber unit 100 is such an attitude that is assumed when the printer is being used, the interface 113*c* between the two absorbent material pieces 130 and 140, which are different in the amount of the capillary force, is positioned higher than the joint pipe 180 (preferably, the capillary force generated at the interface 113*c* and its adjacencies becomes greater than the capillary force in the other portions of the absorbent material pieces 130 and 140). Therefore, even if the structural conglomeration comprising the holder 150, negative pressure controlling chamber unit 100, and ink container unit 200, changes in attitude, there is very little possibility of ink leakage. Thus in this embodiment, the portion of the ink jet head unit 160, by which the ink jet head unit 160 is attached to the holder 150, is located on the bottom side, that is, the side where the electric terminals of the holder 150 are located, so that the ink jet head unit 160 can be easily removed even when the ink container unit 200 is in the holder 150.

Depending upon the shape of the holder 150, the negative pressure controlling chamber unit 100 or ink jet head unit 160 may be integral with, that is, inseparable from, the holder 150. As for a method for integration, they may be integrally formed from the beginning of manufacture, or may be separately formed, and integrated thereafter by thermal crimping or the like so that they become inseparable.

Figures 3A, 3B:
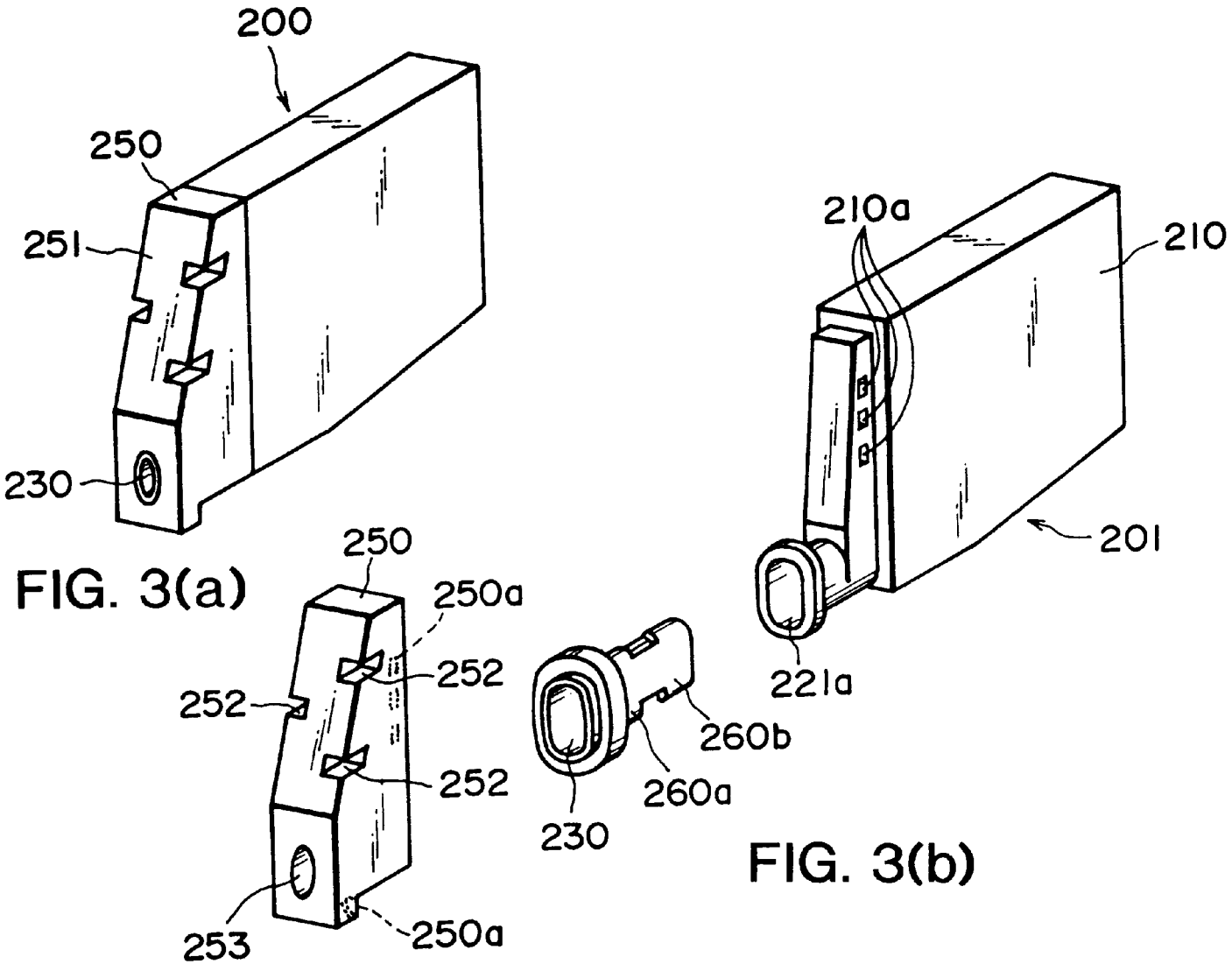
FIGS. 3(*a*) and (*b*) are perspective drawings for depicting the ink container unit illustrated in FIG. 2.
Figure 4A:
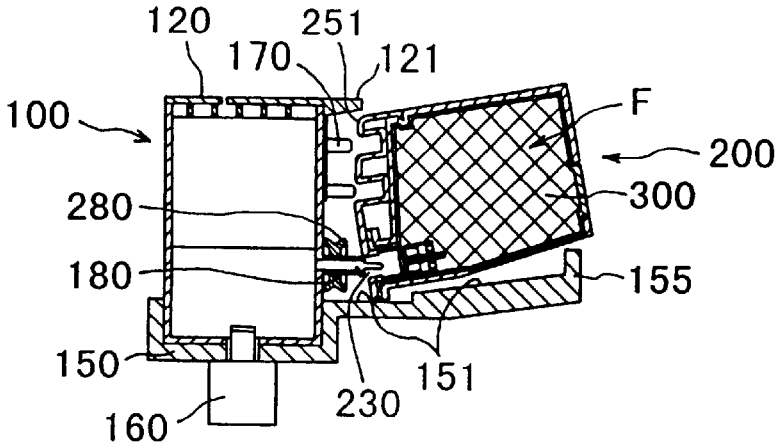
FIGS. 4(*a*) through (*d*) are sectional drawings for depicting the operation for attaching the ink container unit to a holder to which the negative pressure controlling chamber unit illustrated in FIG. 2 has been attached.
Figure 4B:
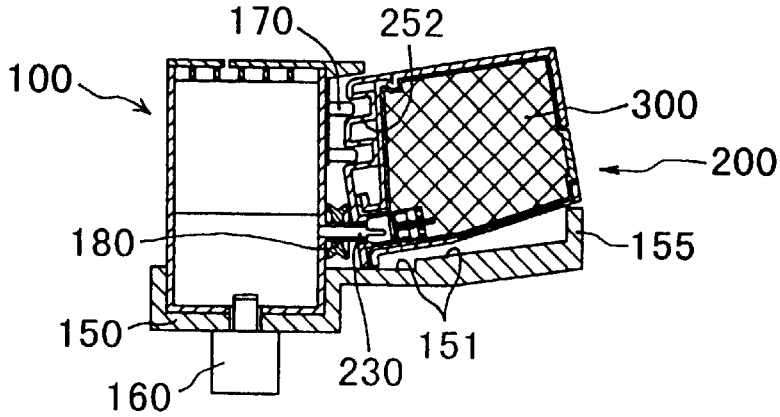
Figure 4C:
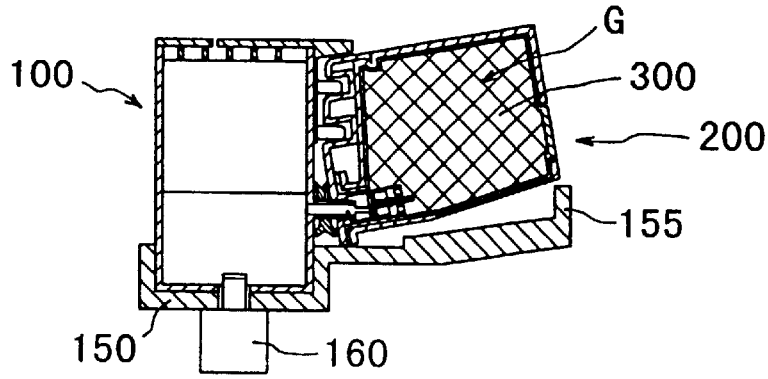
Figure 4D:
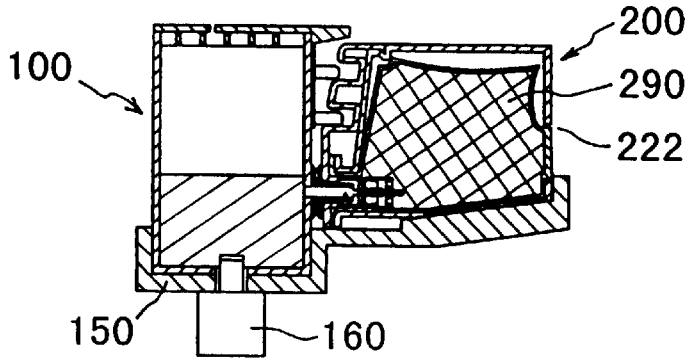
Figure 5A:
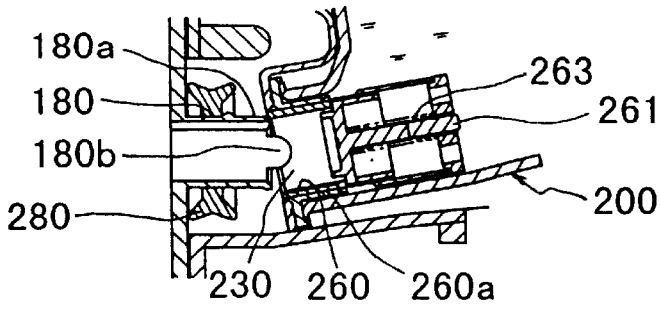
FIGS. 5(*a*) through (*e*) are sectional drawings for depicting the opening and closing operations of the valve mechanism to which the present invention is applicable.
Figure 5B:
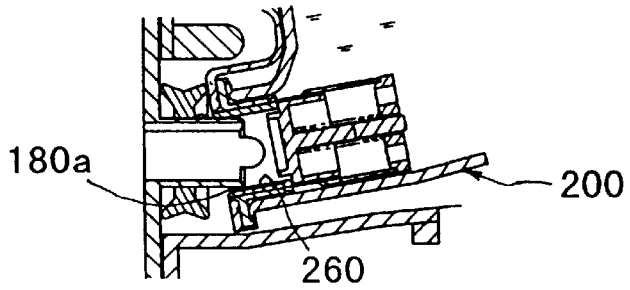
Figure 5C:
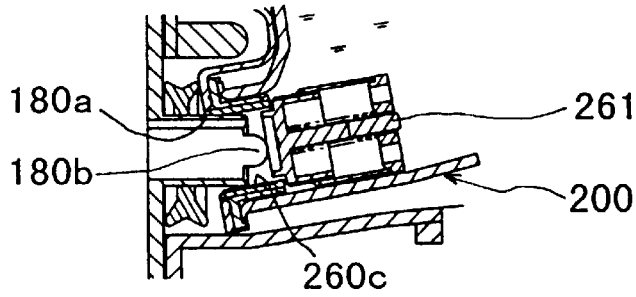
Figure 5D:
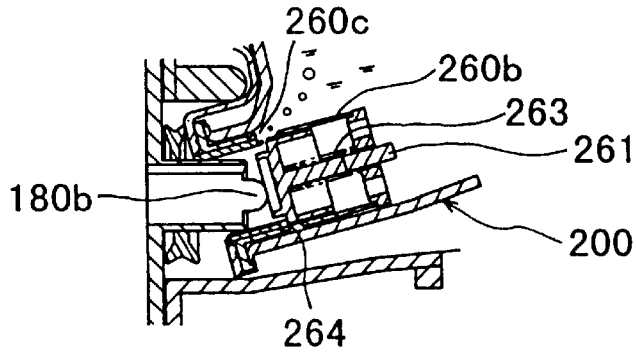
Figure 5E:
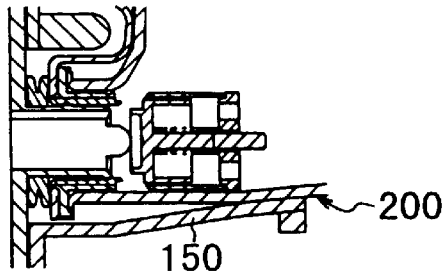

Referring to FIGS. 2, 3(*a*), and 3(*b*), the ink container unit 200 comprises an ink storing or accommodating container or reservoir 201, the valve mechanism comprising the first and second valve bodies 260*a* and 260*b*, and the ID member 250. The ID member 250 is a member for preventing installation mistakes which occur during the joining of ink container unit 200 to negative pressure controlling chamber unit 100.

The valve mechanism is a mechanism for controlling the ink flow through the joint opening 230, and is opened, or closed, as it is engaged with, or disengaged from, the joint pipe 180 of the negative pressure controlling chamber unit 100, respectively. The misalignment, or twisting, of the valve plug, which tends to occur during the installation or removal of the ink container unit 200, is prevented with the provision of an innovative valve structure, which will be described later, or the provision of an ID member 170 and an ID member slots 252, which limit the rotational range of the ink container unit 200.

Ink Container Unit

FIGS. 3(*a*) and (*b*) are perspective drawings for depicting the ink container unit 200 illustrated in FIG. 2. FIG. 3(*a*) is a perspective view of the ink container unit 200 in the assembled form, and FIG. 3(*b*) is a perspective view of the ink container unit 200 in the disassembled form.

The front side of the ID member 250, that is, the side which faces the negative pressure controlling chamber unit 100, is slanted backward from the point slightly above the supply outlet hole 253, forming a slanted (or tapered) surface 251. More specifically, the bottom end, that is, the supply outlet hole 253 side, of the slanted surface 251 is the front side, and the top end, that is, the ink storing container 201 side, of the slanted surface 251 is the rear side. The slanted surface 251 is provided with a plurality of ID slots 252 (three in the case of FIG. 3) for preventing the wrong installation of the ink container unit 200. Also in this embodiment, the ID member 250 is positioned on the front surface (surface with the supply outlet), that is, the surface which faces the negative pressure controlling chamber unit 100, of the ink storing container 201.

The ink storing container 201 is a hollow container in the form of an approximately polygonal prism, and is enabled to generate negative pressure. It comprises the external shell 210, or the outer layer, and the internal bladder 220, or the inner layer (FIG. 2), which are separable from each other. The internal bladder 220 is flexible, and is capable of changing in shape as the ink held therein is drawn out. Also, the internal bladder 220 is provided with a pinch-off portion (welding seam portion) 221, at which the internal bladder 220 is attached to the external shell 210; the internal bladder 220 is supported by the external shell 210. Adjacent to the pinch-off portion 221, the air vent 222 of the external shell 210 is located, through which the outside air can be introduced into the space between the internal bladder 220 and external shell 210.

Figure 19:
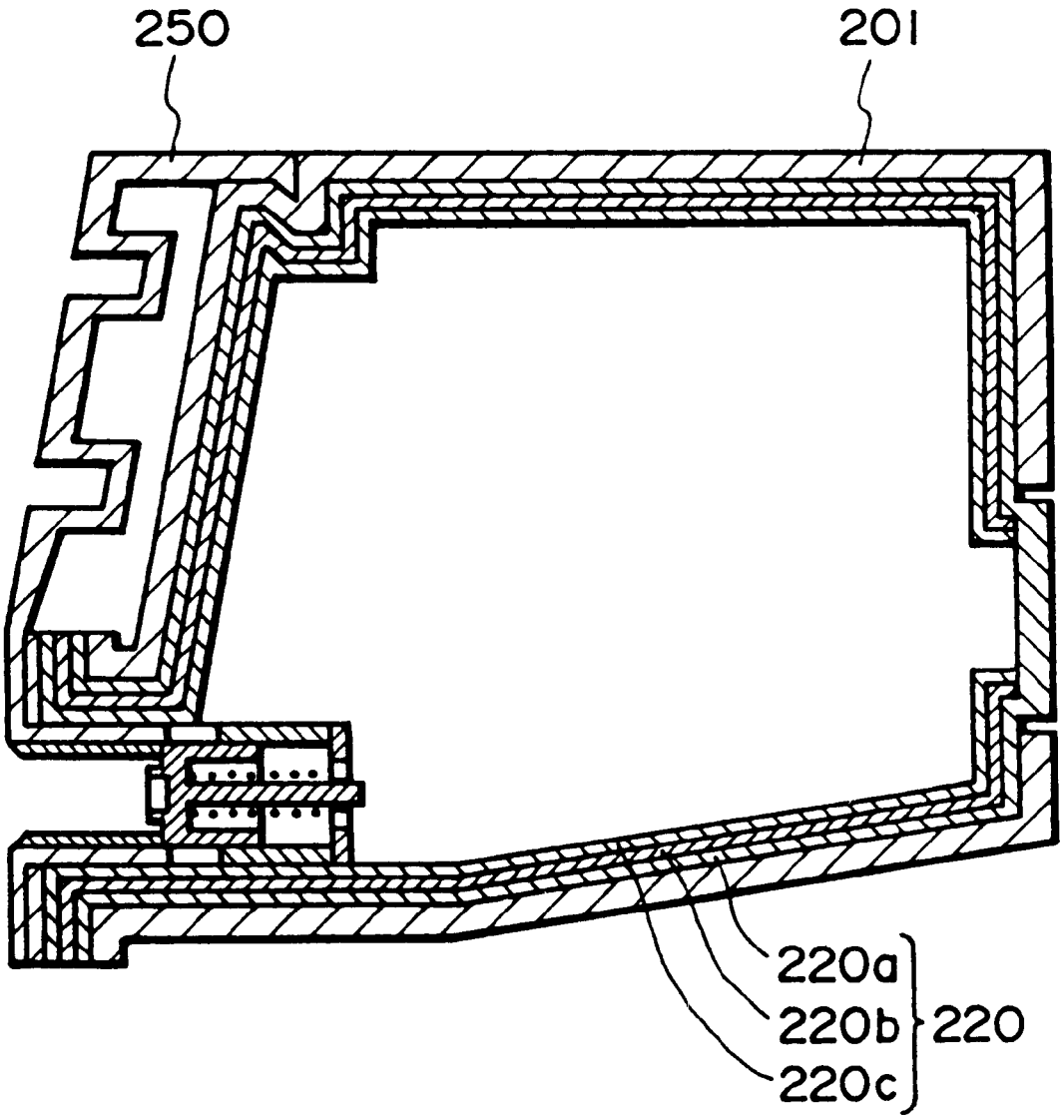
FIG. 19 is a sectional view of the ink storing container illustrated in FIG. 2, for depicting an example of the internal structure of the ink container.

Referring to FIG. 19, the internal bladder 220 is a laminar bladder, having three layers different in function: a liquid contact layer 220*c*, or the layer which makes contact with the liquid; an elastic modulus controlling layer 220*b*; and a gas barrier layer 220*a* superior in blocking gas permeation. The elastic modulus of the elastic modulus controlling layer 220*b* remains virtually stable within the temperature range in which the ink storing container 201 is used; in other words, the elastic modulus of the internal bladder 220 is kept virtually stable by the elastic modulus controlling layer 220*b* within the temperature range in which the ink storing container 201 is used. The middle and outermost layers of the internal bladder 220 may be switched in position; the elastic modulus controlling layer 220*b* and gas barrier layer 220*a* may be the outermost layer and middle layer, respectively.

Structuring the internal bladder 220 as described above makes it possible for the internal bladder 220 to synergistically display each of the individual functions of the ink-resistant layer 220*c*, elastic modulus controlling layer 220*b*, and gas barrier layer 220*a*, while using only a small number of layers. Thus, the temperature sensitive properties, for example, the elastic modulus, of the internal bladder 220 is less likely to be affected by the temperature change. In other words, the elastic modulus of the internal bladder 220 can be kept within the proper range for controlling the negative pressure in the ink storing container 201, within the temperature range in which the ink storing container 201 is used. Therefore, the internal bladder 220 is enabled to function as the buffer for the ink within the ink storing container 201 and negative pressure controlling chamber shell 110 (details will be given later). Consequently, it becomes possible to reduce the size of the buffering chamber, that is, the portion of the internal space of the negative pressure controlling chamber shell 110, which is not filled with ink absorbing material, inclusive of the portion of the absorbent material piece 130, in which ink is not present, and the portion of the absorbent material piece 140, in which ink is not present. Therefore, it is possible to reduce the size of the negative pressure controlling chamber unit 100, which in turn makes it possible to realize an ink jet head cartridge 70 which is superior in operational efficiency.

In this embodiment, polypropylene is used as the material for the liquid contact layer 220*c*, or the innermost layer, of the internal bladder 220, and cyclic olefin copolymer is used as the material for the elastic modulus controlling layer 220*b*, or the middle layer. As for the material for the gas barrier layer 220*a*, or the outermost layer, EVOH (ethylene-vinyl acetate copolymer: EVA resin) is used. It is desired that functional adhesive resin is mixed in the elastic modulus controlling layer 220*b*, because such a mixture eliminates the need for an adhesive layer between the adjacent functional layers, reducing the thickness of the wall of the internal bladder 220.

As for the material for the external shell 210, polypropylene is used, as it is used for the material for the innermost layer of the internal bladder 220. Polypropylene is also used as the material for the first valve body 260*a*.

The ID member 250 is provided with a plurality of ID member slots 252, which are arranged at the left and right edges of the front surface, corresponding to the plurality of ID members 170 for the prevention of the incorrect installation of the ink container unit 200.

The installation mistake preventing function is provided by the installation mistake prevention mechanism, which comprises the plurality of ID members 170 provided on the negative pressure controlling chamber unit 100 side, and the ID member slots 252 provided by the ID member 250 corresponding to the positions of the ID members 170. Therefore, a large number of ink container unit installation areas can be made identifiable by changing the shapes and positions of the ID members 170 and ID member slots 252.

The ID member slots 252 of the ID member 250, and the joint opening 230 of the first valve body 260*a*, are located in the front surface of the ink container unit 200, that is, the front side in terms of the direction in which the ink container unit 200 is installed or removed. They are parts of the ID member 250 and first valve body 260*a*, respectively.

The ink storing container 201 is formed by blow molding, and the ID member 250 and first valve body 260*a* are formed by injection molding. Giving the ink container unit 200 a three piece structure makes it possible to precisely form the valve body and ID member slots 252.

If the ID member slots 252 are directly formed as the portions of the wall of the ink storing container 201 by blow molding, the shape of the internal space of the ink containing portion becomes complicated, affecting the separation of the internal bladder 100 wall, or the inner layer of the ink storing container 201, which sometimes affects the negative pressure generated by the ink container unit 200. Separately forming the ID member 250 and ink container portion 201, and then attaching the ID member 250 to the ink containing portion 202, as the ink container unit 200 in this embodiment is structured, eliminates the aforementioned effect, making it possible to generate and maintain stable negative pressure in the ink storing container 201.

The first valve body 260*a* is attached to at least the internal bladder 220 of the ink storing container 201. More specifically, the first valve body 260*a* is attached by welding the exposed portion 221*a*, that is, the ink outlet portion of the ink storing container 201, to the surface of the joint opening 230 corresponding to the exposed portion 221*a*. Since both the external shell 210 and the innermost layer of the internal bladder 220 are formed of the same material, that is, polypropylene, the first valve body 260*a* can be welded to the external shell 210 also at the periphery of the joint opening 230.

The above described welding method increases accuracy in the positional relationship among the mutually welded components, while perfectly sealing the supply outlet portion of the ink storing container 201, and therefore, preventing ink leakage or the like which tends to occur at the seal portion between the first valve body 260*a* and the ink storing container 201 when the ink container unit 200 is installed, removed, or the like motion. When the first valve body 260*a* is attached to the ink storing container 201 by welding as in the case of the ink container unit 200 in this embodiment, it is desired for the sake of better sealing that the material for the internal bladder 220 layer, which provides the bonding surface, is the same as the material for the first valve body 260*a*.

As for the attachment of the ID member 250 to the external shell 210, in order to firmly join them, the shell surface which faces the sealing surface 102 of the first valve body 260*a*, which is bonded to the ink containing portion 210, is joined, by interlocking, to the click portions 250*a* of the ID member 250, which is located at the bottom portion of the ID member 250, and the engagement portion 210*a* of the external shell 210, which is located on the side walls of the external shell 210, are interlocked with the other click portions 250*a* of the ID member 250.

Regarding the word "interlocking",the mutually interlockable portions of these components are structured in the form of a projection or an indentation which fit with each other in an easily disengageable manner. Interlocking the ID member 250 with the ink storing container 201 allows both components to move slightly against each other. Therefore, the force generated by the contact between the ID members 170 and the ID member slots 252 during the installation or removal of these components can be absorbed to prevent the ink container unit 200 and negative pressure controlling chamber unit 100 from being damaged during the installation or removal of these components.

Also, interlocking the ID member 250 with the ink storing container 201 using only a limited number of the portions of the possible contact area makes it easier to disassemble the ink container unit 200, which is beneficial in consideration of its recycling. Providing indentations as the engagement portions 210*a* in the side walls of the external shell 210 makes the structure of the ink storing container 201 simpler to form by blow molding, and therefore, makes the mold pieces simpler. In addition, it makes it easier to control the film thickness.

Also regarding the joining of the ID member 250 to the external shell 210, the ID member 250 is joined to the external shell 210 after the first valve body 260*a* is welded to the external shell 210. Since the click portions 250*a* are interlocked with the engagement portions 210*a*, in the state in which the peripheral portion of the first valve body 260*a* is tightly surrounded at the periphery of the joint opening 230 by the inward surface of the ID member 250, the joint portion becomes stronger against the force which applies to the joint portion when the ink container unit 200 is installed or removed.

The shape of the ink storing container 201 is such that the portion to be covered by the ID member 250 is recessed, and the supply outlet portion protrudes. However, the protruding shape of the front side of the ink container unit 200 is hidden from view by the fixation of the ID member 250 to the ink storing container 201. Further, the welding seam between the first valve body 260*a* and ink storing portion 201 is covered by the ID member 250, being thereby protected. The relationship between the engagement portions 210*a* of the external shell 210 and the corresponding click portions 250*a* of the ID member 250, with regard to which side is projecting and which side is recessed, may be reversal to their relationship in this embodiment.

As described before, it is assured by the joint pipe 180 and valve mechanism that ink does not leak when the ink container unit 200 is installed. In this embodiment, a rubber joint portion 280 is fitted around the base portion of the joint pipe 180 of the negative pressure controlling chamber unit 100 to deal with unpredictable ink leakage. The rubber joint portion 280 seals between the ID member 250 and ink container unit 200, improving the degree of airtightness between the negative pressure controlling chamber unit 100 and ink container unit 200. When removing the ink container unit 200, this airtightness could function as resistance. However, in the case of this embodiment, the ID member 250 and ink storing container 201 are interlocked with the presence of a small amount of gap, allowing air to be introduced between the rubber joint portion 280 and ID member 250, and therefore, although ink is prevented from leaking, the force necessary to be applied for removing the ink container unit 200 is not as large as it otherwise would be, because of the provision of the rubber joint portion 280.

Further, the positions of the ink storing container 201 and IC member 250 can be controlled in terms of both the lengthwise and widthwise directions. The method for joining the ink storing container 201 with the ID member 250 does not need to be limited to a method such as the one described above; different joining points and different joining means may be employed.

Figure 22:
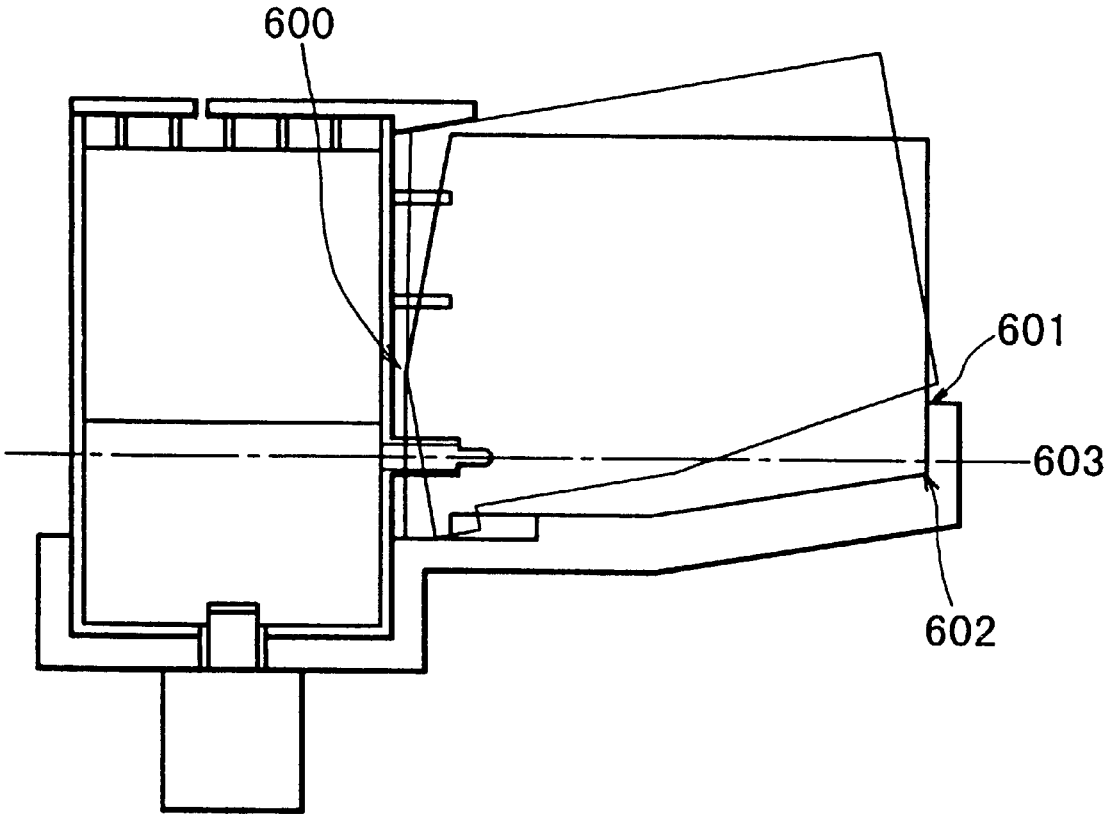
FIG. 22 is a schematic drawing for depicting the rotation of the ink container unit illustrated in FIG. 2, which is caused when the ink container unit is installed or removed.

Referring to FIGS. 2 and 22, the bottom wall of the ink storing container 201 is slanted upward toward the rear, and is engaged with the ink containing unit engagement portion 155 of the holder 150, by the bottom rear portion, that is, the portion opposite to the ink outlet side. The holder 150 and ink container unit 200 are structured so that when removing the ink container unit 200 from the holder 150, the portion of the ink storing container 201, which is in contact with the ink containing portion engagement portion 155, can be moved upward. In other words, when the ink container unit 200 is removed, the ink container unit 200 is rotated by a small angle. In this embodiment, the center of this rotation virtually coincides with the supply outlet opening (joint opening 230). However, strictly speaking, the position of this rotational center shifts as will be described later. In the case of the above described structural arrangement, which requires the ink container unit 200 to be rotationally moved to be disengaged from the holder 150, the greater the difference by which the distance (A) from the rotational center of the ink container unit 200 to the bottom rear corner of the ink container unit 200 corresponding to the ink containing unit engagement portion 155, is longer than the distance (B) from the same rotational center to the ink containing unit engagement portion 155, the more frictionally do the bottom rear corner of the ink container unit 200 and the image containing unit engagement portion 155 rub against each other, requiring a substantially greater amount of force to install the ink container unit 200, which sometimes causes problems such as deformation of the contact areas on both the ink container unit 200 side and holder 150 side.

Slanting the bottom wall of the ink storing container 201 so that the position of the ink containing portion engagement portion 155 side of the bottom wall of the ink storing container 201 becomes higher than that of the front end of the ink storing container 201, as in this embodiment, prevents the ink container unit 200 from heavily rubbing against the holder 150 during its rotational motion. Therefore, the ink container unit 200 can be smoothly installed or removed.

In this embodiment, the joint opening 230 of the ink jet head cartridge is located in the bottom portion of the sidewall of the ink storing container 201, on the negative pressure controlling chamber unit side, and the bottom portion of another wall of the ink storing container 201, that is, the wall opposite to the wall in which the joint opening 230 is located is engaged with the ink container engagement portion 155; in other words, the bottom rear portion of the ink storing container 201 is engaged with the ink storing container engagement portion 155. Also, the ink storing container engagement portion 155 extends upward from the bottom wall of the holder 150, so that the position of the top portion of the ink storing container engagement portion 155 becomes approximately the same as the position 603 of the horizontal center line of the joint opening 230, in terms of the vertical direction. With this arrangement, it is assured that the horizontal movement of the joint opening 230 is regulated by the ink storing container engagement portion 155 to keep the joint opening 230 correctly connected with the joint pipe 180. In this embodiment, in order to assure that the joint opening 230 is correctly connected with the joint pipe 180 during the installation of the ink container unit 200, the top end of the ink storing container engagement portion 155 is positioned at approximately the same height as the upper portion of the joint opening 230, and the ink container unit 200 is removably installed into the holder 150 by rotating the ink container unit 200 about a portion of the front surface of the ink container unit 200 on the joint opening 230 side. During the removal of the ink container unit 200, the portion of the ink container unit 200 which remains in contact with the negative pressure controlling chamber unit 100 functions as the rotational center for the ink container unit 200. As is evident from the above description, making the bottom wall of the ink storing container 201 of the ink jet head cartridge slanted upward toward its bottom rear portion as described above reduces the difference between the distance from the rotational center 600 to the top end of the ink storing container engagement portion, and the distance from the rotational center 600 to the bottom end of the ink storing container engagement portion. Therefore, the portions of the ink container unit 200, which make contact with the holder 150, and the portions of the holder 150, which make contact with the ink container unit 200, are prevented from strongly rubbing against each other. Therefore, the ink container unit 200 can be smoothly installed or removed.

By shaping the ink storing container 201 and holder 150 as described above, it is possible to keep relatively small the size of the portion of the bottom rear portion of the ink storing container 201, which rubs against the ink storing container engagement portion 155 during the installation or removal of the ink container unit 200, and the size of the portion of the ink storing container engagement portion 155, which rubs against the bottom rear portion of the ink storing container 201, even if the joint opening 230 is enlarged to deliver ink at a greater volumetric rate. Therefore, the ink container unit 200 is prevented from uselessly rubbing against the ink storing container engagement portion 155 during the installation of the ink container unit 200 into the holder 150, and yet, it is assured that the ink container unit 200 remains firmly attached to the holder 150.

Next, referring to FIG. 22, the movement of the ink container unit 200 during its installation or removal will be described in detail. When the distance from the rotational center 600, about which the ink container unit 200 rotates during its installation or removal, to the bottom end 602 of the ink container engagement portion, is greater than the distance from the same rotational center 600 to the top end 601 of the ink container engagement portion, by an excessive margin, the force necessary for the installation or removal of the ink container unit 200 is excessively large, and therefore, it sometimes occurs that the top end 601 of the ink container engagement portion is shaved, or the ink storing container 201 deforms.

Thus, the difference between the distance from the rotational center 600, about which the ink container unit 200 rotates during its installation or removal, to the bottom end 602 of the ink container engagement portion, and the distance from the same rotational center 600 to the top end 601 of the ink container engagement portion, should be as small as possible within a range in which the ink container unit 200 is retained in the holder 150 with a proper degree of firmness while affording smooth installation or removal of the ink container unit 200.

If the position of the rotational center 600 of the ink container unit 200 is made lower than the position of the center of the joint opening 230, the distance from the rotational center 600, about which the ink container unit 200 rotates during its installation or removal, to the top end 601 of the ink container engagement portion, becomes longer than the distance from the same rotational center 600 to the bottom end 602 of the ink container engagement portion. Therefore, it becomes difficult to accurately hold the ink storing container 201 at a point which is at the same height as the center of the joint opening 230. Thus, in order to accurately position the vertical center of the joint portion 230, it is desired that the position of the rotational center 600 of the ink container unit 200 is higher than the position of the vertical center of the joint opening 230.

If the structure of the ink container unit 200 is changed so that the position of the rotational center 600 of ink container unit 200 becomes higher than the position 603 of the vertical center of the joint opening 230, the portion of the ink container unit 200, which corresponds to the ink container engagement portion 155, becomes thicker, requiring the height of the ink storing container engagement portion 155 to be increased. As a result, there will be an increased possibility that the ink container unit 200 and holder 150 will be damaged. Thus, it is desired, in view of the smoothness of the installation or removal of the ink container unit 200, that the position of the rotational center 600 of the ink container unit 200 is close to the vertical center of the joint opening 230. The height of the ink container engagement portion 155 of the holder 150 has to be properly determined based only on the ease of the installation or removal of the ink container unit 200. However, if the height of the ink container engagement portion 155 is increased so that the position of its top end becomes higher than that of the rotational center 600, the length by which the ink container unit 200 contacts the ink container engagement portion 155 of the holder 150 becomes greater, which in turn increases the sizes of the portions on both sides, which rub against each other. Therefore, in consideration of the deterioration of the ink container unit 200 and holder 150, the height of the ink container engagement portion 155 is such that the position of its top end is lower than that of the rotational center 600.

In the ink jet head cartridge in this embodiment, the elastic force for keeping the position of the ink storing container 201 fixed in terms of the horizontal direction is a combination of the force generated by the resilient member 263 for pressing the valve plug 261, and the force generated by the resiliency of the rubber joint portion 280 (FIG. 4). However, the configuration for generating the above resiliency does not need to be limited to the one in this embodiment; the bottom rear end, or the engagement portion, of the ink storing container 201, the surface of the ink storing container engagement portion 155, on the ink storing container side, the negative pressure controlling chamber unit 100, or the like, may be provided with an elastic force generating means for keeping the position of the ink storing container 201 fixed in terms of the horizontal direction. When the ink storing container is in connection with the negative pressure controlling chamber, the rubber joint portion 280 remains compressed between the walls of the negative pressure controlling chamber and ink storing container, assuring that the joint portion (peripheral portion of the joint pipe) is airtightly sealed (it is not necessary to maintain perfect airtightness as long as the size of the area exposed to the outside air can be minimized). Also, the rubber joint portion 280 plays an auxiliary role in coordination with a sealing projection, which will be described later.

Next, the internal structure of the negative pressure controlling chamber unit 100 will be described.

In the negative pressure controlling chamber unit 100, the absorbent material pieces 130 and 140 are disposed in layers as members for generating negative pressure, the former being on top of the latter. Thus, the absorbent material piece 130 is exposed to the outside air through the air vent 115, whereas the absorbent material piece 140 is airtightly in contact with the absorbent material piece 130, at its top surface, and also is airtightly in contact with the filter 161 at its bottom surface. The position of the interface between the absorbent material pieces 130 and 140 is such that when the ink jet head cartridge is placed in the same attitude as the ink jet head cartridge is in use, it is higher than the position of the uppermost portion of the joint pipe 180 as a liquid passage.

The absorbent material pieces 130 and 140 are formed of fibrous material, and are held in the negative pressure controlling chamber shell 110, so that in the state in which the ink jet head cartridge 70 has been properly installed into the printer, its fibers extend in substantially the same, or primary, direction, being angled (preferably, in the virtually horizontal direction as they are in this embodiment) relative to the vertical direction.

As for the material for the absorbent material pieces 130 and 140, the fibers of which are arranged in virtually the same direction, short (approximately 60 mm) crimped mixed strands of fiber formed of thermoplastic resin (polypropylene, polyethylene, and the like) are used. In production, a wad of such strands is put through a carding machine to parallel the strands, is heated (heating temperature is desired to be set higher than the melting point of polyethylene, which is relatively low, and lower than the molding point of polypropylene, which is relatively high), and then, is cut to a desired length. The fiber strands of the absorbent material pieces in this embodiment are greater in the degree of alignment in the surface portion than in the center portion, and therefore, the capillary force generated by the absorbent members is greater in the surface portion than in the center portion. However, the surfaces of the absorbent material pieces are not as flat as a mirror surface. In other words, they have a certain amount of unevenness which results mainly when the slivers are bundled; they are three dimensional, and the intersections of the slivers, at which they are welded to each other, are exposed from the surfaces of the absorbent material pieces. Thus, in strict terms, the interface 113*c* between the absorbent material pieces 130 and 140 is an interface between the two uneven surfaces, allowing ink to flow by a proper amount in the horizontal direction along the interface 113*c* and also through the adjacencies of the interface 113*c*. In other words, it does not occur that ink is allowed to flow far more freely along the interface 113*c* than through its adjacencies, and therefore, an ink path is formed through the gaps between the walls of the negative pressure controlling chamber shell 110 and absorbent material pieces 130 and 140, and along the interface 113*c*. Thus, by making a structural arrangement so that the interface 113*c* between the absorbent material pieces 130 and 140 is above the uppermost portion of the joint pipe 180, preferably, above and close to the uppermost portion of the joint pipe 180 as in this embodiment, when the ink jet head cartridge is positioned in the same attitude as it is when in use, the position of the interface between the ink and gas in the absorbent material pieces 130 and 140 during the gas-liquid exchange, which will be described later, can be made to coincide with the position of the interface 113*c*. As a result, the negative pressure in the head portion during the ink supplying operation can be stabilized.

Figure 20:
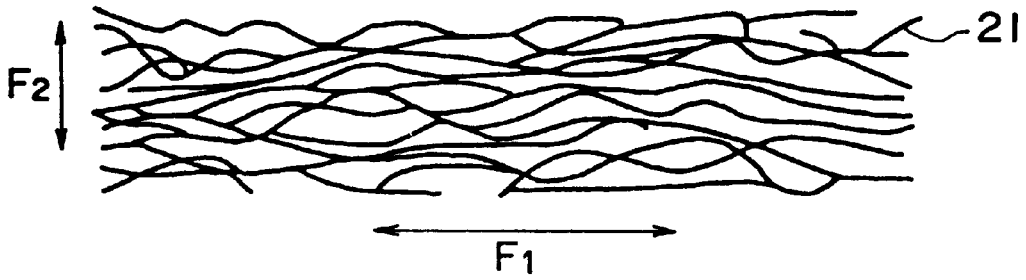
FIG. 20 is a schematic drawing for depicting the absorbent material in the negative pressure controlling chamber shell illustrated in FIG. 2.

Referring to FIG. 20, if attention is paid to the directionality of the strands of fiber in any portion of the fibrous absorbent material piece, it is evident that plural strands of fiber are extended in a direction F1, or the longitudinal direction of the absorbent material piece, in which the strands have been arranged by a carding machine. In terms of the direction F2 perpendicular to the direction F1, the strands are connected to each other by being fused to each other at their intersections during the aforementioned heating process. Therefore, the fiber strands in the absorbent material pieces 130 and 140 are not likely to be separated from each other when the absorbent material pieces 130 or 140 is stretched in the direction F1. However, the fiber strands which are not likely to separate when pulled in the direction F1 can be easily separated at the intersections at which they have been fused with each other if the absorbent material piece 130 or 140 is stretched in the direction F2.

Since the absorbent material pieces 130 and 140 formed of the fiber strands possess the above described directionality in terms of the strand arrangement, the primary fiber direction, that is, the fiber direction F1 is different from the fiber direction F2 perpendicular to the direction F1 in terms of how ink flows through the absorbent pieces, and also in terms of how ink is statically held therein.

Figure 21A:
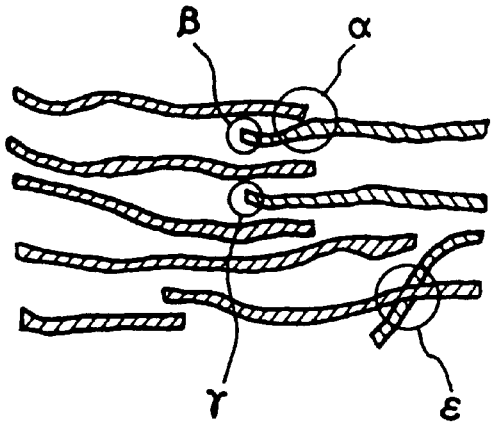
FIGS. 21(*a*) and (*b*) are also schematic drawings for depicting the absorbent material in the negative pressure controlling chamber shell illustrated in FIG. 2.
Figure 21B:
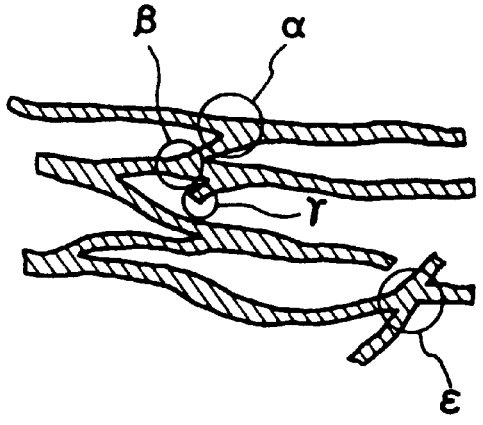

To look at the internal structures of the absorbent material pieces 130 and 140 in more detail, the state of a wad of short strands of fiber crimped and carded as shown in FIG. 21(*a*) changes to the state shown in FIG. 21(*b*) as it is heated. More specifically, in a region a in which plural short strands of crimped fiber extend in an overlapping manner, more or less in the same direction, the fiber strands are likely to be fused to each other at their intersections, becoming connected as shown in FIG. 21(*b*) and therefore, difficult to separate in the direction F1 in FIG. 20. On the other hand, the 21 tips of the short strands of crimped fiber (tips β and γ in FIG. 21(*a*)) are likely to three-dimensionally fuse with other strands like the tip β in FIG. 21(*b*), or remain unattached like the tip γ in FIG. 21(*b*). However, all the strands do extend in the same direction. In other words, some strands extend in the non-conforming direction and intersect with the adjacent strands (region ϵ in FIG. 21(*a*)) even before heat is applied, and as heat is applied, they fuse with the adjacent strands in the position they are in, (region ϵ in FIG. 21(*b*)). Thus, compared to a conventional absorbent piece constituted of a bundle of unidirectionally arranged strands of fiber, the absorbent members in this embodiment are also far more difficult to split in the direction F2.

Further, in this embodiment, the absorbent pieces 130 and 140 are disposed so that the primary fiber strand direction F1 in the absorbent pieces 130 and 140 becomes nearly parallel to the horizontal direction and the line which connects the joint portion and the ink supply outlet. Therefore, after the connection of ink storing container 201, the gas-liquid interface L (interface between ink and gas) in the absorbent piece 140 becomes nearly horizontal, that is, virtually parallel to the primary fiber strand direction F1, remaining virtually horizontal even if ambient changes occur, and as the ambience settles, the gas-liquid interface L returns to its original position. Thus, the position of the gas-liquid interface in terms of the gravitational direction is not affected by the number of the cycles of the ambient change.

Thus, even when the ink container unit 200 is replaced with a fresh one because the ink storing container 201 has run out of ink, the gas-liquid interface remains virtually horizontal, and therefore, the size of the buffering space 116 does not decrease no matter how many times the ink container unit 200 is replaced.

All that is necessary in order to keep the position of the gas-liquid interface stable in spite of the ambient changes during the gas-liquid exchange is that the fiber strands in the region immediately above the joint between the negative pressure controlling chamber unit 100 and ink container unit 200 (in the case of this embodiment, above the position of the joint pipe 180), preferably inclusive of the adjacencies of the region immediately above the joint, are extended in the more or less horizontal direction. From a different viewpoint, all that is necessary is that the above described region is between the ink delivery interface and the joint between the negative pressure controlling chamber unit 100 and ink container unit 200. From another viewpoint, all that is necessary is that the position of this region is above the gas-liquid interface while gas-liquid exchange is occurring. To analyze the latter viewpoint with reference to the functionality of this region in which the fiber strands posses the above described directionality, this region contributes to keeping horizontal the gas-liquid interface in the absorbent piece 140 while the liquid is supplied through the gas-liquid exchange; in other words, the region contributes to regulate the changes which occur in the vertical direction in the absorbent material piece 140 in response to the movement of the liquid into the absorbent material piece 140 from the ink storing container 201.

The provision of the above described region or layer in the absorbent material piece 140 makes it possible to reduce the unevenness of the gas-liquid interface L in terms of the gravity direction. Further, it is desired that the fiber strands in the aforementioned region or layer be arranged so that they appear to extend in parallel in the aforementioned primary direction even when they are seen from the direction perpendicular to the horizontal direction of the absorbent material piece 140, because such an arrangement enhances the effect of the directional arrangement of the fiber strands in the more or less parallel manner in the primary direction.

Regarding the direction in which the fiber strands are extended, theoretically, when the general direction in which the fiber strands are extended is angled relative to the vertical direction, the above described effect can be provided, although the amount of effect may be small if the angle is small. In practical terms, as long as the above described angle was in a range of ±30° relative to the horizontal direction, the effect was clearly confirmed. Thus, the term "more or less" in the phrase "more or less horizontal" in this specification includes the above range.

Figure 6:
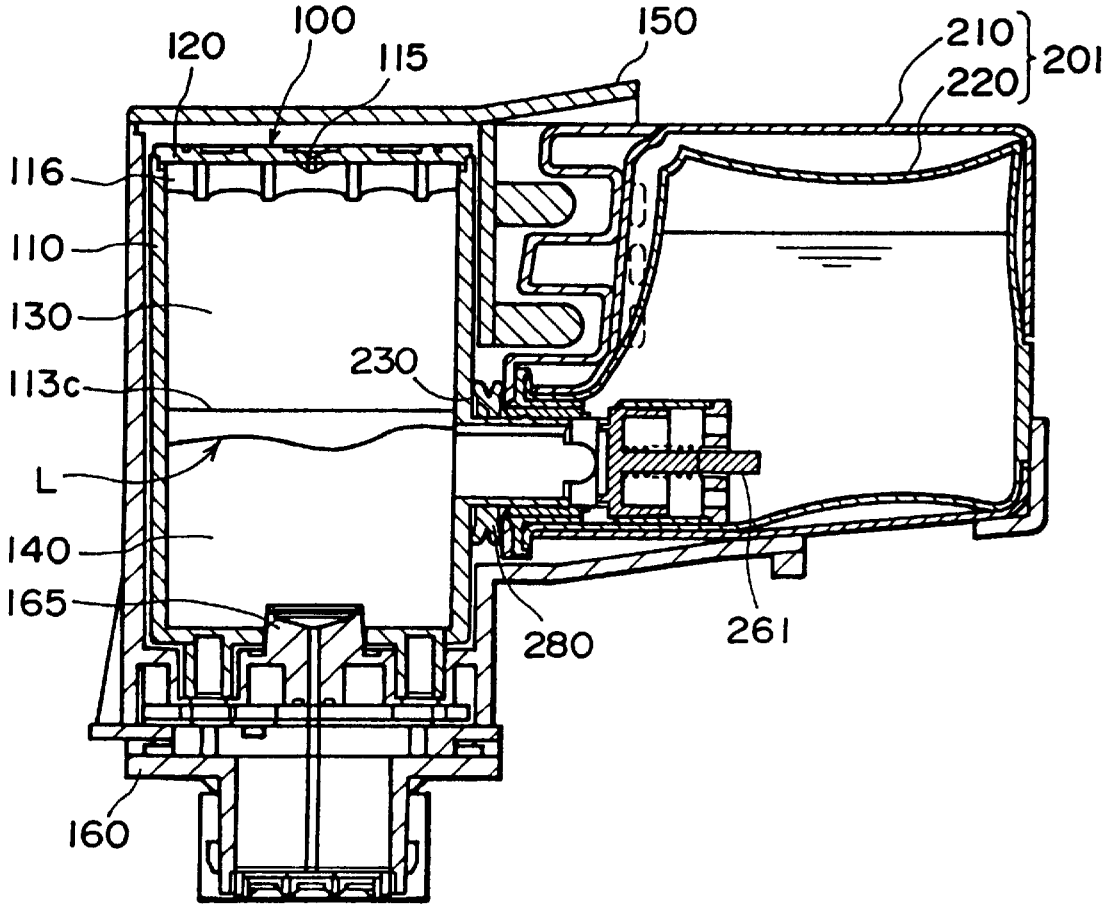
FIG. 6 is a sectional drawing for depicting the operation for supplying the ink jet head cartridge, illustrated in FIG. 2, with ink.

In this embodiment, the fiber strands in the absorbent material piece 140 are extended more or less in parallel in the primary direction also in the region below and adjacent to the joint portion, preventing therefore the gas-liquid interface L from becoming unpredictably uneven in the region below the uppermost portion of the joint portion, as shown in FIG. 6, during the gas-liquid exchange. Therefore, it does not occur that the ink jet head cartridge fails to be supplied with a proper amount of ink due to the interruption of ink delivery.

More specifically, during the gas-liquid exchange, the outside air introduced through the air vent 115 reaches the gas-liquid interface L. As it reaches the interface L, it is dispersed along the fiber strands. As a result, the interface L is kept more or less horizontal during the gas-liquid exchange; it remains stable, assuring that the ink is supplied while a stable amount of negative pressure is maintained. Since the primary direction in which the fiber strands are extended in this embodiment is more or less horizontal, the ink is consumed through the gas-liquid exchange in such a manner that the top surface of the ink remains more or less horizontal, making it possible to provide an ink supplying system which minimizes the amount of the ink left unused, even the amount of the ink left unused in the negative pressure controlling chamber shell 110. Therefore, in the case of an ink supplying system such as the system in this embodiment which allows the ink containing unit 200, in which liquid is directly stored, to be replaced, it is easier to provide the absorbent material pieces 130 and 140 with regions in which ink is not retained. In other words, it is easier to increase the buffering space ratio, to provide an ink supplying system which is substantially more resistant to the ambient changes than a conventional ink supplying system.

When the ink jet head cartridge in this embodiment is the type of cartridge mountable in a serial type printer, it is mounted on a carriage which is shuttled. As this carriage is shuttled, the ink in the ink jet head cartridge is subjected to the force generated by the movement of the carriage, more specifically, the component of the force in the direction of the carriage movement. In order to minimize the adverse effects of this force upon the ink delivery from the ink container unit 200 to ink jet head unit 160, the direction of the fiber strands in the absorbent material pieces 130 and 140 and the direction in which the ink container unit 200 and negative pressure controlling chamber unit 100 are connected, are desired to coincide with the direction of the line which connects the joint opening 230 of the ink container unit 200 and the ink outlet 131 of the negative pressure controlling chamber shell 110.

Operation for Installing Ink Containing Unit

Next, referring to FIG. 4, the operation for installing the ink containing unit 200 into the integral combination of the negative pressure controlling chamber unit 100 and holder 150 will be described.

FIGS. 4(*a*) through (*d*) are sectional drawings for depicting the operation for installing the ink container unit 200 into the holder 150 to which the negative pressure controlling chamber unit 100 has been attached. The ink container unit 200 is installed into the holder 150 by being moved in the direction F as well as the direction G, while being slightly rotated by being guided by the unillustrated lateral guides, the bottom wall of the holder 150, the guiding portions 121 with which the negative pressure controlling chamber cover 120 of the negative pressure controlling chamber unit 100, the ink container engagement portion 155, that is, the rear end portion of the holder 150.

More specifically, the installation of the ink container unit 200 occurs as follows. First, the ink container unit 200 is moved to a point indicated in FIG. 4(*a*), that is, the point at which the slanted surface 251 of the ink container unit 200 comes into contact with the ID members 170 with which the negative pressure controlling chamber unit 100 is provided to prevent the wrong installation of the ink container unit 200. The holder 150 and ink container unit 200 are structured so that at the point in time when the above described contact occurs, the joint pipe 180 has yet to enter the joint opening 230. If a wrong ink container unit 200 is inserted, the slanted surface 251 of the wrong ink container unit 200 collides with the ID members 170 at this point in time, preventing the wrong ink container unit 200 from being inserted further. With this structural arrangement of the ink jet head cartridge 70, the joint opening 230 of the wrong ink container unit 200 does not make contact with joint pipe 180. Therefore, the problems which occur at the joint portion as a wrong ink container unit 200 is inserted, for example, the mixture of inks with different color, and the solidification of ink in the absorbent material pieces 130 and 140 (anions in one type of ink react with cations in another type of ink), which might cause the negative pressure controlling chamber unit 100 to stop functioning, can be prevented, and therefore, it will never occurs that the head and ink containing portion of an apparatus, the ink containing portions of which are replaceable, needs to be replaced due to the occurrence of such problems. Further, since the ID portions of the ID member 250 are provided on the slanted surface of the ID member, the plurality of ID members 170 can be almost simultaneously fitted into the correspondent ID slots to confirm that a correct ink container unit 200 is being inserted; a reliable installation mistake prevention mechanism is provided.

In the next step, the ink container unit 200 is moved toward the negative pressure controlling chamber unit 100 so that the ID members 170 and joint pipe 180 are inserted into the ID member slots 252 and joint opening 230, respectively, at the same time, as shown in FIG. 4(*b*), until the leading end of the ink container unit 200 reaches the negative pressure controlling chamber unit 100 as shown in FIG. 4(*c*). Next, the ink container unit 200 is rotationally moved in the direction indicated by an arrow mark G. During the rotational movement of the ink container unit 200, the tip of the joint pipe 180 comes into contact with the valve plug 261 and pushes it. At a result, the valve mechanism opens, allowing the internal space of the ink container unit 200 to be connected to the internal space of the negative pressure controlling chamber unit 100, in other words, enabling the ink 300 in the ink container unit 200 to be supplied into the negative pressure controlling chamber unit 100. The detailed description of the opening or closing movement of this valve mechanism will be given later.

Next, the ink container unit 200 is further rotated in the direction of the arrow mark G, until the ink container unit 200 settles as shown in FIG. 2. As a result, the bottom rear end portion of the ink container unit 200 becomes engaged with the ink container engagement portion 155 of the holder 150; in other words, the ink container unit 200 is correctly placed in the predetermined space for the ink container unit 200. During this second rotational movement of the ink container unit 200, the ID members 170 slightly come out of the ID member slots 252. The rearward force for correctly retaining the ink container unit 200 in the ink container unit space is generated toward the ink container engagement portion 155 of the holder 150 by the resilient member 263 in the ink container unit 200 and the rubber joint portion 280 fitted around the joint pipe 180.

Since the ID member slots 252 are provided in the slanted front wall of the ink container unit 200 which is rotationally installed or removed, and also, the bottom wall of the ink container unit 200 is slanted, it is possible to minimize the space necessary to assure that the ink container unit 200 is installed or removed without making mistakes or mixing inks of different color.

As soon as the ink container unit 200 is connected with the negative pressure controlling chamber unit 100 as described above, the ink moves until the internal pressure of the negative pressure controlling chamber unit 100 and the internal pressure of the ink storing container 201 equalize to realize the equilibrium state illustrated in FIG. 4, (*d*), in which the internal pressure of the joint pipe 180 and joint opening 230 remains negative (this state is called "initial state of usage").

At this time, the ink movement which results in the aforementioned equilibrium will be described in detail.

The valve mechanism provided in the joint opening 230 of the ink storing container 201 is opened by the installation of the ink container unit 200. Even after the opening of the valve mechanism, the ink holding portion of the ink storing container 201 remains virtually sealed except for the small passage through the joint pipe 230. As a result, the ink in the ink storing container 201 flows into the joint opening 230, forming an ink path between the internal space of the ink storing container 201 and the absorbent material piece 140 in the negative pressure controlling chamber unit 100. As the ink path is formed, the ink begins to move from the ink storing container 201 into the absorbent material piece 140 because of the capillary force of the absorbent material piece 140. As a result, the ink-gas interface in the absorbent material piece 140 rises. Meanwhile, the internal bladder 220 begins to deform, starting from the center portion of the largest wall, in the direction to reduce the internal volume.

The external shell 210 functions to impede the displacement of the corner portions of the internal bladder 220, countering the deformation of the internal bladder 220 caused by the ink consumption. In other words, it works to preserve the pre-installation state of the internal bladder 220 (initial state illustrated in FIGS. 4(*a*)–(*c*)). Therefore, the internal bladder 220 produces and maintains a proper amount of negative pressure correspondent to the amount of deformation, without suddenly deforming. Since the space between the external shell 210 and internal bladder 220 is connected to the outside through the air vent 222, air is introduced into the space between the external shell 210 and internal bladder 220 in response to the aforementioned deformation.

Even if air is present in the joint opening 230 and joint pipe 180, this air easily moves into the internal bladder 220 because the internal bladder 220 deforms as the ink in the internal bladder 220 is drawn out through the ink path formed as the ink from the ink storing container 201 comes into contact with the absorbent material piece 140.

The ink movement continues until the amount of the static negative pressure in the joint opening 230 of the ink storing container 201 becomes the same as the amount of the static negative pressure in the joint pipe 180 of the negative pressure controlling chamber unit 100.

As described above, the ink movement from the ink storing container 201 into the negative pressure controlling chamber unit 100, which is triggered by the connection of the ink storing container 201 with the negative pressure controlling chamber unit 100, continues without the introduction of gas into the ink storing container 201 through the absorbent material pieces 130 and 140. What is important to this process is to configure the ink storing container 201 and negative pressure controlling chamber unit 100 according to the type of a liquid jet recording means to which the ink container unit 200 is connected, so that the static negative pressures in the ink storing container 201 and negative pressure controlling chamber unit 100 reach proper values for preventing ink from leaking from the liquid jet recording means such as the ink jet head unit 160 which is connected to the ink outlet of the negative pressure controlling chamber unit 100.

The amount of the ink held in the absorbent material piece 130 prior to the connection varies. Therefore, some regions in the absorbent piece 140 remain unfilled with ink. These regions can be used as the buffering regions.

On the other hand, sometimes the internal pressures of the joint pipe 180 and joint opening 230 are caused to become positive due to the aforementioned variation. When there is such a possibility, a small amount of ink may be flowed out by performing a recovery operation with a suction-based recovering means, with which the main assembly of a liquid jet recording apparatus is provided, to deal with the possibility. This recovery means will be described later.

As described before, the ink container unit 200 in this embodiment is installed into the holder 150 through a movement which involves a slight rotation; it is inserted at an angle while resting on the ink container engagement portion 155 of the holder 150, by its bottom wall, and after the bottom rear end of the ink container unit 200 goes over the ink container engagement portion 155, it is pushed downward into the holder 150. When the ink container unit 200 is removed from the holder 150, the above described steps are reversely taken. The valve mechanism with which the ink container unit 200 is provided is opened or closed as the ink container unit 200 is installed or removed, respectively.

Opening or Closing of Valve Mechanism

Hereinafter, referring to FIGS. 5(*a*)–(*e*), the operation for opening or closing the valve mechanism will be described. FIG. 5(*a*) shows the states of the joint pipe 180 and its adjacencies, and the joint opening 230 and its adjacencies, immediately before the joint pipe 180 is inserted into the joint opening 230, but after the ink container unit 200 was inserted into the holder 150 at an angle so that the joint opening 230 tilts slightly downward.

The joint pipe 180 is provided with a sealing projection 180*a*, which is integrally formed with the joint pipe 180, and extends on the peripheral surface of the joint pipe 180, encircling the peripheral surface of the joint pipe 180. It is also provided with a valve activation projection 180*b*, which forms the tip of the joint pipe 180. The sealing projection 180*a* comes into contact with the joint sealing surface 260 of the joint opening 230 as the joint pipe 180 is inserted into the joint opening 230. The sealing projection 180*a* extends around the joint pipe 180 at an angle so that the distance from the uppermost portion of the sealing projection 180*a* to the joint sealing surface 260 becomes greater than the distance from the bottommost portion of the sealing projection 180*a* to the joint sealing surface 260.

When the ink container unit 200 is installed or removed, the joint sealing surface rubs against the sealing projection 180*a*, as will be described later. Therefore, the material for the sealing projection 180*a* is desired to be such material that is slippery and yet capable of sealing between itself and an object it contacts. The configuration of the resilient member 263 for keeping the valve plug 26*a* pressed upon or toward the first valve body 260*a* does not need to be limited to a particular one; a springy member such as a coil spring or a plate spring, or a resilient member formed of rubber or the like, may be employed. However, in consideration of recycling, a resilient member formed of resin is preferable.

In the state depicted in FIG. 5(*a*), the valve activation projection 180*b* is yet to make contact with the valve plug 261, and the seal portion of the valve plug 261, provided at the periphery of the joint pipe 180, on the joint pipe side, is in contact with the seal portion of the first valve body 260*a*, with the valve plug 261 being under the pressure from the resilient member 263. Therefore, the ink container unit 200 remains airtightly sealed.

As the ink container unit 200 is inserted further into the holder 150, the joint portion is sealed at the sealing surface 260 of the joint opening 230 by the sealing projection 180*a*. During this sealing process, first, the bottom side of the sealing projection 180*a* comes into contact with the joint sealing surface 260, gradually increasing the size of the contact area toward the top side of the sealing projection 180*a* while sliding against the joint sealing surface 260. Eventually, the top side of the sealing projecting 180*a* comes into contact with the joint sealing surface 260 as shown in FIG. 5(*c*). As a result, the sealing projection 180*a* makes contact with the joint sealing surface 260, by the entire peripheral surface, sealing the joint opening 230.

In the state illustrated in FIG. 5(*c*), the valve activation projection 180*b* is not in contact with the valve plug 261, and therefore, the valve mechanism is not open. In other words, before the valve mechanism is opened, the gap between the joint pipe 180 and joint opening 230 is sealed, preventing ink from leaking from the joint opening 230 during the installation of the ink container unit 200.

Further, as described above, the joint opening 230 is gradually sealed from the bottom side of the joint sealing surface 260. Therefore, until the joint opening 230 is sealed by the sealing projection 180*a*, the air in the joint opening 230 is discharged through the gap between the sealing projection 180*a* and joint sealing surface 260. As the air in the joint opening 230 is discharged as described above, the amount of the air remaining in the joint opening 230 after the joint opening 230 is sealed is minimized, preventing the air in the joint opening 230 from being excessively compressed by the invasion of the joint pipe 180 into the joint opening 230, in other words, preventing the internal pressure of the joint opening 230 from rising excessively. Thus, it is possible to prevent the phenomenon that before the ink container unit 200 is completely installed into the holder 150, the valve mechanism is inadvertently opened by the increased internal pressure of the joint opening 230, and ink leaks into the joint opening 230.

As the ink container unit 200 is further inserted, the valve activation projection 180*b* pushes the valve plug 261 against the resiliency of the resilient member 263, with the joint opening 230 remaining sealed by the sealing projection 180*a*, as shown in FIG. 5(*d*). As a result, the internal space of the ink storing container 201 becomes connected to the internal space of the joint opening 230 through the opening 260*c* of the second valve body 26. Consequently, the air in the joint opening 230 is allowed to be drawn into the ink container unit 200 through the opening 260*c*, and the ink in the ink container unit 200 is supplied into the negative pressure controlling chamber shell 110 (FIG. 2).

As the air in the joint opening 230 is drawn into the ink container unit 200 as described above, the negative pressure in the internal bladder 220 (FIG. 2) is reduced, for example, when an ink container unit 200 the ink in which has been partially consumed is re-installed. Therefore, the balance in the internal negative pressure between the negative pressure controlling chamber shell 110 and internal bladder 220 is improved, preventing the ink from being inefficiently supplied into the negative pressure controlling chamber shell 110 after the re-installation of the ink container unit 200.

After the completion of the above described steps, the ink container unit 200 is pushed down onto the bottom wall of the holder 150 to finish installing the ink container unit 200 into the holder 150 as shown in FIG. 5(*e*). As a result, the joint opening 230 is perfectly connected to the joint pipe 180, realizing the aforementioned state which assures that gas-liquid exchange occurs flawlessly.

In this embodiment, the opening 260*c* of the second valve body 260*b* is located adjacent to the valve body seal portion 264 and on the bottom side of the ink container unit 200. According to the configuration of this opening 260, during the opening of the valve mechanism, more specifically, immediately after the valve plug 261 is moved toward the valve cover 262 by being pushed by the valve activation projection 180*b*, the ink in the ink container unit 200 begins to be supplied into the negative pressure controlling chamber unit 100. Also, it is possible to minimize the amount of the ink which remains in the ink container unit 200 when the ink container unit 200 needs to be discarded because the ink therein can no longer be drawn out.

Also in this embodiment, elastomer is used as the material for the joint sealing surface 260, that is, the seal portion, of the first valve body 260*a*. With the use of elastomer as the material for the joint sealing surface 260, it is assured that because of the resilience of the elastomer, the joint between the joint sealing surface 260 and the sealing projection 180*a* of the joint pipe 180 is perfectly sealed, and also, the joint between the seal portion of the first valve body 260*a* and the correspondent seal portion of the valve plug 261 is perfectly sealed. In addition, by providing the elastomer with an amount of resiliency exceeding the minimum amount of resiliency necessary to assure that the joint between the first valve body 260*a* and joint pipe 180 is perfectly sealed (for example, by increasing the thickness of the elastomer layer), the flexibility of elastomer compensates for the effects of the misalignment, twisting, and/or rubbing, which occur at the contact point between the joint pipe 180 and valve plug 261 during the serial scanning movement of an ink jet head cartridge; it is doubly assured that the joint remains perfectly sealed. The joint sealing surface 260, the material for which is elastomer, can be integrally formed with the first valve body 260*a*, making it possible to provide the above described effects without increasing the number of components. Elastomer usage does not need to be limited to the above described structure; elastomer may also be used as the material for the sealing projection 180*a* of the joint pipe 180, the seal portion of the valve plug 261, and the like.

On the other hand, when the ink container unit 200 is removed from the holder 150, the above described installation steps occur in reverse, unsealing the joint opening 230, and allowing the valve mechanism to close.

In other words, as the ink container unit 200 is pulled in the direction to remove it from the holder 150, while gradually rotating the ink container unit 200 in the direction opposite to the installation direction, first, the valve plug 261 moves forward due to the resiliency of the resilient member 263, and presses on the seal portion of the first valve body 260*a* by its sealing surface to close the joint opening 230.

Then, as the ink container unit 200 is pulled out of the holder 150, the gap between the wall of the joint opening 230 and the joint pipe 180, which remained sealed by the sealing projection 180*a*, is unsealed. Since this gap is unsealed after the closing of the valve mechanism, it does not occur that ink is wastefully released into the joint opening 230.

In addition, since the sealing projection 180*a* is disposed at an angle as described before, the unsealing of the joint opening 230 occurs from the top side of the sealing projection 180*a*. Before the joint opening 230 is unsealed, ink remains in the joint opening 230 and joint pipe 180. However, it is at the top side where the unsealing starts. In other words, the bottom side remains sealed, preventing ink from leaking out of the joint opening 230. Further, the internal pressure of the joint opening 230 and joint pipe 180 is negative, and therefore, as the joint is unsealed from the top side of the sealing projection 180*a*, the outside air enters into the joint opening 230, causing the ink remaining in the joint opening 230 and 180 to be drawn into the negative pressure controlling chamber shell 110.

By causing the joint opening 230 to be unsealed starting from the top side of the sealing projection 180*a* to make the ink remaining in the joint opening 230 move into the negative pressure controlling chamber shell 110, it is possible to prevent ink from leaking from the joint opening 230 as the ink container unit 200 is removed from the holder 150.

As described above, according to the structure of the junction between the ink container unit 200 and negative pressure controlling chamber shell 110, the joint opening 230 is sealed before the valve mechanism of the ink container unit 200 is activated, and therefore, ink is prevented from inadvertently leaking from the joint opening 230. Further, since a time lag is provided between the top and bottom sides of the sealing projection 180*a* in terms of the sealing and unsealing timing, the valve plug 261 is prevented from inadvertently moving during the connection, and the ink remaining in the joint opening 230 is prevented from leaking during the connection and during the removal.

Also in this embodiment, the valve plug 261 is disposed in the joint opening 230, at a point deeper inside the joint opening 230, away from the outside opening of the joint opening 230, and the movement of the valve plug 261 is controlled by the valve activation projection 180*b* provided at the projecting end of the joint pipe 180. Therefore, a user is not required to touch the valve plug 261, being prevented from being contaminated by the ink adhering to the valve plug 261.

Relationship Between Engagement or Disengagement of Joint Portion, and ID

Next, referring to FIGS. 4 and 5, the relationship between the engagement or disengagement of the joint portion, and ID will be described. FIGS. 4(*a*) through (*d*) and 5(*a*) through (*d*) are drawings for depicting the steps for installing the ink container unit 200 into the holder 150, wherein FIGS. 4(*a*), (*b*), (*c*), and FIGS. 5(*a*), (*b*), (*c*) correspondingly represent the same steps. FIGS. 4 and 5 show in detail the portion related to ID, and the joint portion, respectively.

In the first step, the ink container unit 200 is inserted up to the position illustrated in FIG. 4(*a*) and FIG. 5(*a*), at which the plurality of ID members 170 for preventing the ink container unit installation error make contact with the slanted wall 251 of the ink container. The holder 150 and ink container unit 200 are structured so that at this point in time, the joint opening 230 and joint pipe 180 do not make contact. If a wrong ink container unit 200 is inserted, the slanted surface 251 of the wrong ink container unit 200 collides with the ID members 170 at this point in time, preventing the wrong ink container unit 200 from being inserted further. With this structural arrangement, the joint opening 230 of the wrong ink container unit 200 never makes contact with joint pipe 180. Therefore, the problems which occur at the joint portion as a wrong ink container unit 200 is inserted, for example, the mixture of inks with different color, ink solidification, production of incomplete images, and breaking down of the apparatus, can be prevented, and therefore, it never occurs that the head and ink containing portion of an apparatus, the ink containing portions of which are replaceable, will be replaced due to the occurrence of such problems.

If the inserted ink container unit 200 is a correct one, the positions of the ID members 170 match the positions of the ID member slots 252. Therefore, the ink container unit 200 is inserted a little deeper toward the negative pressure controlling chamber unit 100 to a position shown in FIG. 4, (*b*). At this position, the joint sealing surface 260 of the joint opening 230 of the ink container unit 200 has come into contact with the bottom side of the sealing projection 180*a* of the joint pipe 180.

Thereafter, the both sides are completely joined through the steps described before, providing a passage between the internal space of the ink container unit 200 and the internal space of the negative pressure controlling chamber unit 100.

In the above described embodiment, the sealing projection 180*a* is an integral part of the joint pipe 180. However, the two components may be separately formed. In such a case, the sealing projection 180*a* is fitted around the joint pipe 180, being loosely held by a projection formed on the peripheral surface of the joint pipe 180, or a groove provided in the peripheral surface of the joint pipe 180, so that the sealing projection 180*a* is allowed to move on the peripheral surface of the joint pipe 180. However, the joint portion is structured so that within the moving range of the independent sealing projection 180*a*, the valve action controlling projection 180*b* does not make contact with the valve plug 261 until the sealing projection 180*a* comes into contact with the joint sealing surface 260.

In the above description of this embodiment, it is described that as the ink container unit 200 is further inserted, the bottom side of the sealing projection 180*a* comes into contact with the joint sealing surface 260, and the sealing projection 180*a* slides on the joint sealing surface 260, gradually expanding the contact range between the sealing projection 180*a* and the joint sealing surface 260, upward toward the top side of the sealing projection 180*a*, until the top end of the sealing projection 180*a* finally comes into contact with the joint sealing surface 260. However, the installation process may be such that, first, the top side of the sealing projection 180*a* comes into contact with the joint sealing surface 260, and as the ink container unit 200 is further inserted, the sealing projection 180*a* slides on the joint sealing surface 260, gradually expanding the contact range between the sealing projection 180*a* and the joint sealing surface 260, downward toward the bottom end of the sealing projection 180*a*, until the bottom end of the sealing projection 180*a* finally makes contact with the joint sealing surface 260*a*. Further, the contact between the sealing projection 180*a* and joint sealing surface 260 may occur simultaneously at both the top and bottom sides. During the above process, if the air present between the joint pipe 180 and valve plug 261 opens the valve mechanism by pushing the valve plug 261 inward of the joint opening 230, the ink 300 within the ink storing container 201 does not leak outward, because the joint opening 230 has been completely sealed at the joint between the sealing projection 180*a* and joint sealing surface 260. In other words, the essential point of this invention is that the valve mechanism is opened only after the joint between the joint pipe 180 and joint opening 230 is completely sealed. According to this structure, it does not occur that the ink 300 within the ink container unit 200 leaks out during the installation of the ink container unit 200. In addition, the air pushed into the joint opening 230 enters the ink container unit 200, and pushes out the ink 300 in the ink storing container 201 into the joint opening 230, contributing to smoothly supplying ink from the ink storing container 201 into the absorbent material piece 140.

Ink Supplying Operation

Next, referring to FIG. 6, the ink supplying operation of the ink jet head cartridge illustrated in FIG. 2 will be described. FIG. 6 is a sectional drawing for describing the ink supplying operation of the ink jet head cartridge illustrated in FIG. 2.

By dividing the absorbent material in the negative pressure controlling chamber unit 100 into a plurality of pieces, and positioning the interface between the divided pieces of the absorbent material so that the interface will be positioned above the top end of the joint pipe 180 when the ink jet head cartridge is disposed in the attitude in which it is used, as described above, it becomes possible to consume the ink within the absorbent piece 140, or the bottom piece, after the ink within the absorbent material piece 130, or the top piece, if ink is present in both the absorbent material pieces 130 and 140 of the ink jet head cartridge illustrated in FIG. 2. Further, if the position of the gas-liquid interface L changes due to the ambient changes, ink seeps into the absorbent material piece 130 after filling up, first, the absorbent material piece 140 and the adjacencies of the interface 113*c* between the absorbent material pieces 130 and 140. Therefore, it is assured that buffering zone in addition to the buffering space 116 is provided in the negative pressure controlling chamber unit 100. Making the strength of the capillary force of the absorbent material piece 140 higher compared to that of the absorbent material piece 130 assures that the ink in the absorbent material piece 130 is consumed when the ink jet head cartridge is operating.

Further, in this embodiment, the absorbent material piece 130 remains pressed toward the absorbent material piece 140 by the ribs of the negative pressure controlling chamber cover 120, and therefore, the absorbent material piece 130 is kept in contact with the absorbent material piece 140, forming the interface 113*c*. The compression ratios of the absorbent material pieces 130 and 140 are higher adjacent to the interface 113*c* than those in the other portions, and therefore, the capillary force is greater adjacent to the interface 113*c* than that in the other portions. More specifically, representing the capillary force of the absorbent material piece 140, the capillary force of the absorbent material piece 130, and the capillary force of the area adjacent to the interface 113*c* between the absorbent material pieces 130 and 140, with P1, P2, and PS, correspondingly, their relationship is: P2<P1<PS. Providing the area adjacent to the interface 113*c* between the absorbent material pieces 130 and 140 with such capillary force that is stronger than that in the other areas assures that the strength of the capillary force in the area adjacent to the interface 113*c* exceeds the strength necessary to meet the above described requirement, even if the ranges of the strengths of the P1 and P2 overlap with each other because of the unevenness of the absorbent material pieces 130 and 140 in terms of their density, or compression. Therefore, it is assured that the above described effects will be provided. Further, positioning the joint pipe 180 below, and adjacent to, the interface 113*c* between the absorbent material pieces 130 and 140 assures that the gas-liquid interface remains at this position, and therefore, is desired.

Accordingly, next, the method for forming the interface 113*c*, in this embodiment, will be described. In this embodiment, olefinic fiber (2 denier) with a capillary force of −110 mmAq (P1=−110 mmAq) is used as the material for the absorbent material piece 140 as a capillary force generating member. The hardness of the absorbent material pieces 130 and 140 is 0.69 kgf/mm. The method for measuring their hardness is such that, first, the resilient force generated as a pushing rod with a diameter of 15 mm is pushed against the absorbent material placed in the negative pressure controlling chamber shell 110 is measured, and then, the hardness is obtained from the relationship between the distance the pushing rod was inserted, and the measured amount of the resilient force correspondent to the distance. On the other hand, the same material as that for the absorbent material piece 140, that is, olefinic fiber, is used as the material for the absorbent material piece 130. However, compared to the absorbent material piece 140, the absorbent material piece 130 is made weaker in capillary force (P2=−80 mmAq), and is made larger in the fiber diameter (6 denier), making it higher in rigidity at 1.88 kgf/mm.

By making the absorbent material piece 130, which is weaker in capillary force than the absorbent material piece 140, greater in hardness than the absorbent material piece 140, placing them in combination, and in contact, with each other, and keeping them pressed against each other, causes the absorbent material piece 140 to be kept more compressed than the absorbent material piece 130, adjacent to the interface 113*c* between the absorbent material pieces 130 and 140. Therefore, the aforementioned relationship in capillary force (P2<P1<PS) is established adjacent to the interface 113*c*, and also it is assured that the difference between the P2 and PS remains always greater than the difference between the P2 and P1.

Ink Consumption

Figure 7A:
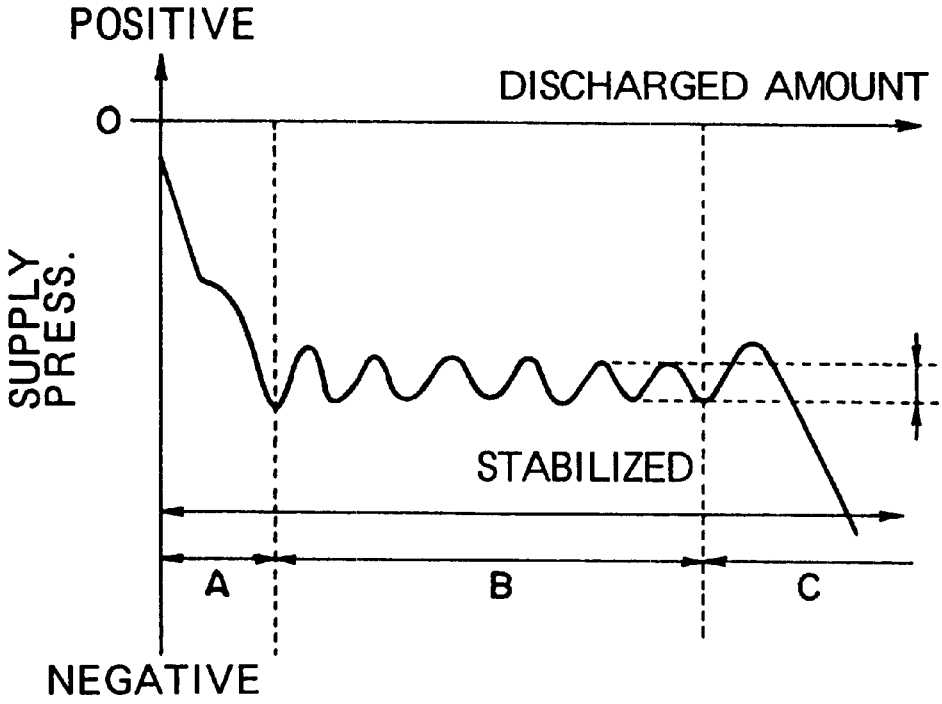
FIGS. 7(*a*) and (*b*) are graphs for depicting the state of the ink during ink consumption, with reference to FIG. 6.

Next, referring to FIGS. 6–8, the outlines of the ink consuming process will be described from the time when the ink container unit 200 has been installed into the holder 150 and has become connected to the negative pressure controlling chamber unit 100, to the time when the ink in the ink storing container 201 begins to be consumed. FIGS. 7(*a*) and (*b*) are drawings for describing the state of the ink during the ink consumption described with reference to FIG. 6, and FIGS. 8(*a*) and (*b*) are graphs for depicting the effects of the deformation of the internal bladder 220 upon the prevention of the internal pressure change in the ink container unit 200.

First, as the ink storing container 201 is connected to the negative pressure controlling chamber unit 100, the ink in the ink storing container 201 moves into the negative pressure controlling chamber unit 100 until the internal pressure of the negative pressure controlling chamber unit 100 becomes equal to the internal pressure of the ink storing container 201, readying the ink jet head cartridge for a recording operation. Next, as the ink begins to be consumed by the ink jet head unit 160, both the ink in the internal bladder 220 and the ink in the absorbent material piece 140 are consumed, maintaining such a balance that the value of the static negative pressure generated by the internal bladder 220 and absorbent material piece 140 increases (first state: range A in FIG. 7(*a*)). In this state, when ink is in the absorbent material piece 130, the ink in the absorbent material piece 130 is also consumed. FIG. 7(*a*) is a graph for describing one of the examples of the rate at which the negative pressure in the ink delivery tube 165 varies. In FIG. 7(*a*), the axis of abscissa represents the rate at which the ink is drawn out of the negative pressure controlling chamber shell 110 through the ink delivery tube 160, and the axis of ordinates represents the value of the negative pressure (static negative pressure) in the ink delivery tube 160.

Next, gas is drawn into the internal bladder 220, allowing ink to be consumed, that is, drawn out, through gas-liquid exchange while the absorbent material pieces 130 and 140 keep the position of the gas-liquid interface L at about the same level, and keep the internal negative pressure substantially constant (second state: range B in FIG. 7(*a*)). Then, the ink remaining in the capillary pressure generating member holding chamber 110 is consumed (range C in FIG. 7(*a*)).

As described above, the ink jet head cartridge in this embodiment goes through the stage (first stage) in which the ink in the internal bladder 220 is used without the introduction of the outside air into the internal bladder 220. Therefore, the only requirement to be considered regarding the internal volume of the ink storing container 201 is the amount of the air introduced into the internal bladder 220 during the connection. Therefore, the ink jet head cartridge in this embodiment has merit in that it can compensate for the ambient changes, for example, temperature change, even if the requirement regarding the internal volume of the ink storing container 201 is relaxed.

Further, in whichever period among the aforementioned periods A, B, and C, in FIG. 7(*a*), the ink storing container 201 is replaced, it is assured that the proper amount of negative pressure is generated, and therefore, ink is reliably supplied. In other words, in the case of the ink jet head cartridge in this embodiment, the ink in the ink storing container 201 can be almost entirely consumed. In addition, air may be present in the joint pipe 180 and/or joint opening 230 when the ink container unit 200 is replaced, and the ink storing container 201 can be replaced regardless of the amounts of the ink retained in the absorbent material pieces 130 and 140. Therefore, it is possible to provide an ink jet head cartridge which allows the ink storing container 201 to be replaced without relying on an ink remainder detection mechanism; in other words, the ink jet head cartridge in this embodiment does not need to be provided with an ink remainder detection mechanism.

At this time, the aforementioned ink consumption sequence will be described from a different viewpoint, referring to FIG. 7(*b*).

FIG. 7(*b*) is a graph for describing the above described ink consumption sequence. In FIG. 7(*b*), the axis of abscissas represents the elapsed time, and the axis of ordinates represents the cumulative amount of the ink drawn out of the ink storing container, and the cumulative amount of the air drawn into the internal bladder 220. It is assumed that the rate at which the ink jet head unit 160 is provided with ink remains constant throughout the elapsed time.

The ink consumption sequence will be described from the angles of the cumulative amount of the ink drawn out of the ink containing portion, and the cumulative amount of the air drawn into the internal bladder 220, shown in FIG. 7(*b*). In FIG. 7(*b*), the cumulative amount of the ink drawn out of the internal bladder 220 is represented by a solid line (1), and the cumulative amount of the air drawn into the ink containing portion is represented by a solid line (2). A period from a time t0 to t1 corresponds to the period A, or the period before the gas-liquid exchange begins, in FIG. 7(*a*). In this period A, the ink from the absorbent material piece 140 and internal bladder 220 is drawn out of the head while balance is maintained between the absorbent material piece 140 and 220, as described above.

Next, the period from time t1 to time t2 corresponds to the gas-liquid exchange period (period B) in FIG. 7(*b*). In this period B, the gas-liquid exchange continues according to the negative pressure balance, as described above. As air is introduced into the internal bladder 220 (which corresponds to the stepped portions of the solid line (2)), as indicated by the solid line (1) in FIG. 7(*b*), ink is drawn out of the internal bladder 220. During this process, it does not occur that ink is always drawn out of the internal bladder 220 by an amount equal to the amount of the introduced air. For example, sometimes, ink is drawn out of the internal bladder 220 a certain amount of time after the air introduction, by an amount equivalent to the amount of the introduced air. As is evident from FIG. 7(*b*), the occurrence of this kind of reaction, or the timing lag, characterizes the ink jet head cartridge in this embodiment in comparison to an ink jet head cartridge which does not have an internal ink bladder (220), and the ink containing portion of which does not deform. As described above, this process is repeated during the gas-liquid exchange period. As the ink in the internal bladder 220 continues to be drawn out, the relationship between the amounts of the air and ink in the internal bladder 220 reverses at a certain point in time.

The period after the time t2 corresponds to the period (range C) after the gas-liquid exchange period in FIG. 7(*a*). In this range C, the internal pressure of the internal bladder 220 becomes substantially the same as the atmospheric pressure as stated before. As the internal pressure of the internal bladder 220 gradually changes toward the atmospheric pressure, the initial state (pre-usage state) is gradually restored by the resiliency of the internal bladder 220. However, because of the so-called buckling, it does not occur that the state of the internal bladder 220 is completely restored to its initial state. Therefore the final amount Vc of the air drawn into the internal bladder 220 is smaller than the initial internal volume of the internal bladder 220 (V>Vc). Even in the state within the range C, the ink in the internal bladder 220 can be completely consumed.

As described above, the structure of the ink jet head cartridge in this embodiment is characterized in that the pressure fluctuation (amplitude ←C→ in FIG. 7(*a*)) which occurs during the gas-liquid exchange in the ink jet head cartridge in this embodiment is greater compared to that in an ink jet head cartridge which employs a conventional ink container system in which gas-liquid exchange occurs.

The reason for this characteristic is that before the gas-liquid exchange begins, the internal bladder 220 is deformed, and kept deformed, by the drawing of the ink from inside the internal bladder 220. Therefore, the resiliency of the internal bladder material continuously generates such force that works in the direction to move the wall of the internal bladder 220 outward. As a result, the amount of the air which enters the internal bladder 220 to reduce the internal pressure difference between the absorbent material piece 140 and internal bladder 220 during the gas-liquid exchange often exceeds the proper amount, as described, increasing the amount of the ink drawing out of the internal bladder 220 into the external shell 210. On the contrary, if the ink container unit 200 is structured so that the wall of the ink containing portion does not deform as does the wall of the internal bladder 220, ink is immediately drawn out into the negative pressure controlling chamber unit 100 as soon as a certain amount of air enters the ink containing portion.

For example, in 100% duty mode (solid mode), a large amount of ink is ejected all at once from the ink jet head unit 160, causing ink to be rapidly drawn out of the negative pressure controlling chamber unit 100 and ink storing container 201. However, in the case of the ink jet head cartridge in this embodiment, the amount of the ink drawn out through gas-liquid exchange is relative large, improving the reliability, that is, eliminating the concern regarding the interruption of ink flow.

Also, according to the structure of the ink jet head cartridge in this embodiment, ink is drawn out with the internal bladder 220 remaining deformed inward, providing thereby an additional benefit in that the structure offers a higher degree of buffering effect against the vibration of the carriage, ambient changes, and the like.

As described above, according to the structure of the ink jet head cartridge in this embodiment, the slight changes in the negative pressure can be eased by the internal bladder 220, and even when air is present in the internal bladder 220, for example, during the second stage in the ink delivery, the ambient changes such as temperature change can be compensated for by a method different from the conventional methods.

Next, referring to FIGS. 8(*a*) and (*b*), a mechanism for assuring that even when the ambient condition of the ink jet head cartridge illustrated in FIG. 2 changes, the liquid within the unit remains stable will be described. In the following description, the absorbent material pieces 130 and 140 may be called a capillary force generating member.

As the air in the internal bladder 220 expands due to decrease in the atmospheric pressure and/or increase in the temperature, the walls or the like portions of the internal bladder 220, and the liquid surface in the internal bladder 220, are subjected to pressure. As a result, not only does the internal volume of the internal bladder 220 increase, but also a portion of the ink in internal bladder 220 flows out into the negative pressure controlling chamber shell 110 from the internal bladder 220 through the joint pipe 180. However, since the internal volume of the internal bladder 220 increases, the amount of the ink that flows out into the absorbent material piece 140 in the case of this embodiment is substantially smaller compared to a case in which the ink storage portion is undeformable.

As described above, the aforementioned changes in the atmospheric pressure ease the negative pressure in the internal bladder 220 and increase the internal volume of the internal bladder 220. Therefore, initially, the amount of the ink which flows out into the negative pressure controlling chamber shell through the joint opening 230 and joint pipe 180 as the atmospheric pressure suddenly changes is substantially affected by the resistive force generated by the internal bladder wall as the inward deformation of the wall portion of the internal bladder 220 is eased, and by the resistive force for moving the ink so that the ink is absorbed by the capillary force generating member.

In particular, in the case of the structure in this embodiment, the flow resistance of the capillary force generating members (absorbent material pieces 130 and 140) is greater than the resistance of the internal bladder 220 against the restoration of the original state. Therefore, as the air expands, initially, the internal volume of the internal bladder 220 increases. Then, as the amount of the air expansion exceeds the maximum amount of the increase in the internal volume of the internal bladder 220 afforded by the internal bladder 220, ink begins to flows from within the internal bladder 220 toward the negative pressure controlling chamber shell 110 through the joint opening 230 and joint pipe 180. In other words, the wall of the internal bladder 220 functions as the buffer against the ambient changes, and therefore, the ink movement in the capillary force generating member calms down, stabilizing the negative pressure adjacent to the ink delivery hole 165.

Also according to this embodiment, the ink which flows out into the negative pressure controlling chamber shell 110 is retained by the capillary force generating members. In the aforementioned situation, the amount of the ink in the negative pressure controlling chamber shell 110 increases temporarily, causing the gas-liquid interface to rise, and therefore, in comparison to when the internal pressure is stable, the internal pressure temporarily becomes slightly positive, as it is initially. However, the effect of this slightly positive internal pressure upon the characteristics of a liquid ejection recording means such as the ink jet head unit 160, in terms of ejection, creates no practical problem. As the atmospheric pressure returns to the normal level (base unit of atmospheric pressure), or the temperature returns to the original level, the ink which leaked out into the negative pressure controlling chamber shell 110 and has been retained in the capillary force generating members, returns to the internal bladder 220, and the internal bladder 220 restores its original internal volume.

Next, the basic action in the stable condition restored under such atmospheric pressure that has changed after the initial operation will be described.

What characterizes this state is the amount of the ink drawn out of the internal bladder 220, as well as that the position of the interface between the ink retained in the capillary force generating member, and the gas, changes to compensate for the fluctuation of the negative pressure resulting from the fluctuation of the internal volume of the internal bladder 220 itself. Regarding the relationship between the amount of the ink absorbed by the capillary force generating member and the ink storing container 201, all that is necessary from the viewpoint of preventing ink from leaking from the air vent or the like during the aforementioned decrease in the atmospheric pressure and temperature change, is to determine the maximum amount of the ink to be absorbed by the negative pressure controlling chamber shell 110 and the amount of the ink to be retained in the negative pressure controlling chamber shell 110 while the ink is supplied from the ink storing container 201, in consideration of the amount of the ink which flows out of the ink storing container 201 under the worst conditions, and then, to give the negative pressure controlling chamber shell 110 an internal volume sufficient for holding the capillary force generating members, the sizes of which match the aforementioned amount of ink under the worst conditions, and the maximum amount of the ink to be absorbed.

Figure 8A:
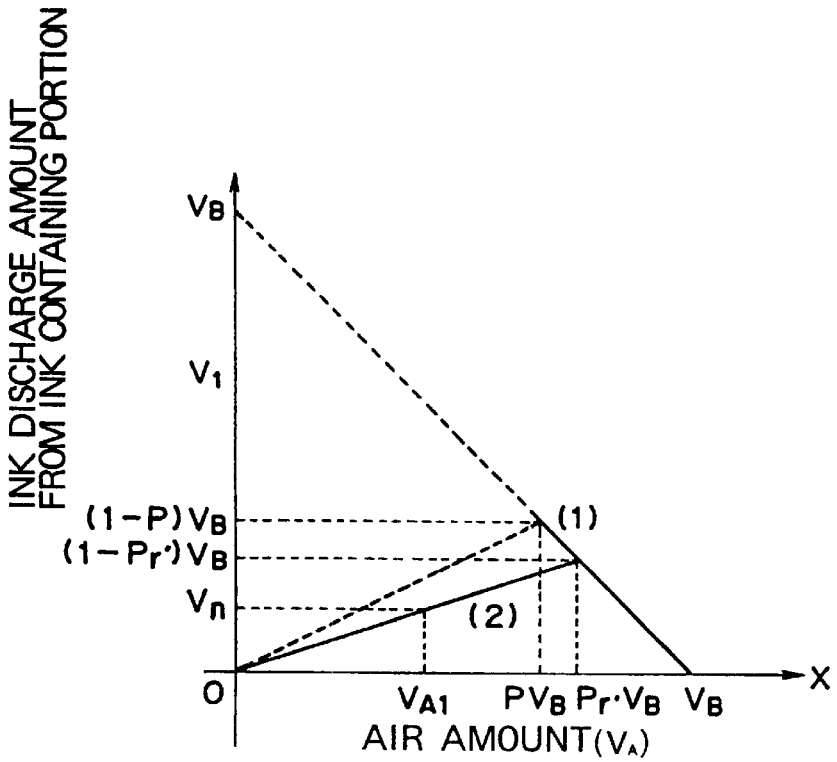
FIGS. 8(*a*) and (*b*) are graphs for depicting the effect of the change in the internal pressure resulting from the deformation of the internal bladder during the ink consumption in the ink jet head cartridge shown in FIG. 6.
Figure 8B:
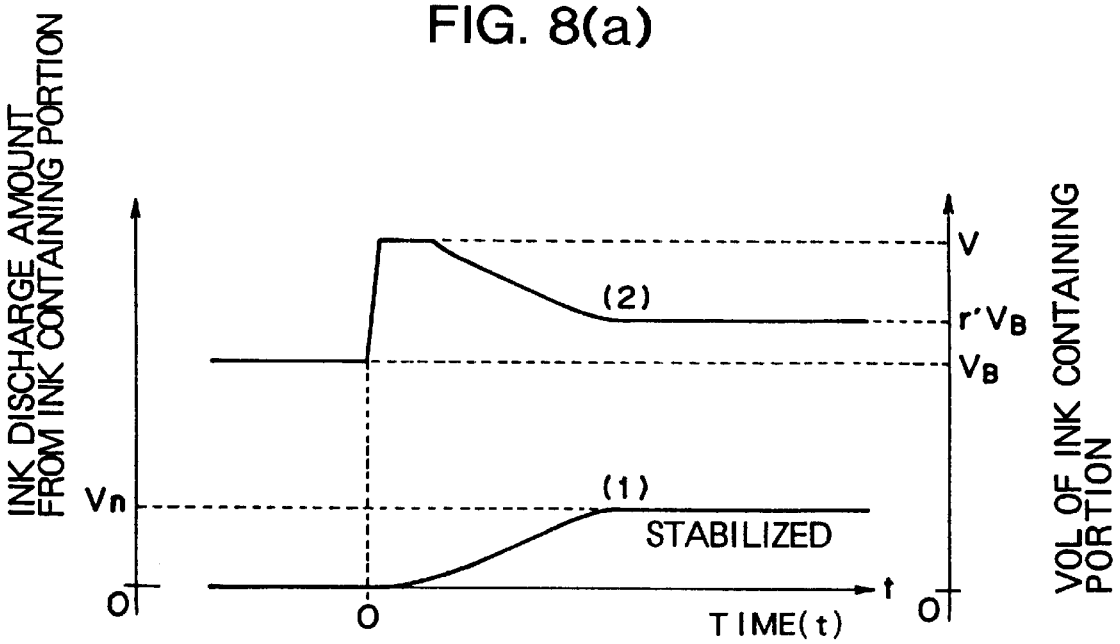
Figure 9A:
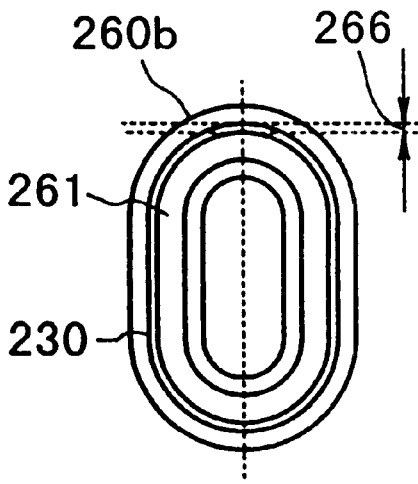
FIGS. 9(*a*) through (*d*) are sectional drawings for depicting the relationship between the valve body and valve plug in the valve mechanism to which the present invention is applicable.
Figure 9B:
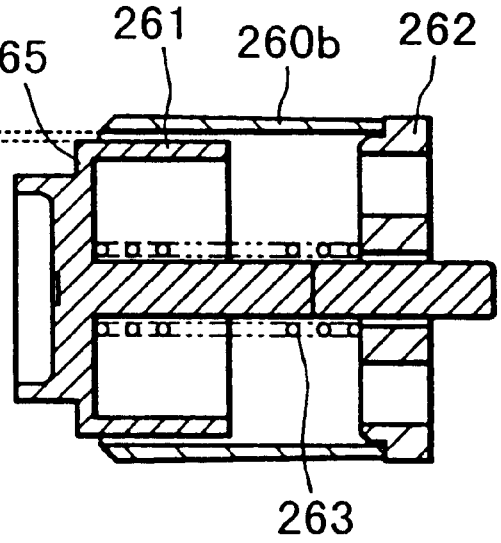
Figure 9C:
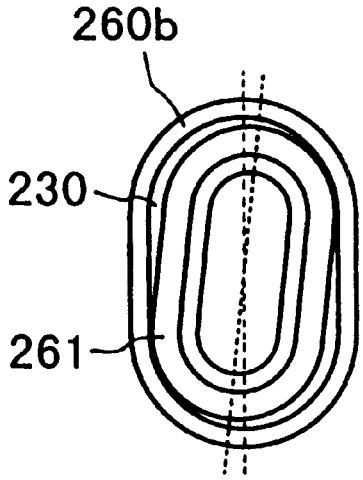
Figure 9D:
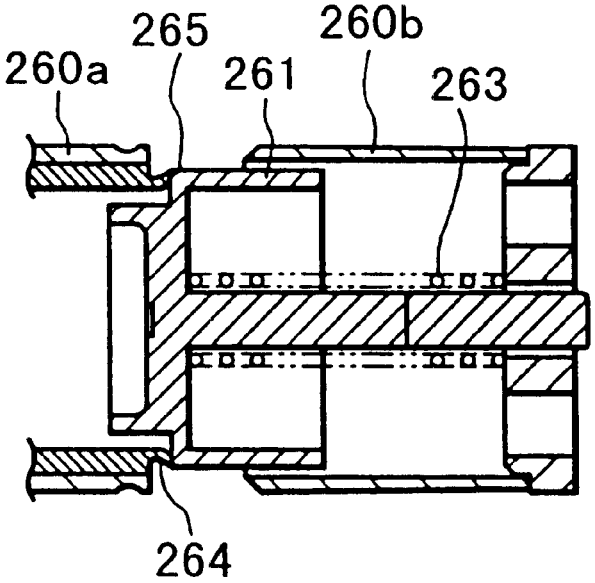

In FIG. 8(*a*), the initial volume of the internal space (volume of the air) of the internal bladder 220 before the decrease in the atmospheric pressure, in a case in which the internal bladder 220 does not deform at all in response to the expansion of the air, is represented by the axis of abscissas (X), and the amount of the ink which flowed out as the atmospheric pressure decreased to a value of P ($0<P<1$) is represented by the axis of ordinates, and their relationship is depicted by a dotted line (1).

The amount of the ink which flows out of the internal bladder 220 under the worst conditions may be estimated based on the following assumption. For example, a situation in which the amount of the ink which flows out of the internal bladder 220 becomes the maximum when the lowest level to which the value of the atmospheric pressure decreases is 0.7, is when the volume of the ink remaining in the internal bladder 220 equals 30% of the volumetric capacity VB of the internal bladder 220. Therefore, presuming that the ink below the bottom end of the wall of the internal bladder 220 is also absorbed by the capillary force generating members in the negative pressure controlling chamber shell 110, it may be expected that the entirety of the ink remaining in the internal bladder 220 (equals in volume to 30% of the volumetric capacity VB) leaks out.

On the contrary, in this embodiment, the internal bladder 220 deforms in response to the expansion of the air. In other words, compared to the internal volume of the internal bladder 220 before the expansion, the internal volume of the internal bladder 220 is greater after the expansion, and the ink level in the negative pressure controlling chamber shell 110 changes to compensate for the fluctuation of the negative pressure in the internal bladder 220. Under the stable condition, the ink level in the negative pressure controlling chamber shell 110 changes to compensate for the decrease in the negative pressure in the capillary force generating members, in comparison to the negative pressure in the capillary force generating members before the change in the atmospheric pressure, caused by the ink from the internal bladder 220. In other words, the amount of the ink which flows out decreases in proportion to the amount of the expansion of the internal bladder 220, as depicted by a solid line (2). As is evident from the dotted line (1) and solid line (2), the amount of the ink which flows out of the internal bladder 220 may be estimated to be smaller compared to that in the case in which the internal bladder 220 does not deform at all in response to the expansion of the air. The above described phenomenon similarly occurs in the case of the change in the temperature of the ink container, except that even if the temperature increases approximately 50 degrees, the amount of the ink outflow is smaller than the aforementioned amount of the ink outflow in response to the atmospheric pressure decrease.

As described above, the ink container in accordance with the present invention can compensate for the expansion of the air in the ink storing container 201 caused by the ambient changes not only because of the buffering effect provided by the negative pressure controlling chamber shell 110, but also because of the buffering effect provided by the ink storing container 201 which is enabled to increase in its volumetric capacity to the maximum value at which the shape of the ink storing container 201 becomes substantially the same as the shape of the internal space of the external shell 210. Therefore, it is possible to provide an ink supplying system which can compensate for the ambient changes even if the ink capacity of the ink storing container 201 is substantially increased.

FIG. 8(*b*) schematically shows the amount of the ink drawn out of the internal bladder 220 and the internal volume of the internal bladder 220, in relation to the length of the elapsed time, when the ambient pressure is reduced from the normal atmospheric pressure to the pressure value of P ($0<P<1$). In FIG. 8(*b*), the initial volume of the air is VA1, and a time t0 is a point in time at which the ambient pressure is the normal atmospheric pressure, and from which the reduction in the ambient pressure begins. The axis of abscissas represents time (t) and the axis of ordinates represents the amount of the ink drawn out of the internal bladder 220 and the internal volume of the internal bladder 220. The changes in the amount of the ink drawn out of the internal bladder 220 in relation to the elapsed time is depicted by a solid line (1), and the change in the volume of the internal bladder 220 in relation to the elapsed time is depicted by a solid line (2).

As shown in FIG. 8(*b*), when a sudden ambient change occurs, the compensation for the expansion of the air is made mainly by the ink storing container 201 before the normal state, in which the negative pressure in the negative pressure controlling chamber shell 110 balances with the negative pressure in the ink storing container 201, is finally restored. Therefore, at the time of sudden ambient change, the timing with which the ink is drawn out into the negative pressure controlling chamber shell 110 from the ink storing container 201 can be delayed.

Therefore, it is possible to provide an ink supplying system capable of supplying ink under the stable negative pressure condition during the usage of the ink storing container 201, while compensating the expansion of the air introduced in the ink storing container 201 through gas-liquid exchange, under various usage conditions.

According to the ink jet head cartridge in this embodiment, the volumetric ratio between the negative pressure controlling chamber shell 110 and internal bladder 220 can be optimally set by optionally selecting the material for the capillary force generating members (ink absorbent pieces 130 and 140), and the material for the internal bladder 220; even if the ratio is greater than 1:2, practical usage is possible. In particular, when emphasis needs to be placed on the buffering effect of the internal bladder 220, all that is necessary is to increase, within the range in which the elastic deformation is possible, the amount of the deformation of the internal bladder 220 during the gas-liquid exchange, relative to the initial state.

As described above, according to the ink jet head cartridge in this embodiment, although the capillary force generating members occupies only a small portion of the internal volume of the negative pressure controlling chamber shell 110, it is still effective to compensate for the changes in the ambient condition, by synergistically working with the structure of the negative pressure controlling chamber shell 110.

Referring to FIG. 2, in the ink jet head cartridge in this embodiment, the joint pipe 180 is located adjacent to the bottom end of the negative pressure controlling chamber shell 110. This arrangement is effective to reduce the uneven distribution of the ink in the absorbent material pieces 130 and 140 in the negative pressure controlling chamber shell 110. This effect will be described below in detail.

The ink from the ink container unit 200 is supplied to the ink jet head unit 160 through the joint opening 230, absorbent material piece 130, and absorbent material piece 140. However, between the joint opening 230 and ink delivery tube 165, the ink takes a different path depending on the situation. For example, the shortest path, that is, the path taken by the ink in a situation in which the ink is directly supplied, is substantially different from the path taken in a situation in which the ink goes, first, to the top of the absorbent material piece 140 due to the rise of the liquid surface of the absorbent material piece 140 caused by the aforementioned ambient changes. This difference creates the aforementioned uneven ink distribution, which sometimes affects recording performance. This variation in the ink path, that is, the difference in the length of the ink path, can be reduced to reduce the unevenness of the ink distribution, by positioning the joint pipe 180 adjacent to the absorbent material piece 140, as it is according to the structure of the ink jet head cartridge in this embodiment, so that the unevenness in the recording performance is reduced. Thus, it is desired that the joint pipe 180 and joint opening 230 are placed as close as possible to the top portion.

However, in consideration of the need to provide the buffering performance, they are placed at reasonably high positions as they are in this embodiment. These positions are optionally chosen in consideration of various factors, for example, the absorbent material pieces 130 and 140, ink, amount by which ink is supplied, amount of ink, and the like.

In this embodiment, the absorbent material piece 140 which generates a capillary force with a value of P1 and the absorbent material piece 130 which generates a capillary force with a value of P2 are placed in the negative pressure controlling chamber shell 110, in contact with each other, in a compressed state, generating a capillary force with a value of PS. The relationship in the strength among these capillary forces is: P2<P1<PS. In other words, the capillary force generated at the interface 113*c* is the strongest, and the capillary force generated in the absorbent material piece 130, or the absorbent material piece on the top side, is the weakest. Because the capillary force generated at the interface 113*c* is the strongest, and the capillary force generated in the absorbent material piece 130, or the absorbent material piece on the top side, is the weakest, even if the ink supplied through the joint opening 230 flows into the absorbent material piece 130 on the top side past the interface 113*c*, the ink is pulled with strong force toward the interface 113*c*, and moves back toward the interface 113*c*. With the presence of this interface 113*c*, it does not occur that the path J forms a line through both the absorbent material pieces 140 and 130. For this reason, in addition to the fact that the position of the joint opening 230 is higher than that of the supply opening 131, the difference in length between the path K and path J can be reduced. Therefore, it is possible to reduce the difference in the effect which ink receives from the absorbent material piece 140, which occurs as the ink path through the absorbent material pieces 140 varies.

Further, in this embodiment, the ink absorbing member as the negative pressure generating member placed in the negative pressure controlling chamber shell 110 comprises two pieces 130 and 140 of absorbent material, which are different in capillary force. The piece with stronger capillary force is used as the piece for the bottom side. The positioning of the joint pipe 180 below, and adjacent to, the interface 113*c* between the absorbent material pieces 130 and 140 assures that the shifting of the ink path is controlled while providing a reliable buffering zone.

As for an ink delivery port, the ink delivery port 131 located at the approximate center of the bottom wall of the negative pressure controlling chamber shell 110 is described as an example. However, the choice is not limited to the ink delivery port 131; if necessary, an ink delivery port may be moved away from the joint opening 230; in other words, it may be positioned at the left end of the bottom wall, or adjacent to the left sidewall. With such modifications, the position of the ink jet head unit 160, with which the holder 150 is provided, and the position of the ink delivery tube 165, may also be correspondingly altered to the left end of the bottom wall, or the adjacency of the left sidewall.

Valve Mechanism

Next, referring to FIGS. 9(*a*) through (*d*), the valve mechanism provided inside the joint opening 230 of the above described ink container unit 200 will be described.

FIG. 9(*a*) is a front view of the relationship between the second valve body 260*b* and valve plug 261; FIG. 9(*b*) is a lateral and vertically sectional view of the second valve body 260*b* and valve plug 261 illustrated in FIG. 9(*a*); FIG. 9, (*c*) is a front view of the relationship between the second valve body 260*b*, and the valve plug 260 which has slightly rotated; and FIG. 9(*d*) is a lateral and vertically sectional view of the second valve body 260*b* and valve plug 260 illustrated in FIG. 9(*c*).

As shown in FIGS. 3, 9(*a*) and 9(*b*), the front end of the joint opening 230 is elongated in one direction, enlarging the cross-sectional area of the opening, to enhance the ink supplying performance of the ink storing container 201. However, if the joint opening 230 is widened in the width direction perpendicular to the lengthwise direction of the joint opening 230, the space which the ink storing container 201 occupies increases, leading to increase in the apparatus size. This configuration is particularly effective when a plurality of ink containers are placed side by side in terms of the widthwise direction (direction of the scanning movement of the carriage), in parallel to each other, to accommodate the recent trends, that is, colorization and photographic printing. Therefore, in this embodiment, the shape of the cross section of the joint opening 230, that is, the ink outlet of the ink storing container 201 is made oblong.

In addition, in the case of the ink jet head cartridge in this embodiment, the joint opening 230 has two roles: the role of supplying the external shell 210 with ink, and the role of guiding the atmospheric air into the ink storing container 201. Thus, the fact that the shape of the cross section of the joint opening 230 is oblong in the direction parallel to the gravity direction makes it easier to give the top and bottom sides of the joint opening 230 different functions, that is, that is, to allow the top side to essentially function as the air introduction path, and the bottom side to essentially function as the ink supply path, assuring that gas-liquid exchange occurs flawlessly.

As described above, as the ink container unit 200 is installed, the joint pipe 180 of the negative pressure controlling chamber unit 100 is inserted into the joint opening 230. As a result, the valve plug 261 is pushed by the valve activation projection 180*b* located at the end of the joint pipe 180. Consequently, the valve mechanism of the joint opening 230 opens, allowing the ink in the ink storing container 201 to be supplied into the negative pressure controlling chamber unit 100. Even if the valve activation projection 180*b* misses the exact center of the valve plug 261 as it comes into contact with the valve plug 261 to push it, because of the attitude of the ink container unit 200 when the ink container unit 200 is engaged with the joint opening 230, the twisting of the valve plug 261 can be avoided because the cross section of the end portion of the sealing projection 180*a* placed on the peripheral surface of the joint pipe 180 is semicircular. Referring to FIGS. 9(*a*) and (*b*), in order to allow the valve plug 261 to smoothly slide during the above process, a clearance 266 is provided between the joint sealing surface 260 in the joint opening 230, and the circumference of the first valve body side of the valve plug 261.

In addition, at the end of the joint pipe 180, at least the top portion has an opening, and therefore, when the joint pipe 180 is inserted into the joint opening 230, there is no hindrance to the formation of the essential air introduction path through the top sides of the joint pipe 180 and joint opening 230. Therefore, an efficient gas-liquid exchange is possible. On the contrary, during the removal of the ink container unit 200, as the joint pipe 180 separates from the joint opening 230, the valve plug 261 is slid forward, that is, toward the first valve body 260*a*, by the resilient force which it receives from the resilient member 263. As a result, the seal portion 264 of the first valve body 260*a* and the valve plug 261 engage with each other, closing the ink supply path, as shown in FIG. 9(*d*).

Figure 10:
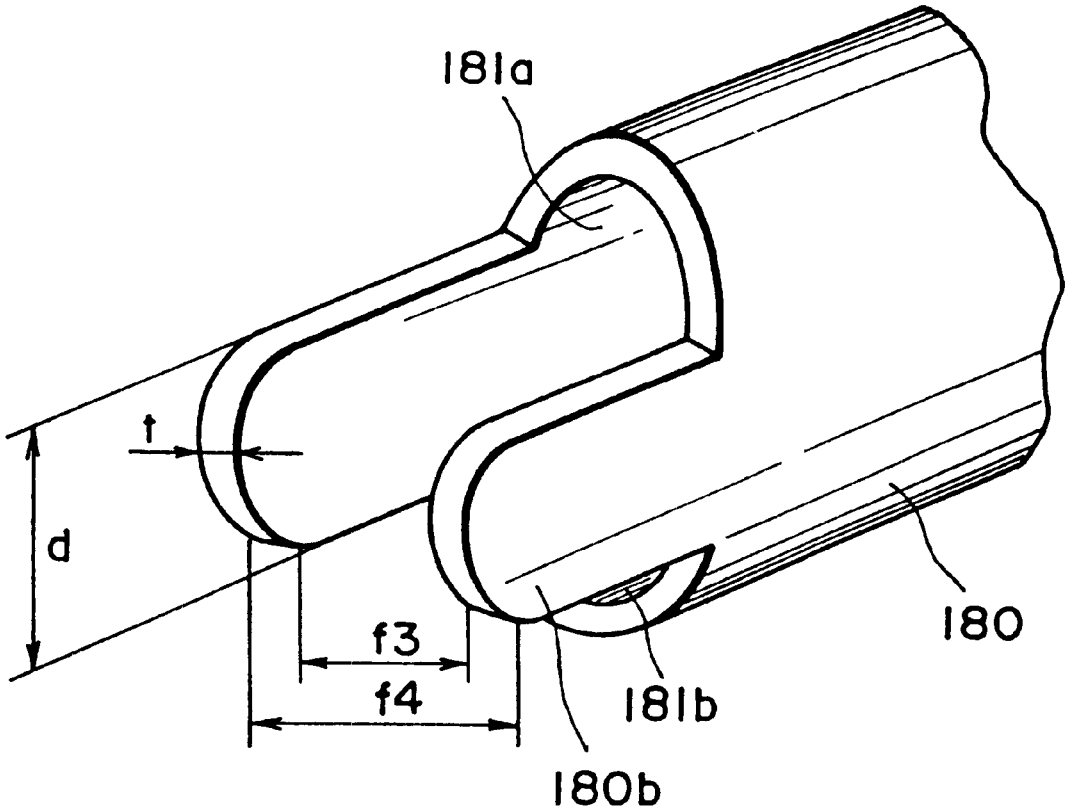
FIG. 10 is a perspective view of an example of the shape of the end portion of the joint pipe which engages with the valve mechanism when the valve mechanism is opened or closed, and to which the present invention is applicable.

FIG. 10 is a perspective view of the end portion of the joint pipe 180, and depicts an example of the shape of the end portion. As shown in FIG. 10, the top side of the end portion of the joint pipe 180 with the aforementioned oblong cross section is provided with an opening 181*a*, and the bottom side of the end portion of the joint pipe 180 is provided with an opening 181*b*. The bottom side opening 181*b* is an ink path, and the top side opening 181*a* is an air path, although ink is occasionally passed through the top side opening 181*a*.

The value of the force applied to the valve plug 261 by the resilient member to keep the valve plug 261 in contact with the first valve body 260*a* is set so that it remains substantially the same even if a pressure difference occurs between the inside and outside of the ink storing container 201 due to the changes in the environment in which the ink storing container 201 is used. If the valve plug 261 is returned to the closed position after the above described ink container unit 200 is used at high altitude with an atmospheric pressure of 0.7, and then, the ink container unit 200 is carried to an environment with an atmospheric pressure of 1.0, the internal pressure of the ink storing container 201 becomes lower than the atmospheric pressure. As a result, the valve plug 261 is pressed in the direction to open the valve mechanism. In the case of this embodiment, the force FA applied to the valve plug 261 by the atmospheric pressures is calculated by the following formula:

$$FA=1.01\times10^5(N/m^2)(=1.0),$$

whereas the force FB applied to the valve plug 261 by the gas in the ink container is obtained from the following formula:

$$FB=0.709\times10^5(N/m^2)(=0.7).$$

The constant force FV necessary to be generated by the resilient member to keep the valve plug 261 in contact with the valve body must satisfy the following requirement:

$$FV-(FA-FB)>0.$$

In other words, in this embodiment, $$FV>1.01\times10^5-0.709\times10^5=0.304\times10^5(N/m^2).$$

This value applies to a situation in which the valve plug 261 is in contact with the first valve body 260*a*, under pressure. When the valve plug 261 is apart from the first valve body 260*a*, that is, after the amount of the deformation of the deformation of the resilient member 26*e* for generating the force applied to the valve plug 261 has increased, the value of the force applied to the valve plug 261 by the resilient member 263 in the direction to push the valve plug 261 toward the first valve body 260*a* is greater, which is evident.

In the case of the above described valve structure, there is a possibility that it suffers from a phenomenon called "twisting". More specifically, the coefficient of friction at the interface between the valve activation projection 180*b* and valve plug 261 sometimes increases due to the adhesion of solidified ink or the like. If such a situation occurs, the valve plug 261 fails to slide on the surface of the valve activation projection 180*b* upon which it was intended to slide. As a result, as the ink container unit 200 is rotationally moved, the valve plug 261 strokes while being pushed, being thereby twisted, in the upward direction in the drawing by the valve activation projection 180*b*.

Thus, hereinafter, the configuration of a valve capable of compensating for the effect of the twisting (clogging) phenomenon upon the sealing performance will be described, along with the comparative examples.

Figure 11:
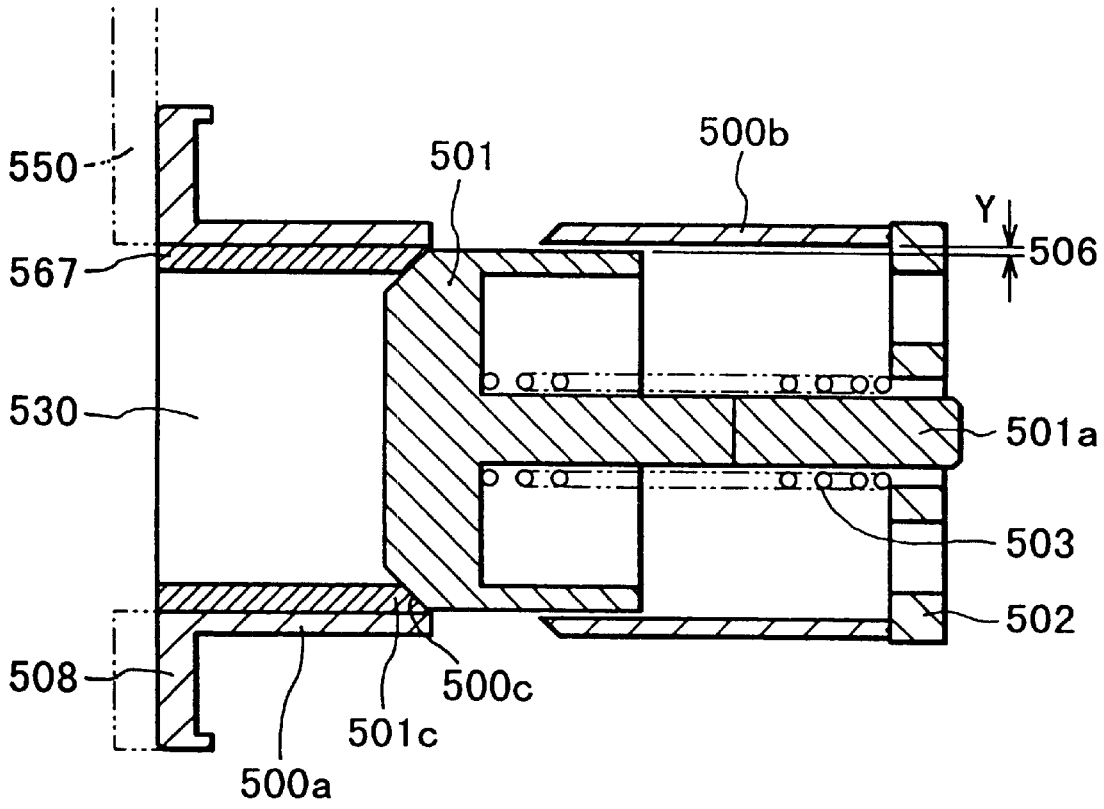
FIG. 11 is a sectional drawing for depicting an example of a valve mechanism, which is to be compared with the valve mechanism in accordance with the present invention.
Figure 12:
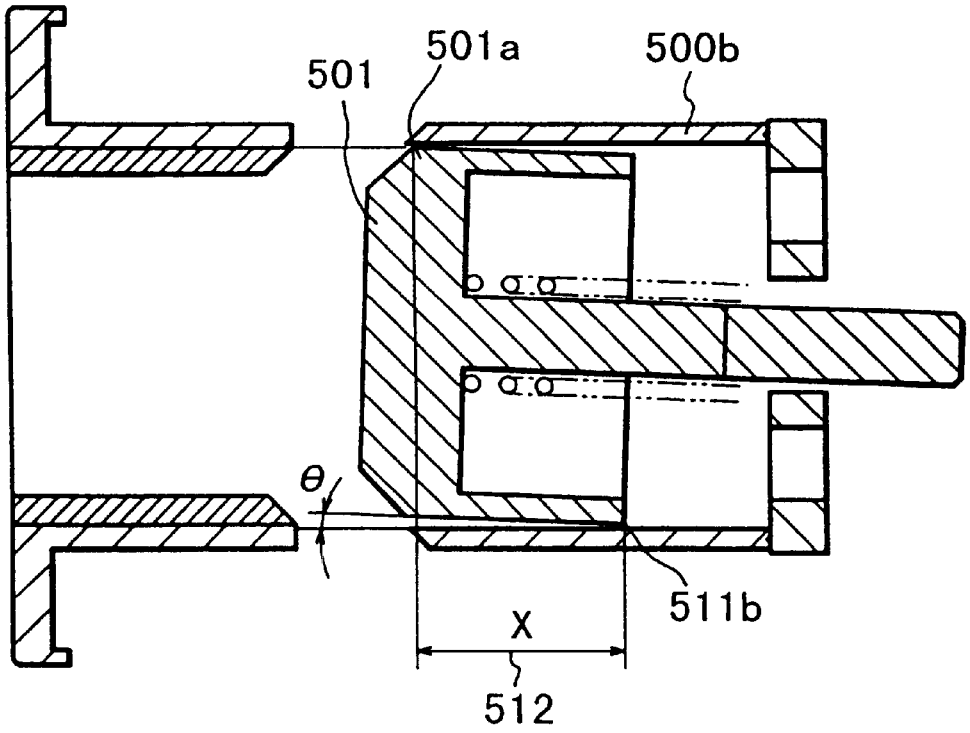
FIG. 12 is a sectional drawing for depicting the state of twisting in the valve mechanism illustrated in FIG. 11.
Figure 13:
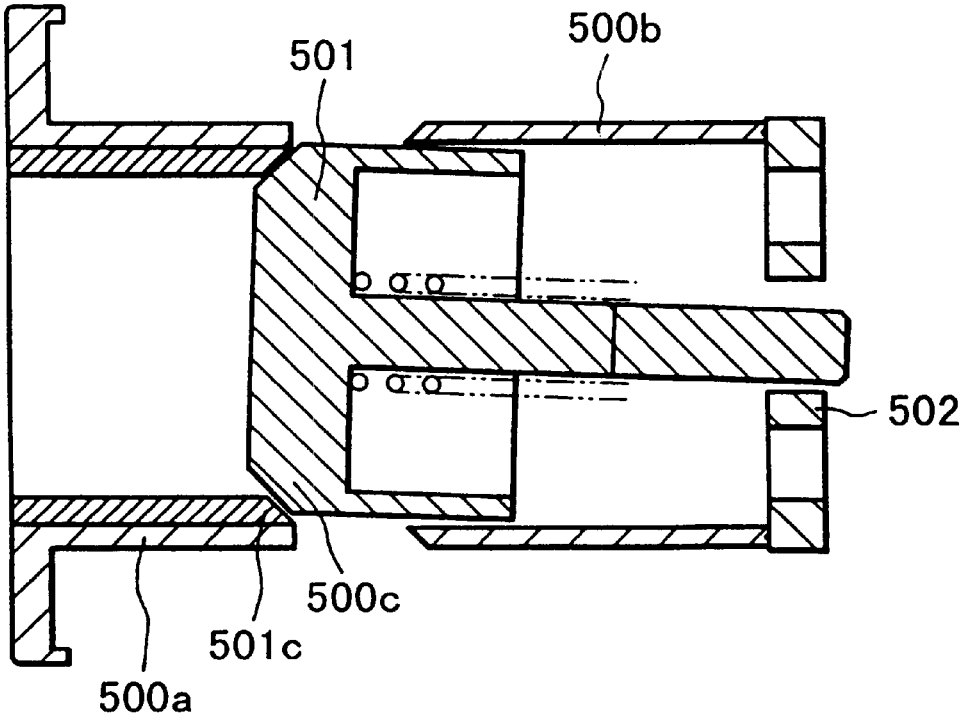
FIG. 13 is a sectional drawing for depicting how the liquid outlet is sealed by the valve mechanism illustrated in FIG. 11.

FIG. 11 shows an example of a valve mechanism, which is compared with the valve mechanism in this embodiment. FIGS. 12 and 13 show the twisting in the valve mechanism illustrated in FIG. 11, and the state in which the joint is sealed. In the case of the comparative example in FIG. 11, a clearance 506 provided between a valve plug 501 with an oblong cross section and a second valve body 500*b* to facilitate the stroking of the valve plug 501, is even. The valve plug 501 is pressed upon a first valve body 500*a* by a resilient member 503 to keep the sealing surface 501*c* of the valve plug 501, that is, the surface of the tapered, second valve body side of the valve plug 501, tightly in contact with the tapered seal portion 500*c* of the first valve body 500*a*, to seal a joint opening 530. Referring to FIG. 12, if the above described twisting phenomenon occurs in the above described structure of the comparative example, the valve plug 501 makes contact with the second valve body 500*b* at two areas, that is, a contact surface 510*a* and a contact surface 511*b*. Representing the distance between these two contact surfaces, and the amount of the clearance, with X and Y, the twist angle θ is: $\theta=\tan^{-1}(2Y/X)$. Assuming that the clearance remains the same, the greater the distance X between the two contact surfaces, the smaller the value of the twist angle θ.

In the case of this comparative example, however, the length X of the contact surface is relatively small (compared to the valve plug diameter, for example), rendering the twist angle θ relatively large. In other words, in order to rectify the twisting, a rotational motion with a relatively large angle is necessary. Therefore, it is evident that the probability that the twisting is rectified after its occurrence is small.

Referring to FIG. 13, if a contact is made with the first valve body 500*a* without rectification of the twisting, the tapered seal portion 501*c* of the valve plug 501 becomes different in the contact radius from the tapered seal portion 500*c* of the first valve body 500*a*. As a result, the contact portions fail to make perfect contact with each other, allowing ink leakage to occur.

The second valve body 500*b* and a valve cover 502 are welded by ultrasonic waves. The valve cover in the comparative example is a simple flat one, raising the possibility that the ultrasonic waves causes misalignment, that is, the accuracy with which the center hole of the valve cover 502, though which the sliding axis 501*a* of the valve plug 501 is put, varies, making it necessary to enlarge the center hole of the valve cover 502 to prevent the wall of the hole of the valve cover 502 from contacting the sliding axis 501*a* of the valve plug 501. Consequently, it becomes difficult to reduce the size of the resilient member 503, and therefore, it becomes difficult to reduce the size of the entirety of the valve mechanism, because the minimum diameter of the resilient member 503 is dependent upon the diameter of the hole of the valve cover 502.

Figure 14:
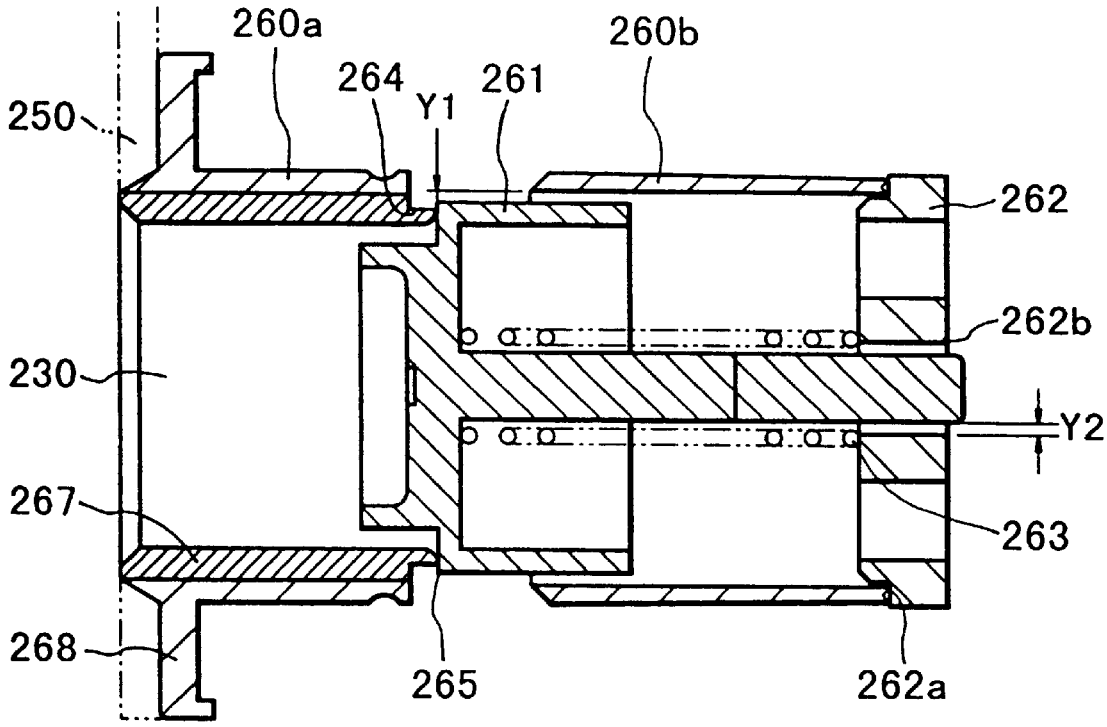
FIG. 14 is a sectional drawing for depicting the valve mechanism in accordance with the present invention.
Figure 15:
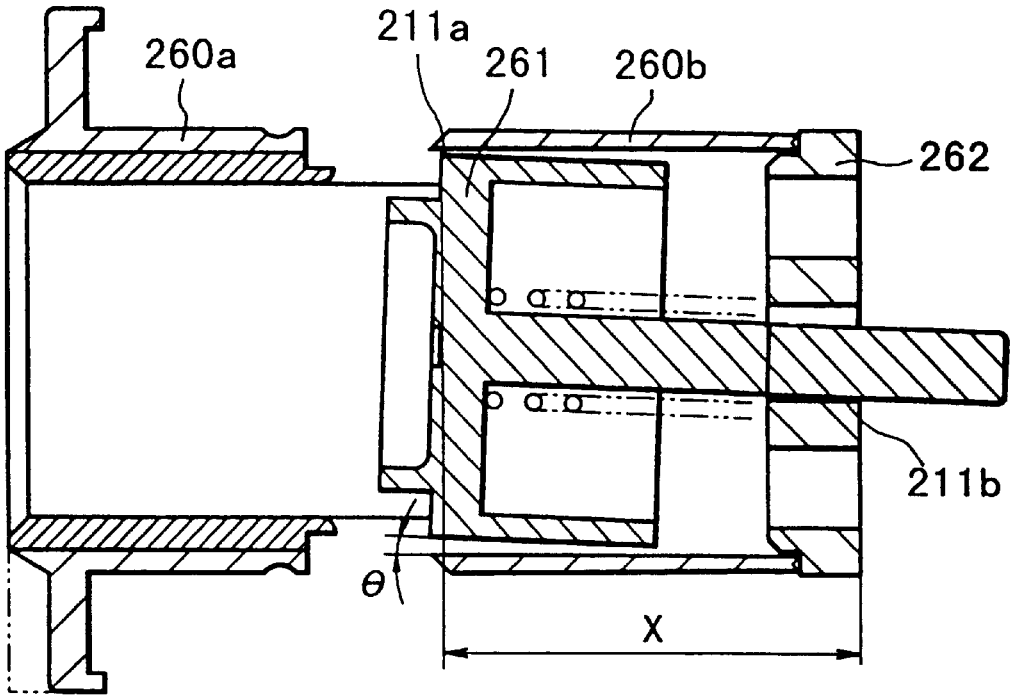
FIG. 15 is a sectional drawing for depicting the state of twisting in the valve mechanism illustrated in FIG. 14.
Figure 16:
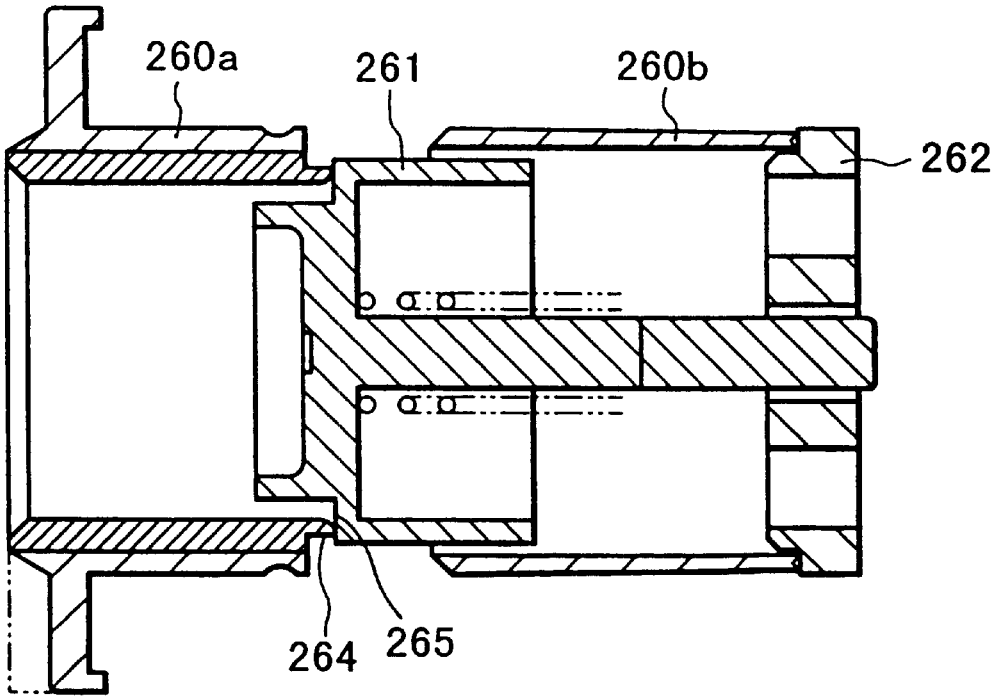
FIG. 16 is a sectional drawing for depicting how the liquid outlet is sealed by the valve mechanism illustrated in FIG. 14.
Figure 17A:
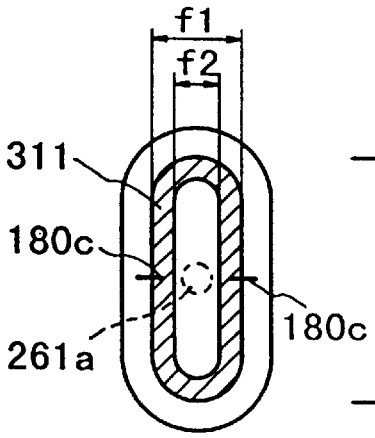
FIGS. 17(*a*) through (*d*) are schematic drawings for depicting how the valve plug of the valve mechanism illustrated in FIG. 14 engages with the end portion of the joint pipe.
Figure 17B:
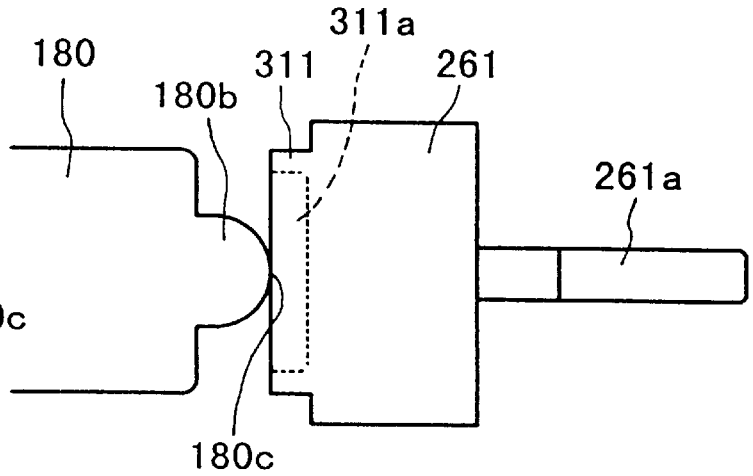
Figure 17C:
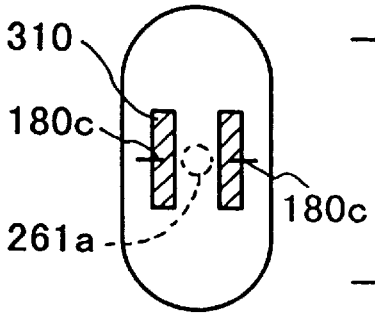
Figure 17D:
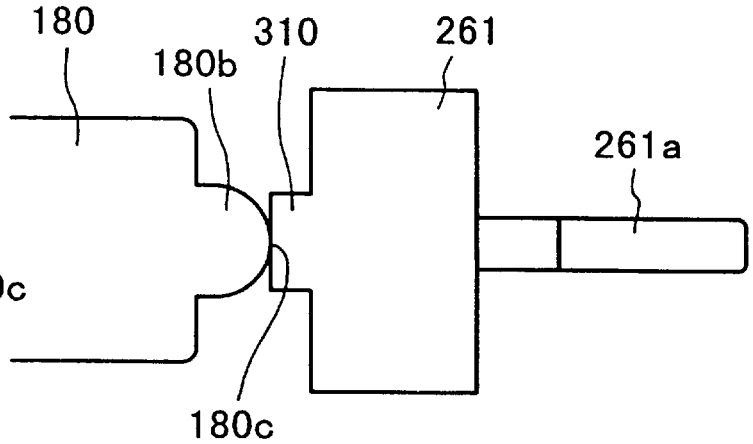

In contrast to the above described comparative example, the valve mechanism in this embodiment has the following structure. FIG. 14 shows the valve mechanism in this embodiment of the present invention, and FIGS. 15 and 16 show the twisting of the valve mechanism in FIG. 14, and the state of the relationship between the two seal portions. Referring to FIG. 14, in this embodiment, the valve plug 261 is tapered in terms of the stroke direction (rightward direction in the drawing); the diameter (at least, length of the major axis) of the valve plug 261 gradually reduces in terms of the rightward direction. The interior wall of the second valve body 260*b* is tapered so that its diameter gradually increases in terms of the stroke (rightward) direction. With this structural arrangement, in order for the valve plug 261 to come into contact with the second valve body 260*b* at a position equivalent to the contact surface 511*b* in the comparative example in FIG. 12 when the valve plug 261 is twisted, a substantially larger angle is necessary, and before the angle of the valve plug 261 reaches this substantially large angle, the sliding axis of the valve plug 261 comes into contact with the wall of the hole of the valve cover 262 (FIG. 15). Thus, the length of X of the contact surface can be set to be longer, making it possible to reduce the amount of the twist angle θ. Therefore, even if the twisted valve plug 261 is placed in contact with the first valve body 500*a* without being rectified in its twist as shown in FIG. 16, the twist angle θ is extremely small compared to the comparative example; the interfaces between the seal portion 265 of the valve plug 261 and the seal portion 264 of the first valve body 260*a* are better sealed.

It should be noted here that representing the length of the contact surface, and the clearance between the sliding axis of the valve plug 261 and the hole of the valve cover 260*b*, with X and Y1:

$$\theta=\tan^{-1}(Y1+Y2/X).$$

The valve cover 252 is provided with a valve cover welding guide 262*a*, which is a stepped portion (depth of penetration by the valve cover: 0.8 mm), and comes in contact with the edge of the second valve body 260*b* as the valve cover 252 is pushed into the second valve body 260*b*. Therefore, the hole of the valve cover 262, through which the sliding axis of the valve plug 261 is put, is rendered smaller than that in the comparative example. In other words, the provision of the valve cover 262 with the welding guide 262*a* reduces the amount of the misalignment between the second valve body 260*b* and the valve cover 262 which is caused by the vibrations occurring during the welding between the two components, and therefore, the accuracy with which the hole of the valve cover 262 is positioned is improved. Thus, it becomes possible to reduce the diameter of the hole of the valve cover 262, which makes it possible to reduce the diameter of the resilient member 263. Consequently, it becomes possible to reduce the size of the valve mechanism. Further, even if force is applied by the valve plug 261 through the sliding axis of the valve plug 261 due to the twisting of the valve plug 261, the rigidity of the valve cover 262 is secured by the valve cover welding guide 262*a*.

The ridge line portion of the hole of the valve cover 262 is provided with an R portion 262*b*. This R portion 262*b* is provided at only the ridge line on the non-welding surface side (right-hand side in the drawing). With the provision of this arrangement, the friction between the sliding axis of the valve plug 261 and the valve cover 262 during the movement, in particular, the opening movement, of the valve plug 261 in the twisted state, can be reduced.

The end portion of the valve plug 261, which comes into contact with the first valve body 260*a*, is a seal portion 265 of the valve plug 261, which has a flat surface. In contrast, the portion of the first valve body 260*a*, which the seal portion 265 of the valve plug 261 contacts, is the seal portion 264 of the first valve body sealing portion 264, that is, the surface of a piece of elastomer 267 placed on the interior surface of the first valve body 260*a*. Flattening the seal portion of the valve plug 261 and first valve body 260*a* equalizes the contact radii of the valve plug 261 having the oblong cross section, with the R portion of the first valve body 260*a*; perfect contact is made between the valve plug 261 and first valve body 260*a*. In addition, the seal portion 264 of the first valve body 260*a* is shaped like a tongue sticking out of a mouth, assuring further that the interfaces between the two components are flawlessly sealed.

In the case of a valve mechanism structured as described above, if clearance is provided between the valve plug 261 and second valve body 260*b*, it occurs sometimes that the valve plug 261 rotates about its axis, within the second valve body 260*b*, during the installation or removal of the ink container unit 200, as shown in FIG. 9(*c*). In this embodiment, however, even if the valve plug 261 is rotated about its axis to the maximum angle, and then, is pressed upon the first valve body 260*a* while remaining in the maximumly rotated state, the contact between the valve plug 261 and first valve body 260*a* is by their seal portions 265 and 264, respectively; in other words, the contact is made surface to surface. Therefore, it is assured that the valve mechanism is airtightly sealed.

In addition, since the joint opening 230 and valve mechanism are shaped so that their cross sections become oblong, the rotational angle of the valve plug 261 during the sliding of the valve plug 261 can be minimized, and also, the valve response can be improved. Therefore, it is possible to assure that the valve mechanism of the joint opening 230 flawlessly functions in terms of sealing performance. Further, since the joint opening 230 and valve mechanism are shaped so that their cross sections become oblong, the projection 180*a* for sealing, provided on the peripheral surface of the joint opening 230, and the valve plug 261, swiftly slide through the joint opening 230 during the installation or removal of the ink container unit 200, assuring that the connecting operation ensues smoothly.

Referring to FIG. 10, the end portion of the joint opening 230, which makes contact with the valve plug 261, comprises two symmetrical absorbent material pieces 180*b*. There are the opening 181*a* for gas-liquid exchange, on the top side of the end portion of the joint opening 230, and the opening 181*b* for supplying liquid, on the bottom side. Therefore, a study was made regarding the idea of providing the valve plug 261 with a pair of contact ribs 310 as counterparts to the projection 180*b*, which are to be positioned on the areas excluding the sealing portion 265 which is placed tightly in contact with the sealing portion 264 of the first valve body 260*a*, as shown in FIGS. 17(*c*) and (*d*). However, during the opening of the valve, the valve plug 261 is pushed back by the force from the resilient member 263, and therefore, the rib portions are required to have a certain amount of rigidity, high enough to prevent the deformation of the rib portions. In addition, regarding the positioning and shapes of the contact rib portions, it is required, from the viewpoint of reliability, that even if the positions of the contact rib portions of the valve plug 261 shift in the radial direction of the sliding axis of the valve plug 261, relative to the two valve activation projections 180*b* of the joint pipe 180, the moments which generate at the two contact rib portions which oppose each other across the sliding axis 261*a*, cancel each other. Therefore, in this embodiment, the valve plug 261 is provided with a circular rib 311 (0.6 mm in width and 1.3 mm in height), which is similar in cross section to the joint pipe 180 which has the oblong cross section, as shown in FIGS. 17(*a*) and (*b*). In other words, the surface of the valve plug 261, on the first valve body side, excluding the sealing portion 265 which is placed in contact with the sealing portion 264 of the first valve body 500*a*, is provided with an oblong recess 311*a*, the center of which coincides with the axial line of the valve plug 261. This structure provides the valve plug 261 with the strength and reliability required when the valve activation projection 180*b* makes contact with the valve plug 261. Making the rib circular, and making the center of the recess coincide with the axial line of the valve plug 261, could improve the moldability of the valve plug 261. From this viewpoint, regarding moldability, it is desired that the base portion of the circular rib, on the recess side, be given a minuscule curvature.

Referring to FIGS. 2 and 3, during the assembly of the ink container unit 200, the ID member 250 is attached by welding and interlocking, after the valve mechanism comprising the first valve body 260*a* and second valve body 260*b* is inserted into the ink delivery opening of the ink storing container 201. In particular, the internal bladder 220 is exposed at the edge of the opening of the ink delivery opening of the ink storing container 201, and the flange 268 of the first valve body 260*a* of the valve mechanism is welded to this exposed portion 221*a* of the internal bladder 220. Thereafter, the ID member 250 is welded at the location of the flange 268, and is interlocked with the engagement portions 201*a* of the container external shell 210.

In the case of this type of assembly, for example, the flange 508 of the first valve body, to which the ID member 550 is attached, is flat as it is in the case of the comparative example illustrated in FIG. 11; the elastomer layer 567 is not exposed at the edge of the ink delivery opening with which the ID member 550 is provided, and therefore, there is a possibility that seal leakage may occur during the process, illustrated in FIGS. 5(*a*) through (*d*), for connecting the joint pipe 180. Thus, in this embodiment, the welding surface of the flange 508 of the first valve body, to which the ID member 550 is welded, and which was in the same plane as the plane of the opening of the joint opening 530, has been moved in the direction opposite to the container installation direction. In other words, the first valve body flange 268 is positioned so that when the ID member 250 is glued to the first valve body flange 268 as shown in FIGS. 2, 14, and the like, the plane of the external surface of the ID member 250 coincides with the plane of the opening of the joint opening 230. This structural arrangement assures the presence of the elastomer layer 267 inside the ink delivery hole with which the ID member 250 is provided, rendering the valve mechanism into a highly reliable one which allows no possibility of the aforementioned seal leakage. Further, since the first valve body flange 268 has been moved away from the plane of the opening of the joint opening 230, the opening portion of the joint opening 230 protrudes from the surface of the first valve body flange 268. Therefore, when the ID member 250 is attached, the position of the ID member is guided by the opening portion of the joint opening 230, making it easier to accurately position the ID member 250.

Each ink storing container 201 of the ink container unit 200 in this embodiment is installed into the holder 150, and supplies the correspondent negative pressure controlling chamber shell 110 with ink through the joint pipe 180 and the valve mechanism of the joint opening 230 of the container 201. The holder 150 holding the ink storing containers 201 as described above is mounted on the carriage of a serial scanning type recording apparatus (FIG. 24) and is moved back and forth in the direction parallel to the plane of recording paper. In this case, it is desired from the viewpoint of product reliability that countermeasures are taken to prevent the state of the sealing between the interior surface of the joint opening 230 of the ink storing container 201, and the exterior surface of the joint pipe 180 of the negative pressure controlling chamber shell 110, from deteriorating due to the twisting which is caused at the joint by the run out of the axis of the joint pipe 180, the shifting of the ink storing containers 201, and the like, which occur as the carriage is moved back and forth.

Therefore, in this embodiment, the thickness of the elastomer layer 267 in the first valve body 260*a* of the valve mechanism shown in FIGS. 2, 14, and the like, is made greater than the minimum requirement for sealing between the first valve body 260*a* and joint pipe 180, so that the run out of the shaft and the twisting, which occur at the location of the joint pipe connection during the reciprocal movement of the carriage, can be neutralized by the elasticity of the elastomer layer, to ensure a high level of reliability in terms of sealing performance. As for other measures, the rigidity of the valve body into which the joint pipe 180 is inserted may be rendered greater than the rigidity of the joint pipe 180, so that the deformation of the valve body, which is caused by the run out of the shaft and the twisting, which occur at the location of the joint pipe connection during the reciprocal movement of the carriage, can be controlled, to ensure a high level of reliability in terms of sealing performance.

Next, referring to FIGS. 10, 17, and 25, the dimensions of the various components for realizing the aforementioned valve mechanism will be described.

Figure 25:
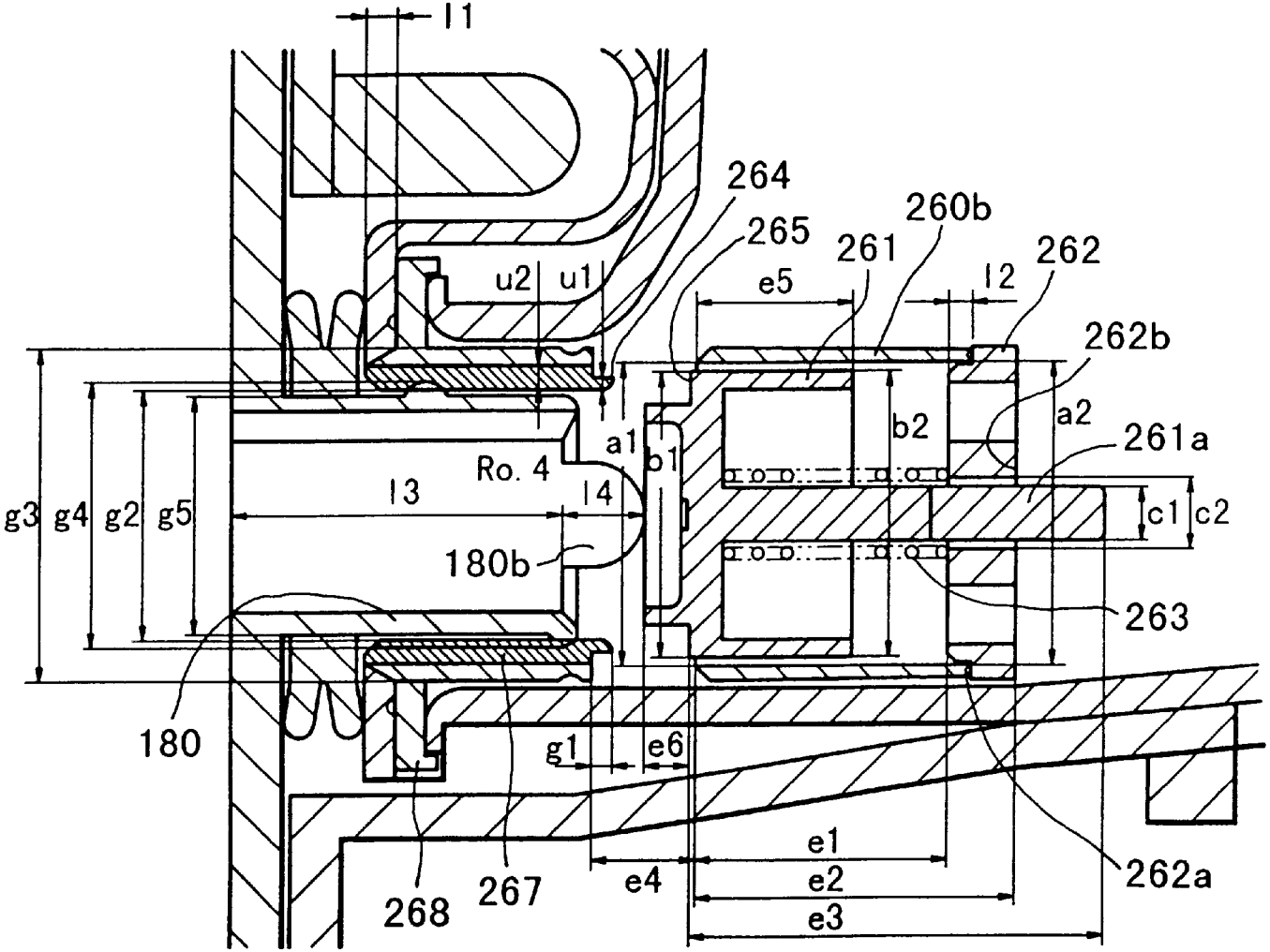
FIG. 25 is a sectional view of the ink container unit, for giving the measurements of the structural components which constitute the joint portion of the ink container unit in accordance with the present invention.

Referring to FIG. 25, the dimension e5 of the valve plug 261 in the longitudinal direction is 5.7 mm; the distance e3 from the sealing portion 265 of the valve plug 261 to the sliding axis 261*a* of the valve plug 261, 14.4 mm; distance e1 from the second valve body 260*b* to the inside surface of the valve cover 262, 8.7 mm; distance e2 from the second valve body 260*b* to the outside surface of the valve cover 262, 11.0 mm; length e4 of the opening between the first valve body 260*a* and second valve body 260*b*, 3.0 mm; the distance e6 the rib protrudes from the sealing portion 265 of the valve plug 261, 1.3 mm; the length 12 of the valve cover welding guide 262*a*, 0.8 mm; dimension b1 of the sealing portion 265 of the valve plug 261 in the longitudinal direction, 9.7 mm; dimension b2 of the valve plug 261, on the valve cover side, in the longitudinal direction, 9.6 mm; dimension a1 of the second valve body 260*b*, on the first valve body side, in the longitudinal direction; 10.2 mm; dimension a2 of the second valve body 260*b*, on the valve cover side, in the longitudinal direction, 10.4 mm; diameter c1 of the sliding axis of the valve plug 261, 1.8 mm; diameter c2 of the hole of the valve cover 262, through which the sliding axis of the valve plug 261 is put, 2.4 mm; length of a spring as the resilient member 263, 11.8 mm (spring constant: 1.016 N/mm); R portion 262*b* of the valve cover 262, R0.2 mm (entire circumference); length g1 of the sealing portion 264 of the first valve body, which is a part of the elastomer layer 267, 0.8 mm; R portion of the sealing portion 264 of the first valve body, R0.4 mm; thickness u1 of the sealing portion 264 of the first valve body, 0.4 mm; thickness u2 of the elastomer layer 267, 0.8 mm; internal diameter g2 of the elastomer layer 267 in the longitudinal direction, 8.4 mm; external diameter g3 of first valve body 260*a* in the longitudinal direction, 10.1 mm; external diameter g5 of the joint pipe 180 in the longitudinal direction, 8.0 mm; external diameter g4, inclusive of the sealing projection 180*a*, of the joint pipe 180 in the longitudinal direction, 8.7 mm; distance 11 of the setback of the first valve body flange 268, 1.0 mm; length 13 of the joint pipe 180, 9.4 mm; and the length 14 of the valve activation projection 180*b* is 2.5 mm.

The length g1 of the sealing portion 264 of the first valve body is set at 0.8 mm; it is desired that the length g1 is sufficient to allow the sealing portion 264 of the first valve body to protrude far enough from the valve body so that the sealing portion 264 bends outward and perfectly seals the gap as it makes contact with the sealing portion 265 of the sealing portion 264 of the valve plug 261.

For the reason given above, the length g1 of the sealing portion of the first valve body has only to be within a range which satisfies the following inequality:

$$(g3-g2)/2>g1>(b1-g2)/2.$$

As for the dimension of the valve activation projection 180*b* of the joint pipe 180, and the rib 311 of the valve plug 261, which are in contact with each other as shown in FIGS. 10 and 17, the thicknesses t of the joint pipe 180 and rib 211 are 0.75 mm; distance f3 between the inside surfaces of the opposing valve activation projection 180*b*, 1.7 mm; distance f4 between the outside surfaces of the opposing valve activation projection 180*b*, 3.2 mm; distance f1 between the outside surfaces of the oblong rib 311 of the valve plug 261 at the short axis of the oblong rib 311, 2.6 mm; distance f2 between the inside surfaces of the rib 311 at the short axis, 1.4 mm; and the length d of the rib 311 is 3.6 mm.

It is desired from the viewpoint of molding accuracy that the thickness u2 of the elastomer layer 267 on the inside surface of the first valve body 260*a* with the oblong cross section is even; the thickness at the curved portion and the thickness at the straight portion are the same. In terms of the vertical direction of the joint opening 230, the depth of the sealing bite between the elastomer layer 267 and the largest diameter portion (portion comprising the sealing projection 180*a*) of the joint pipe 180 is: g4−g2=0.3 mm, and this amount is absorbed by the elastomer layer 267. The total thickness of the elastomer layer 267, which is involved in the absorption is: 0.8 mm×2=1.6 mm. However, since the depth of the bite is 0.3 mm, it does not require as much force as otherwise necessary, to deform the elastomer layer 267. Also in terms of the horizontal direction of the joint opening 230, the depth of the bite for sealing is set at 0.3 mm, and the elastomer layer 267, the total thickness of which for the absorption is: 0.8 mm×2=1.6 mm, is made to absorb this amount. The exterior diameter g5 of the joint pipe 180 in the vertical direction is smaller than the internal diameter g2 of the elastomer layer 267: g5<g2, and this relationship also applies to the horizontal direction: g5<g2. Therefore, in the state illustrated in FIG. 25, it is assured that the elastomer layer comes into contact with only the sealing projection 180*a* of the joint pipe 180, allowing the joint pipe 180 to be smoothly inserted, to perfectly seal the joint. The play in the horizontal direction between the ink storing container 201 and holder 150 has only to be in a range (±0.8 mm in this embodiment) in which the play can be absorbed by the thickness of the elastomer layer 267. In this embodiment, the maximum tolerance of the play is set at ±0.4 mm. In this embodiment, if the amount of the play in the horizontal direction (amount of displacement from the center) is greater than a half of the absolute value of the difference between the external diameter g5 and the internal diameter g2 of the elastomer layer 267 (in other words, if the amount of the play in this embodiment in terms of the horizontal direction is no less than ñ0.2 mm), the external surface of the joint pipe 180, exclusive of the external surface of the sealing portion 180*a*, contacts the elastomer layer 267 across a wide range, and presses thereupon. Therefore, the resiliency of the elastomer generates centering force.

Employing the above listed measurements made it possible to realize a valve mechanism capable of providing the above described effects.

Effects of Valve Mechanism Position

In the case of the ink jet head cartridge in this embodiment, the valve cover 262 and second valve body 260*b* of the valve mechanism attached to the joint opening 230 of the ink container unit 200 protrude deeper into the internal bladder 220. With this arrangement, even if the internal bladder 220 becomes separated from the external shell 210, across the portion adjacent to the joint opening 230 due to the deformation of the internal bladder 220 caused by the consumption of the ink in the internal bladder 220, the deformation of the internal bladder 220, adjacent to the joint opening 230, is regulated by the portion of the valve mechanism, which has been deeply inserted into the internal bladder 220, that is, the valve cover 262 and second valve body 260*b*. In other words, even if the internal bladder 220 deforms as the ink is consumed, the deformation of the internal bladder 220, immediately adjacent to the valve mechanism and in the area surrounding the immediate adjacencies of the valve mechanism, is regulated by the valve mechanism, and therefore, the ink path in the adjacencies of the valve mechanism, in the internal bladder 220, and the bubble path for allowing bubbles to rise during gas-liquid exchange, are ensured. Therefore, during the deformation of the internal bladder 220, ink is not prevented from being supplied from the internal bladder 220 into the negative pressure controlling chamber unit 100, and the bubbles are not prevented from rising in the internal bladder 220.

In the case of the ink container unit 200 comprising the internal bladder 220 deformable as described above, or the ink jet head cartridge equipped with the negative pressure controlling chamber unit 100, it is desired from the viewpoint of increasing the buffering space in the external shell 210 that balance is maintained between the negative pressure in the internal bladder 220 and the negative pressure in the negative pressure controlling chamber shell 110 so that the gas-liquid exchange occurs between the ink container unit 200 and negative pressure controlling chamber unit 100 after the internal bladder 220 is deformed to the maximum extent. For the sake of high speed ink delivery, the joint opening 230 of the ink container unit 200 may be enlarged. Obviously, it is desired that there is a large space in the region adjacent to the joint opening 230 of the internal bladder 220, and that ample ink supply path is secured in this region.

If the deformation of the internal bladder 220 is increased to secure the buffering space in the external shell 210 which contains the internal bladder 220, normally, the space adjacent to the joint opening 230 in the internal bladder 220 narrows as the internal bladder 220 deforms. If the space adjacent to the joint opening 230 in the internal bladder 220 narrows, the bubbles are prevented from rising in the internal bladder 220, and the ink supply path adjacent to the joint opening 230 is shrunk, raising the possibility that they will fail to compensate for the high speed ink delivery. Therefore, in the case that the valve mechanism does not protrude deeply into the internal bladder 220, and the deformation of the internal bladder 220, adjacent to the joint opening 230, is not regulated, unlike the ink jet head cartridge in this embodiment, the amount of the deformation of the internal bladder 220 must be kept within a range in which the deformation does not substantially affect the ink delivery, so that balance is maintained between the negative pressure in the internal bladder 220 and the negative pressure in the negative pressure controlling chamber shell 110, to compensate for the high speed ink delivery.

Comparatively, in this embodiment, the valve mechanism protrudes deeply into the internal bladder 220 as described above, and the deformation of the internal bladder 220, adjacent to the joint opening 230, is regulated by the valve mechanism. Therefore, even if the deformation of the internal bladder 220 is increased, the region adjacent to the joint opening 230, that is, the region through which the ink supply path leads to the joint opening 230, is secured by sufficient size, making it possible to accomplish both objects: securing a large buffering space in the external shell 210, and securing an ink delivery path capable of accommodating high speed ink delivery.

Below the bottom portion of the ink container unit 200 of the above described ink jet head cartridge, an electrode 270 used as an ink remainder amount detecting means for detecting the amount of the ink remaining in the internal bladder 220, as will be described later, is positioned. The electrode 270 is fixed to the carriage of a printer into which the holder 150 is installed. The joint opening 230 to which the valve mechanism is attached is located in the bottom portion of the ink container unit 200, adjacent to the front wall, that is, the wall on the negative pressure controlling chamber unit side. The valve mechanism is inserted deep into the internal bladder 220 in the direction approximately parallel to the bottom surface of the ink container unit 200, and therefore, when the internal bladder 220 deforms, the deformation of the bottom portion of the internal bladder 220 is regulated by the deeply inserted portion of the valve mechanism. In addition, the deformation of the bottom portion of the internal bladder 220 during the deformation of the internal bladder 220 is regulated also by the slanting of a part of the bottom portion of the ink storing container 201 comprising the external shell 110 and internal bladder 220. Since the shifting of the bottom portion of the internal bladder 220 relative to the electrode 270 is regulated by the further regulation of the deformation of the bottom portion of the internal bladder 220 by the valve mechanism, in addition to, the effect of the regulation of the deformation of the bottom portion of the internal bladder 220 by the slanting of the bottom portion of the ink storing container 201, it becomes possible to more accurately carry out the ink remainder amount detection. Therefore, the above described regulation of the deformation of the internal bladder 220, adjacent to the joint opening 230, by the valve mechanism makes it possible to obtain a liquid supplying system capable of more accurately detecting the ink remainder amount, in addition to accomplishing the two objectives of securing a large buffering space in the external shell 210 by increasing the deformation of the internal bladder 220, and supplying ink at a high rate.

In this embodiment, the valve mechanism is inserted deeper into the internal bladder 220 so that the deformation of the internal bladder 220, adjacent to the joint opening 230, is regulated as described above, but a member different from the valve mechanism may be inserted into the internal bladder 220 to regulate the deformation of the aforementioned portion of the internal bladder 220. Further, a piece of plate may be inserted into the internal bladder 220 through the joint opening 230 so that the piece of plate stretches along the bottom surface of the internal bladder 220. With this arrangement, more accurate ink remainder amount detection can be carried out when the ink remainder amount in the internal bladder 220 is detected with the use of the electrode 270.

In addition, in this embodiment, in the valve mechanism attached to the joint opening 230, the structural components of the valve mechanism protrude far deeper into the internal bladder 220, beyond the opening 260*c* which is connected to the joint opening 230 to form an ink path. With this structural arrangement, it is assured that an ink path is secured in the adjacencies of the joint opening 230, in the internal bladder 220 of the ink container unit 200.

Production Method for Ink Container

Next, referring to FIGS. 18(*a*) through (*c*), a production method for the ink container in this embodiment will be described. First, referring to FIG. 18(*a*), the exposed portion 221*a* of the internal bladder 220 of the ink storing container 201 is directed upward, and the ink 401 is injected into the ink storing container 201 with the use of an ink injection nozzle 402 through the ink delivery opening. In the case of the structure in accordance with the present invention, ink injection can be performed under the atmospheric pressure.

Figure 18C:
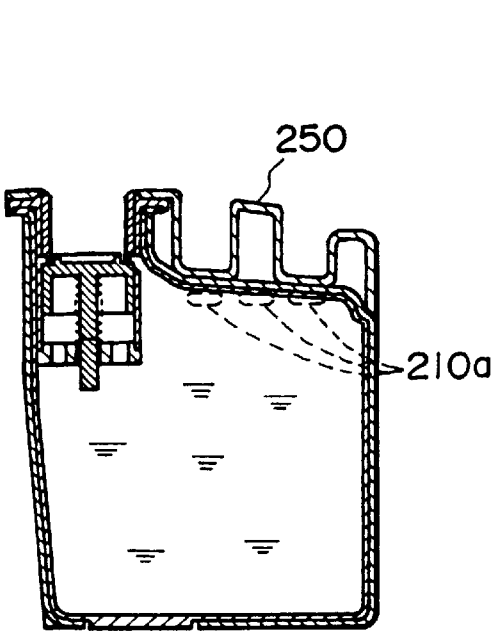
FIGS. 18(*a*) through (*c*) are sectional drawings for depicting the method for manufacturing an ink storing container in accordance with the present invention.
Figure 18B:
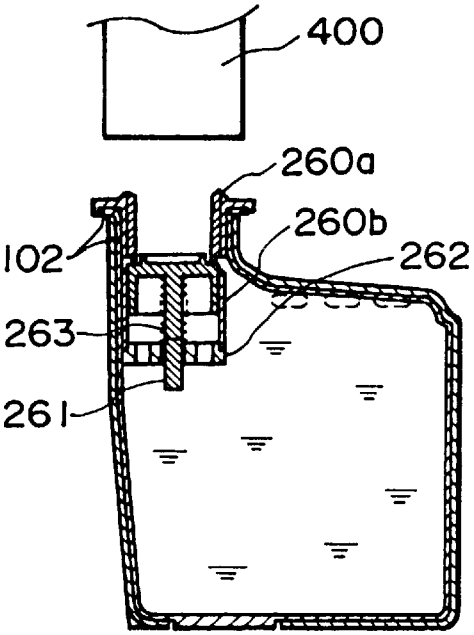
Figure 18A:
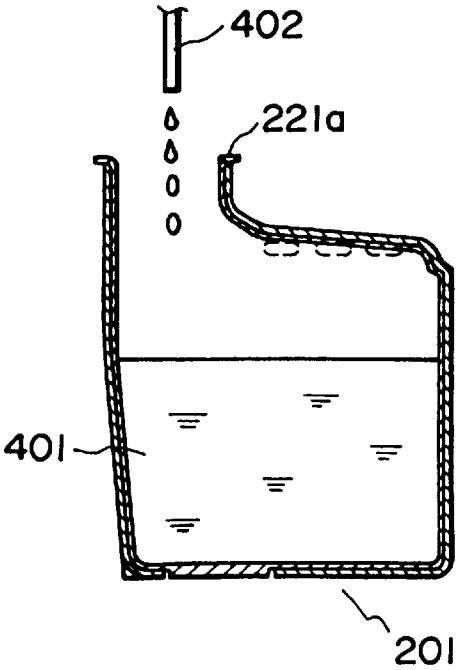

Next, referring to FIG. 18(*b*), the valve plug 261, valve cover 262, resilient member 263, first valve body 260*a*, and second valve body 260*b*, are assembled together into a valve unit, and then, this valve unit is dropped into the ink delivery opening of the ink storing container 201.

At this point in time, the periphery of the sealing surface 102 of the ink storing container 201 is surrounded by the stepped shape of the first valve body 260*a*, on the outward side of the welding surface, making it possible to improve the positional accuracy with which the ink storing container 201 and first valve body 260*a* are positioned relative to each other. Thus, it becomes possible to lower a welding horn 400 from above to be placed in contact with the periphery of the joint opening 230 of the first valve body 260*a*, so that the first valve body 260*a* and the internal bladder 220 of the ink storing container 201 are welded to each other at the sealing surface 102, and at the same time, the first valve body 260*a* and the external shell 210 of the ink storing container 201 are welded to each other at the periphery of the sealing surface 102, assuring that the joints are perfectly sealed. The present invention is applicable to a production method which uses ultrasonic welding or vibration welding, as well as a production method which uses thermal welding, adhesive, or the like.

Next, referring to FIG. 18(*c*), the ID member 250 is placed on the ink storing container 201 to which the first valve body 260*a* has been welded, in a manner to cover the ink storing container 201. During this process, the engagement portions 210*a* formed in the side wall of the external shell of the ink storing container 201, and the click portions 250*a* of the ID member 250, engage, and at the same time, the click portions 250*a* located on the bottom surface side engage, with the external shell 210, on the side opposite to the sealing surface 102 of the ink storing container 201, with the first valve body 260*a* interposed (FIG. 3).

Detection of Ink Remainder Amount in Container

Next, the detection of the ink remainder amount in the ink container unit will be described.

Referring to FIG. 2, below the region of the holder 150 where the ink container unit 200 is installed, the electrode 270 in the form of a piece of plate with a width narrower than the width of the ink storing container 201 (depth direction of the drawing) is provided. This electrode 270 is fixed to the carriage (unillustrated) of the printer, to which the holder 150 is attached, and is connected to the electrical control system of the printer through the wiring 271.

On the other hand, the ink jet head unit 160 comprises: an ink path 162 connected to the ink delivery tube 165; a plurality of nozzles (unillustrated) equipped with an energy generating element (unillustrated) for generating the ink ejection energy; and a common liquid chamber 164 for temporarily holding the ink supplied through the ink path 162, and then, supplying the ink to each nozzle. Each energy generating element is connected to a connection terminal 281 with which the holder 150 is provided, and as the holder 150 is mounted on the carriage, the connection terminal 281 is connected to the electrical control system of the printer. The recording signals from the printer are sent to the energy generating elements through the connection terminal 281, to give ejection energy to the ink in the nozzles by driving the energy generating elements. As a result, ink is ejected from the ejection orifices, or the opening ends of the nozzles.

Also, in the common liquid chamber 164, an electrode 290 is disposed, which is connected to the electrical control system of the printer through the same connection terminal 281. These two electrodes 270 and 290 constitute the ink remainder amount detecting means in the ink storing container 201.

Further, in this embodiment, in order to enable this ink remainder amount detecting means to detect more accurately the ink remainder amount, the joint opening 230 of the ink container unit 200 is located in the bottom portion, that is, the bottom portion when in use, in the wall of the ink storing container 201, between the largest walls of the ink storing container 201. Further, a part of the bottom wall of the ink supplying container 201 is slanted so that the bottom surface holds an angle relative to the horizontal plane when the ink storing container 201 is in use. More specifically, referring to the side, where the joint opening 230 of the ink container unit 200 is located, the front side, and the side opposite thereto, the rear side, in the adjacencies of the front portion in which the valve mechanism is disposed, the bottom wall is rendered parallel to the horizontal plane, whereas in the region therefrom to the rear end, the bottom wall is slanted upward toward the rear. In consideration of the deformation of the internal bladder 220, which will be described later, it is desired that this angle at which the bottom wall of the ink storing container 201 is obtuse relative to the rear sidewall of the ink container unit 200. In this embodiment, it is set to be no less than 95 degrees.

The electrode 270 is given a shape which conforms to the shape of the bottom wall of the ink storing container 201, and is positioned in the area correspondent to the slanted portion of the bottom wall of the ink storing container 201, in parallel to the slanted portion.

Hereinafter, the detection of the ink remainder amount in the ink storing container 201 by this ink remainder amount detecting means will be described.

The ink remainder amount detection is carried out by detecting the capacitance (electrostatic capacity) which changes in response to the size of the portion of the electrode 270 correspondent to where the body of the remaining ink is, while applying pulse voltage between the electrode 270 on the holder 150 side and the electrode 290 in the common liquid chamber 164. For example, the presence or absence of ink in the ink storing container 201 can be detected by applying between the electrodes 270 and 290, such pulse voltage that has a peak value of 5V, a rectangular waveform, and a pulse frequency of 1 kHz, and computing the time constant and gain of the circuit.

As the amount of the ink remaining in the ink storing container 201 reduces due to ink consumption, the ink liquid surface descends toward the bottom wall of the ink storing container 201. As the ink remainder amount further reduces, the ink liquid surface descends to a level correspondent to the slanted portion of the bottom wall of the ink storing container 201. Thereafter, as the ink is further consumed (the distance between the electrode 270 and the body of the ink remains approximately constant), the size of the portion of the electrode 270 correspondent to where the body of ink remains, gradually reduces, and therefore, capacitance begins to reduce.

Eventually, the ink will disappear from the area which corresponds with the position of the electrode 270. Thus, the decrease of the gain, and the increase in electrical resistance caused by the ink, can be detected by computing the time constant by changing the pulse width of the applied pulse or changing the pulse frequency. With this, it is determined that the amount of the ink in the ink storing container 201 is extremely small.

The above is the general concept of the ink remainder amount detection. In reality, in this embodiment, the ink storing container 201 comprises the internal bladder 220 and external shell 210, and as the ink is consumed, the internal bladder 220 deforms inward, that is, in the direction to reduce its internal volume, while allowing gas-liquid exchange between the negative pressure controlling chamber shell 110 and ink storing container 201, and the introduction of air between the external shell 210 and internal bladder 220 through the air vent 222, so that balance is maintained between the negative pressure in the negative pressure controlling chamber shell 110 and the negative pressure in the ink storing container 201.

Referring to FIG. 6, during this deformation, the internal bladder 220 deforms while being controlled by the corner portions of the ink storing container 201. The amount of the deformation of the internal bladder 220, and resultant partial or complete separation of the walls of the internal bladder 220 from the external shell 210, are the largest at the two walls having the largest size (walls approximately parallel to the plane of the cross sectional in FIG. 6), and is small at the bottom wall, or the wall adjacent to the above two walls. Nevertheless, with the increase in the deformation of the internal bladder 220, the distance between the body of the ink and the electrode 270, and the capacitance decreases in reverse proportion to the distance. However, in this embodiment, the main area of the electrode 270 is in a plane approximately perpendicular to the deformational direction of the internal bladder 220, and therefore, even when the internal bladder 220 deforms, the electrode 270 and the wall of the bottom portion of the internal bladder 220 remain approximately parallel to each other. As a result, the surface area directly related to the electrostatic capacity is secured in terms of size, assuring accuracy in detection.

Further, as described before, in this embodiment, the ink storing container 201 is structured so that the angle of the corner portion between the bottom wall and the rear sidewall becomes no less than 95 degrees. Therefore, it is easier for the internal bladder 220 to separate from the external shell 210 at this corner compared to the other corners. Thus, even when the internal bladder 220 deforms toward the joint opening 230, it is easier for the ink to be discharged toward the joint opening 230.

Hereinbefore, the structural aspects of this embodiment were individually described. These structures may be employed in optional combinations, and the combinations promise a possibility of enhancing the aforementioned effects.

For example, combining the oblong structure of the joint portion with the above described valve structure stabilizes the sliding action during the installation or removal, assuring that the value is smoothly open or closed. Giving the joint portion the oblong cross section assures an increase in the rate at which ink is supplied. In this case, the location of the fulcrum shifts upward, but slanting the bottom wall of the ink container upward makes possible stable installation and removal, that is, the installation and removal during which the amount of twisting is small.

Ink Jet Head Cartridge

Figure 23:
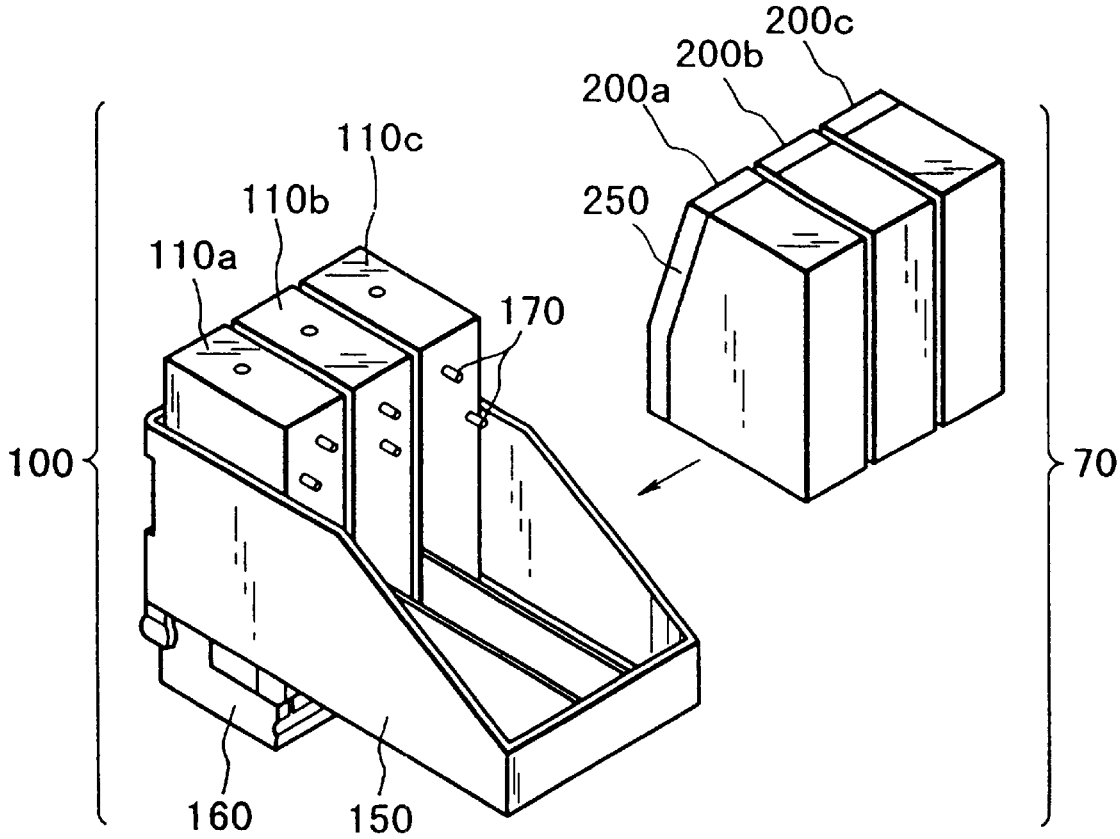
FIG. 23 is a schematic perspective view of an ink jet head cartridge compatible with the ink container unit in accordance with the present invention.

FIG. 23 is a perspective view of an ink jet head cartridge employing an ink container unit to which the present invention is applicable, and depicts the general structure of the ink jet head cartridge.

An ink jet head cartridge 70 in this embodiment, illustrated in FIG. 23, is provided with the negative pressure controlling chamber unit 100, which comprises the ink jet head unit 160 enabled to eject plural kinds of ink different in color (yellow (Y), magenta (M), and cyan (C), in this embodiment) and the negative pressure controlling chamber unit 100 integrally comprising the negative pressure controlling chamber shells 110*a*, 110*b*, and 110*c*. The ink container units 200*a*, 200*b*, and 200*c*, which contain liquid different in color are individually and removably connectable to the negative pressure controlling chamber unit 100.

In order to assure that the plurality of the ink container units 200*a*, 200*b*, and 200*c*, are connected to the correspondent negative pressure controlling chamber shells 110*a*, 110*b*, and 110*c*, without an error, the ink jet head cartridge is provided with the ink holder 150, which partially covers the exterior surface of the ink container unit 200, and each ink container unit 200 is provided with the ID member 250. The ID member 250 is provided with the plurality of the recessed portions, or the slots, and is attached to the front surface of the ink container unit 200, in terms of the installation direction, whereas the negative pressure controlling chamber shell 110 is provided with the plurality of the ID members 170 in the form of a projection, which corresponds to the slot in position and shape. Therefore, it is assured that the installation error is prevented.

In the case of the present invention, the color of the liquid stored in the ink container units may be different from Y, M, and C, which is obvious. It is also obvious that the number of the liquid containers and the type of combination of the liquid containers (for example, a combination of a single black (Bk) ink container and a compound ink container containing inks of Y, M, and C colors), are optional.

Recording Apparatus

Next, referring to FIG. 24, an example of an ink jet recording apparatus in which the above described ink container unit or ink jet head cartridge can be mounted will be described.

Figure 24:
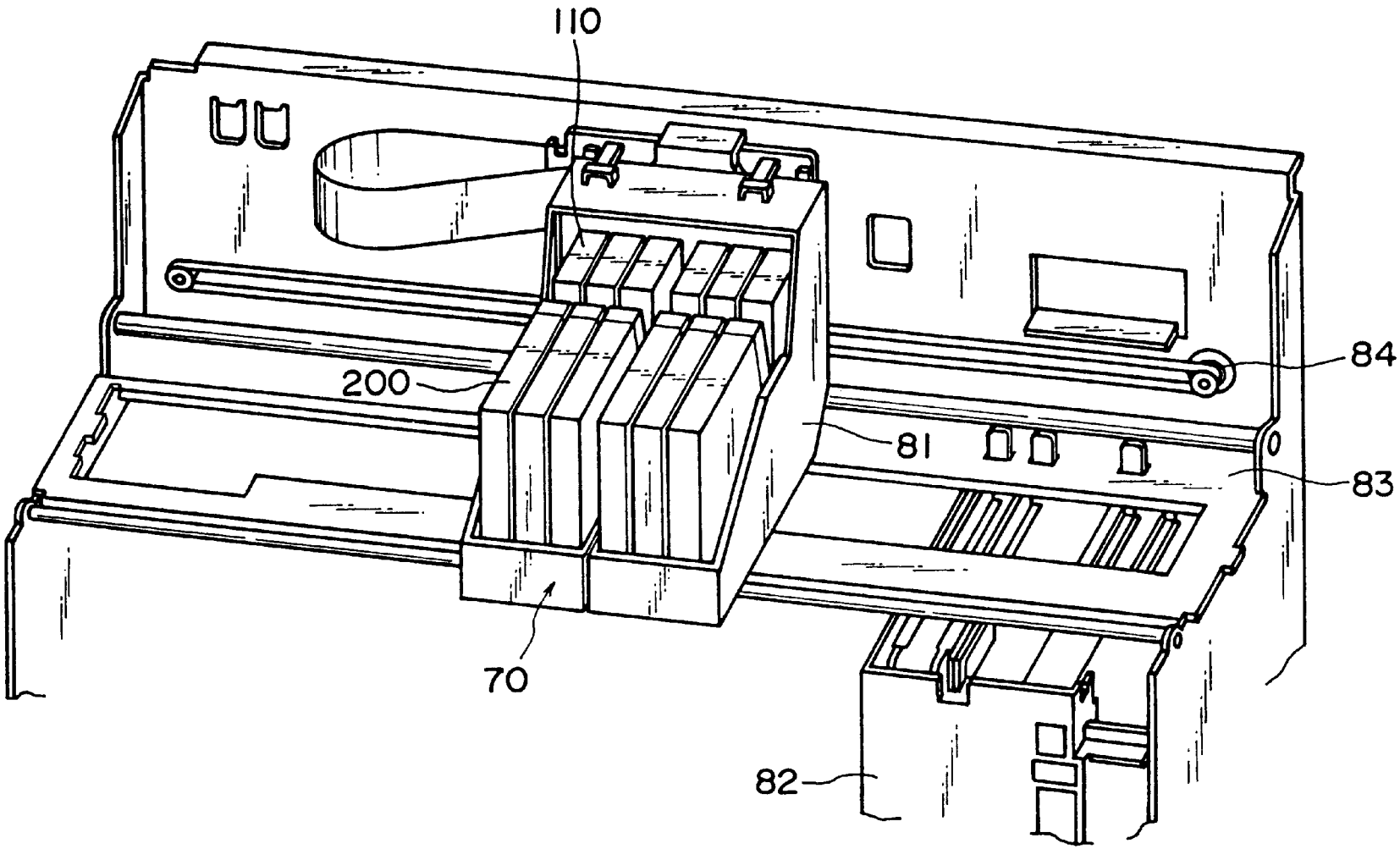
FIG. 24 is a schematic perspective view of a recording apparatus compatible with the ink jet head cartridge in accordance with the present invention.

The recording apparatus shown in FIG. 24 is provided with: a carriage 81 on which the ink container unit 200 and the ink jet head cartridge 70 are removably installable; a head recovery unit 82 assembled from a head cap for preventing ink from losing liquid components through the plurality of orifices of the head and a suction pump for sucking out ink from the plurality of orifices as the head malfunctions; and a sheet feeding surface 83 by which recording paper as recording medium is conveyed.

The carriage 81 uses a position above the recovery unit 82 as its home position, and is scanned in the leftward direction as a belt 84 is driven by a motor or the like. Printing is performed by ejecting ink from the head toward the recording paper conveyed onto the sheet feeding surface 83.

As described above, the above structure in this embodiment is a structure not found among the conventional recording apparatuses. Not only do the aforementioned substructures of this structure individually contribute to the effectiveness and efficiency, but also contribute cooperatively, rendering the entirety of the structure organic. In other words, the above described substructures are excellent inventions, whether they are viewed individually or in combination; disclosed above are examples of the preferable structure in accordance with the present invention. Further, although the valve mechanism in accordance with the present invention is most suitable for the usage in the above described liquid container, the configuration of the liquid container does not need to be limited to the above described one; it can be also applied to liquid containers of different types in which liquid is directly stored in the liquid delivery opening portion.

Further descriptions will be made as to presence-absence detection (remaining amount detection) and modified examples of the liquid supplying system and the liquid supply container according to the present invention.

Figure 26:
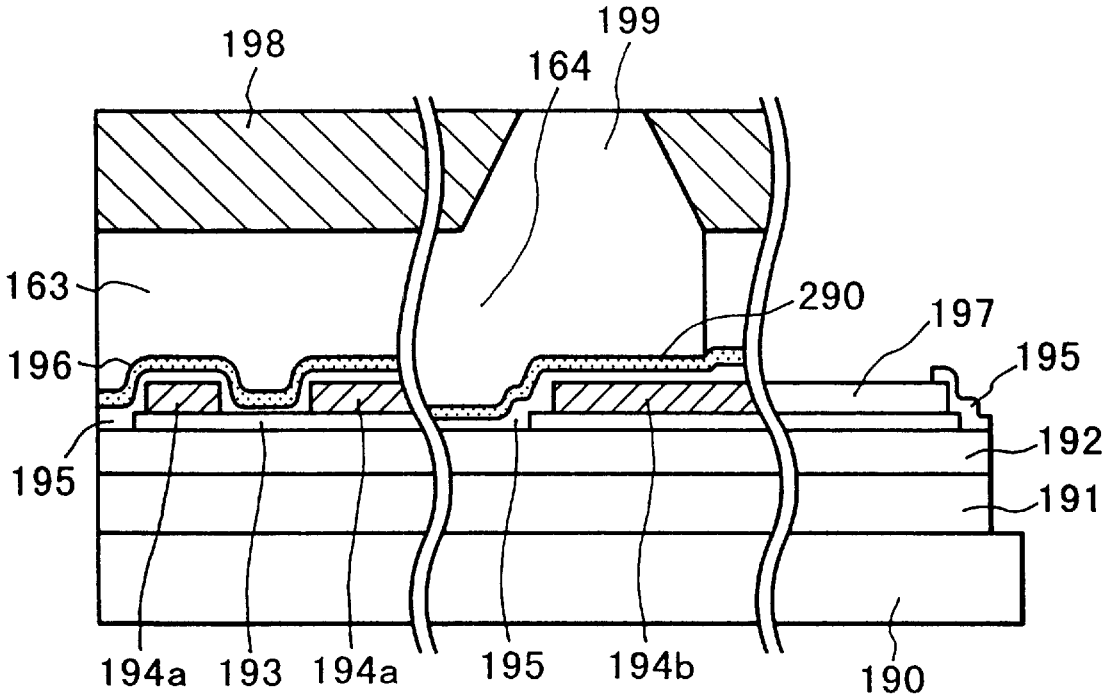
FIG. 26 is a sectional view of an ink jet head unit show in FIG. 2.

Referring to FIG. 26, the description will be made as to a structure of the ink jet head unit 160 used for the ink jet head cartridge according to the present invention as shown in FIG. 2, for example. FIG. 26 is a longitudinal sectional view of the nozzle of the ink jet head unit 160. In FIG. 26, a silicon substrate 191 is supported on a support substrate 190 of Al and is provided with a heat accumulation layer 192 of $SiO_2$ laminated thereon and a heat generating resistance layer 198 of TaN thereon. On the heat generating resistance layer 198, wiring 194*a* for the heat generating resistance is provided, and the region sandwiched by the wiring 194*a* is a heat acting zone. On the other hand, wiring 194*b* for the electrode 290 which will be described hereinafter is provided in common liquid chamber 164 side. At the end opposite from the nozzle 163, a contact pad 197 is provided for external electric connection. On the wiring 194*a*, a protection layer 195 of a SiN and an anti-cavitation layer 196 of Ta are laminated. On the other hand, on the wiring 194*b*, there is provided a protection layer 195 and an electrode 290. The electrode 290 is made of Ta (it is an integral film with the anti-cavitation layer 196), and in a part of the region (FIG. 26), a protection layer 195 connecting the wiring 194*b* is formed. On the head base of such a structure, a top plate 198 having a flow passage wall defining the nozzle 163 and an ink supply port 199 for supplying the ink to the common liquid chamber 164, is connected so that ink jet head unit 160 is constructed.

The electrode 290 is exposed in the liquid chamber space of the common liquid chamber 164, and is always contacted to the ink in normal use state. The electrode 290 is connected with an electrical control system of a printer through the contact pads 280 corresponding to the wiring 194*b* and through a connecting contact 281 provided in the ink jet head unit 160.

Figure 27:
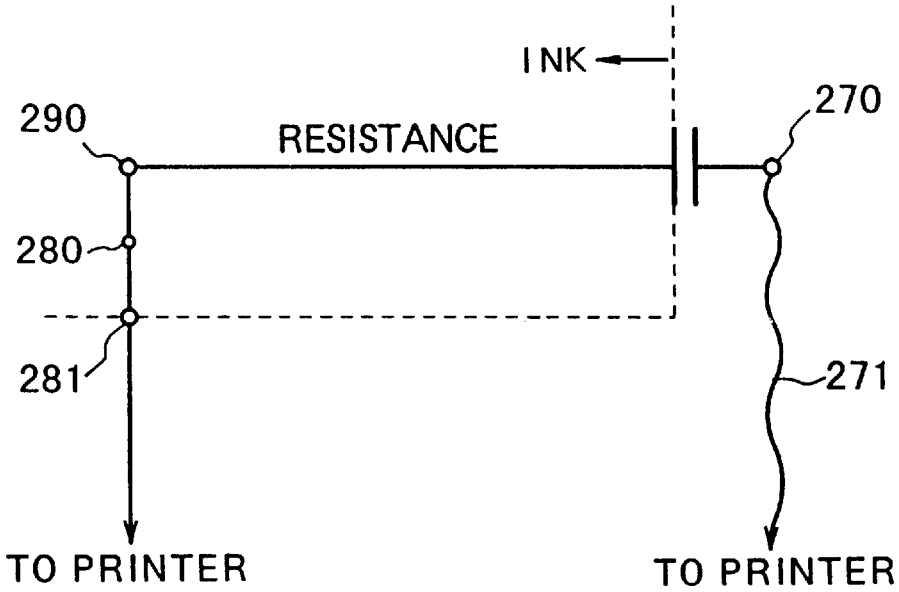
FIG. 27 is an equivalent circuit diagram between the electrodes shown in FIG. 2.
Figure 28A:
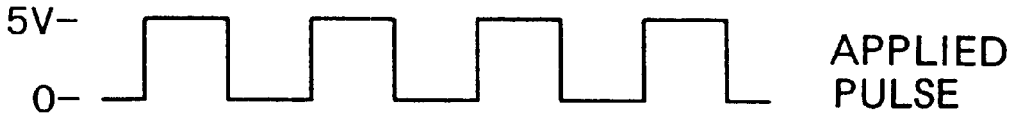
FIGS. 28(*a*) through (*d*) show output waveforms and applied pulses when the ink remaining amount in the inner is detected.
Figure 28B:
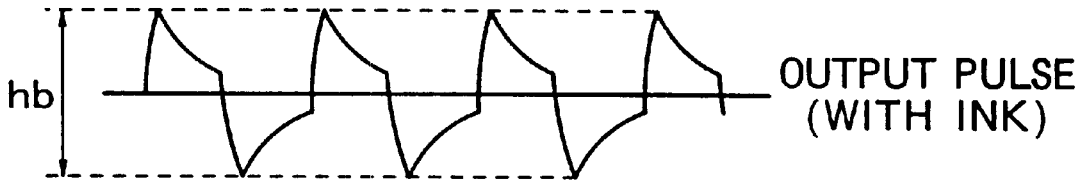
Figure 28C:
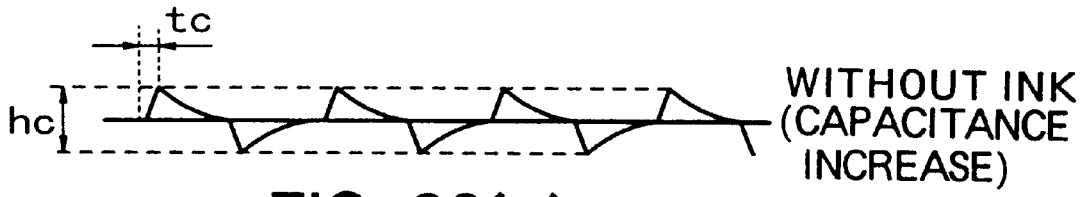
Figure 28D:
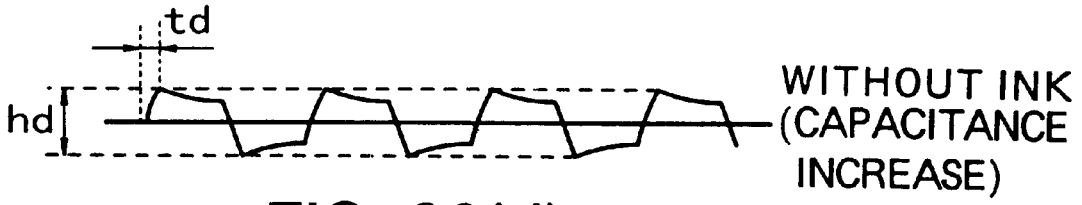

Using the two electrodes 270, 290, the ink remaining amount detecting means for the ink 201 is constituted. Referring to FIG. 27, there is shown an equivalent circuit including the two electrodes 270, 290. As shown in FIG. 27, the equivalent circuit includes a resistance of the ink per se, and a capacitance of the ink present between the electrodes 270, 290, which constitute RC series circuit.

Referring to FIGS. 28(*a*) through (*d*), the ink remaining amount detection for the ink reservoir 201 using the circuit, will be described. In this embodiment, as described hereinbefore, a pulse voltage is applied across the electrode 270 at the holder 150 side and the electrode 290 in the common liquid chamber 164, and the capacitance (electrostatic capacity) which changes in accordance with the area in within which the electrode 270 and the ink are opposed to each other.

More particularly, when the pulse shown in FIG. 28(*a*) is applied between the electrodes 270, 290, an output waveform as shown in FIG. 28(*b*) is provided it a sufficient amount of ink is present in the ink reservoir 201, although the output waveform is different depending on the properties of the ink or the like. When the amount of the ink in the ink reservoir 201 is small, an output waveforms as shown in FIGS. 28(*c*) and (*d*) are provided due to the decrease of the capacitance resulting from the decrees of the ink and due to the increase of the resistance in the equivalent circuit.

In this embodiment, the electrode 290 is provided in the common liquid chamber 164, but the electrode 290 may be provided at any place if it is always contacted to the ink, it has been disposed in the absorbing material 140 in the negative pressure control chamber container 110, for example.

When the ink remaining amount in the ink reservoir 201 decreases due to consumption of the ink, the ink liquid surface lowers toward the bottom surface of the ink reservoir 201. The ink remaining amount decreases to such an extent that ink liquid surface which is the inclination region of the bottom surface of the ink reservoir 201, the opposing area between the ink and the electrode 270 gradually decreases (the distance between the ink end electrode 270 is substantially constant), so that capacitance decreases. As will be understood, it is not inevitable that electrode 270 is parallel to the inclined necessarily of the ink reservoir 201 as in this embodiment, but it may be extended in the horizontal direction.

When the ink is further consumed, the area of the ink opposing to the electrode 270 further decreases. In a area because very small, the capacitance because substantially zero so that shortage of the ink is detected (FIG. 28(*c*)).

When the amount of the ink in the ink reservoir 201 is very small, the ink does not exist at a position corresponding to the opposing area to the electrode 270. The resulting low gain and the increase of the electric resistance of the ink reduction can be detected by calculating a time constant while changing the width and/or frequency of the applied pulse (FIG. 28(*d*)), and the use-up of the ink in the ink reservoir 201 can be detected.

More particularly, the output (peak to peak value) upon the application of the rectangular wave pulse is generally promotional to the capacitance, and it changes from hb to hc with decrease of the capacitance, and therefore, by setting a threshold corresponding to a desired ink level ("no ink" in this embodiment), the ink level can be detected by processing and comparison with the detected value. The time constant of the output waveform is generally the resistance R multiplied by the capacitance C, and therefore, the time constant changes from tc to td with increase of the resistance even when the applied pulse is the same. If a plurality of thresholds or information relating to change with an amount of the ink consumption are set in the devise, the amount of the ink can be detected as analog data.

At this time, the ink remains at the upper portion of the lower absorbing material 140 in the negative pressure control chamber container 110 and forms an ink interface. Therefore, if the ink container unit 200 is ink container united 200 in this state, the stabilized ink supply to the negative pressure control chamber container 110 from the ink container unit 200 can be continued.

The description will be made as to modified examples. The following modified examples (including the embodiments of FIG. 2) can be combined unless particular mentioning is made to the contrary, and the combinations are within the scope of the present invention.

FIRST MODIFIED EXAMPLE

Figure 29A:
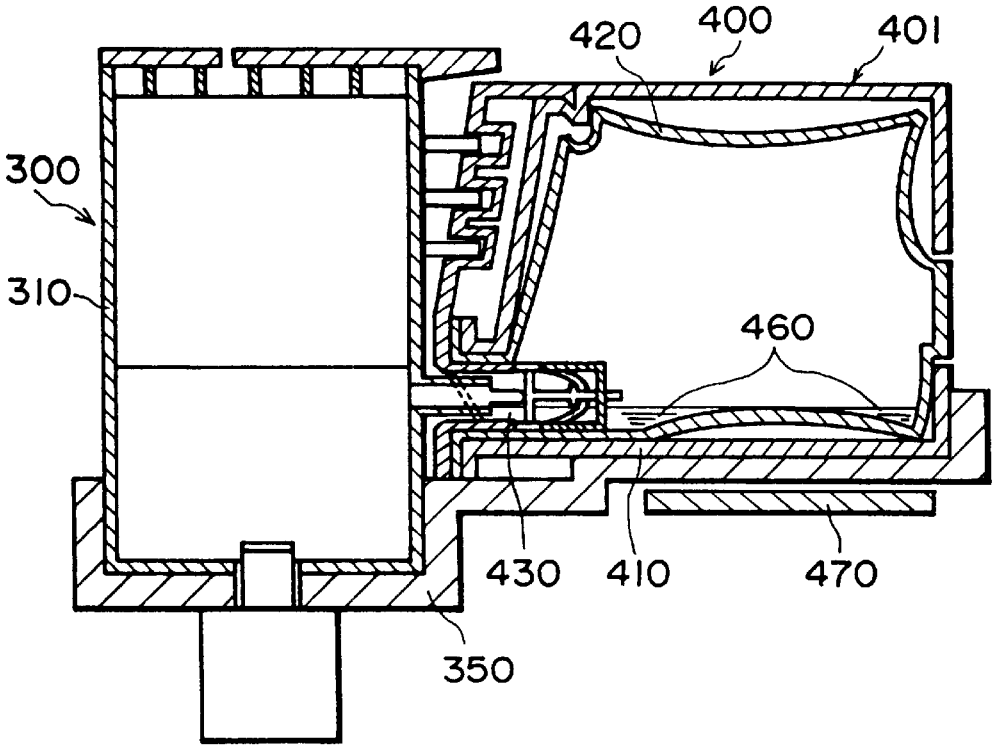
FIGS. 29(*a*) and (*b*) are sectional views of an ink jet cartridge according to a first modified example of the present invention.
Figure 29B:
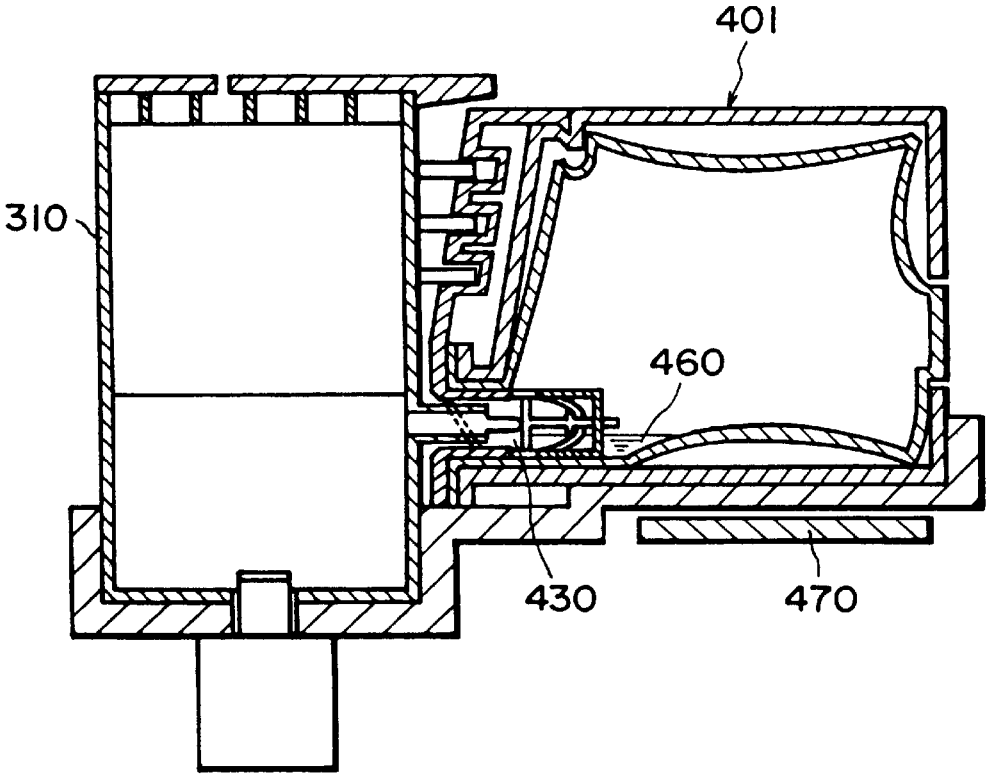

FIGS. 29(*a*) and (*b*) are sectional views of an ink jet cartridge according to a first modified example of the present invention.

In the modified example, the ink reservoir 401 of the ink container unit 400 as a bottom surface which becomes horizontal in use. The portion of the holder 350 of the negative pressure control chamber unit 300 which receives the bottom surface of the ink reservoir 401 is horizontal in use. The electrode 470 at the holder 350 side is in the form of a flat point and is secured to the printer such that it is parallel with the bottom surface of the ink reservoir 401 mounted to the holder 350. With respect to the other structures, they are the same as with the embodiment of FIG. 2, and therefore, the detailed description thereof is omitted.

In the modified example, too, the inner bladder 420 of the ink reservoir 401 deforms with the balanced negative pressure between the negative pressure control chamber unit 300 and the negative pressure control chamber container 310. Here, the bottom surface of the ink reservoir 401 is not inclined as contrasted to the embodiment of FIG. 2, but the electrode 470 is provided perpendicular to the direction of information of the inner bladder 420, and therefore, the same advantageous effects are provided.

Since the angle formed between the bottom surface of the ink reservoir 401 and the trailing edge surface is not obtuse, and therefore, the deformation of the corner portion is rather limited by the casing 410 when the inner bladder 420 deforms. Therefore, the bottom surface of the inner bladder 420 deforms such that central portion rise with the result that ink 460 may remain at two positions at the front end and the rear end as shown in FIG. 29(*a*). However, with the movement of the carriage (not shown) carrying the ink jet cartridge, the ink becomes integral with the ink existing at the joint opening 430 side which is a connecting portion with the negative pressure control chamber container 310 as shown in FIG. 29(*b*) so that ink can be discharged into the negative pressure control chamber container 310 through the joint opening 430. As has been described with the embodiment of FIG. 2, when the ink 460 in the ink reservoir 401 is consumed, most of the ink opposing to the electrode 470 disappears so that capacitance becomes zero, and it is detected that amount of the ink is reaching to use-up state.

Finally, the ink is not present at all at the position opposing to the electrode 470. When the ink reservoir 401 becomes empty, the electric resistance of the ink rises up to several 100 KOhm. And, this can be detected by changing the width of the applied pulse and/or changing the frequency thereof to calculate the time constant, and therefore, the use-up of the ink from the ink reservoir 401 is discriminated.

SECOND MODIFIED EXAMPLE

Figure 30:
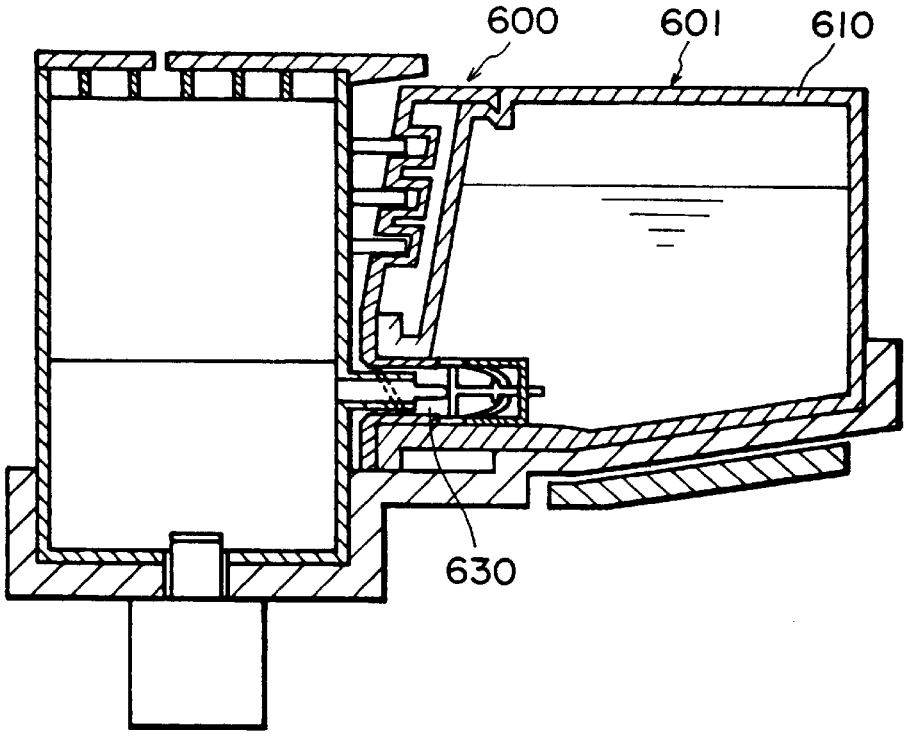
FIG. 30 is a sectional view of an ink jet cartridge according to second modified example of the present invention.

FIG. 30 is a sectional view of an ink jet cartridge according to a second modified example of the present invention. The modified example is different from the embodiment shown in FIG. 2 in the structure of the ink reservoir 601 of the ink container unit 600. More particularly, the ink accommodating portion of the ink reservoir 601 is not of a dual structure, and is constituted only by the casing 610 which is hardly deformable even when the ink is discharged. The ink reservoir 601 defines a space which is hermetically sealed except for the joint opening 630, and air or nitrogen gas is contained therein with the ink to provide a small pressure. The structures of this example is the same as the structures of the embodiment shown in FIG. 2 in the other respects, and therefore, detailed description thereof is omitted for simplicity.

In this manner, even if the ink reservoir portion of the ink reservoir 601 of the ink container unit 600 is not deformable, the use-up of the ink from the ink reservoir 601 can be detected similarly to the embodiment of FIG. 2.

THIRD MODIFIED EXAMPLE

Referring to FIGS. 31 to 38, the description will be made as to an example of control for system which is exchangeably usable with a dual structure ink container unit including the inner bladder and the casing of FIG. 2 embodiment and the ink reservoir of the second modified example. The description will be made at various stages including the step of detection by the electrode. The ink jet cartridge of the modified example has the same structure as that of FIG. 2, and the detailed description thereof are omitted by assigning the same reference numerals for the elements having the corresponding functions, for simplicity of explanation.

(1) use-up of ink container

Figure 31:
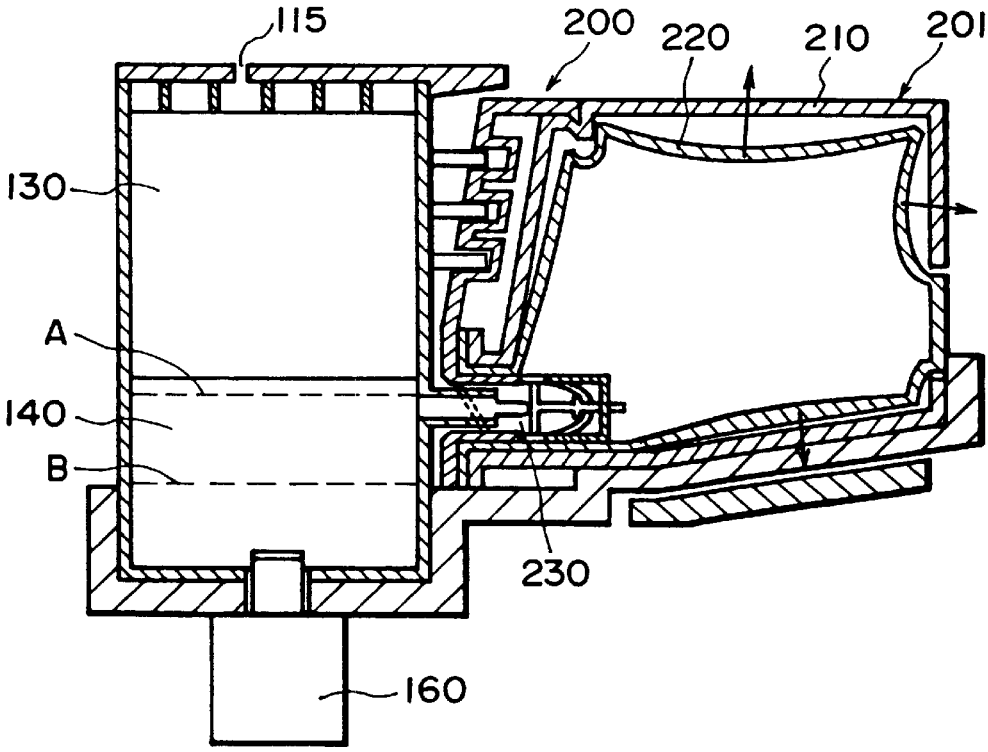
FIG. 31 is a sectional view of an ink jet cartridge illustrating a third modified example according to the present invention.

As shown in FIG. 31, when the ink container unit 200 becomes empty, there becomes no ink discharged from the joint opening 230 by the gas-liquid exchange, and therefore, the ambience is introduced into the inner bladder 220 of the ink reservoir 201 from the air vent 115 through the absorbing materials 130, 140. By this, the inner bladder 220 extends and restores toward the casing 210 as indicated by the arrow in the Figure, and it abuts the casing 210, then, it is stabilized.

The ink interface in the lower absorbing material 140 lowers of the position A with which the ink is in the ink reservoir 201 which is supplied with gas-liquid exchanging operation, to the position B, with the ink supply into the ink jet head unit 160. Before the ink interface reaches the position B, the ink container unit 200 is exchanged with a fresh one. The operation after the exchange will be described hereinafter (3).

(2) ink container mounting

Figure 32:
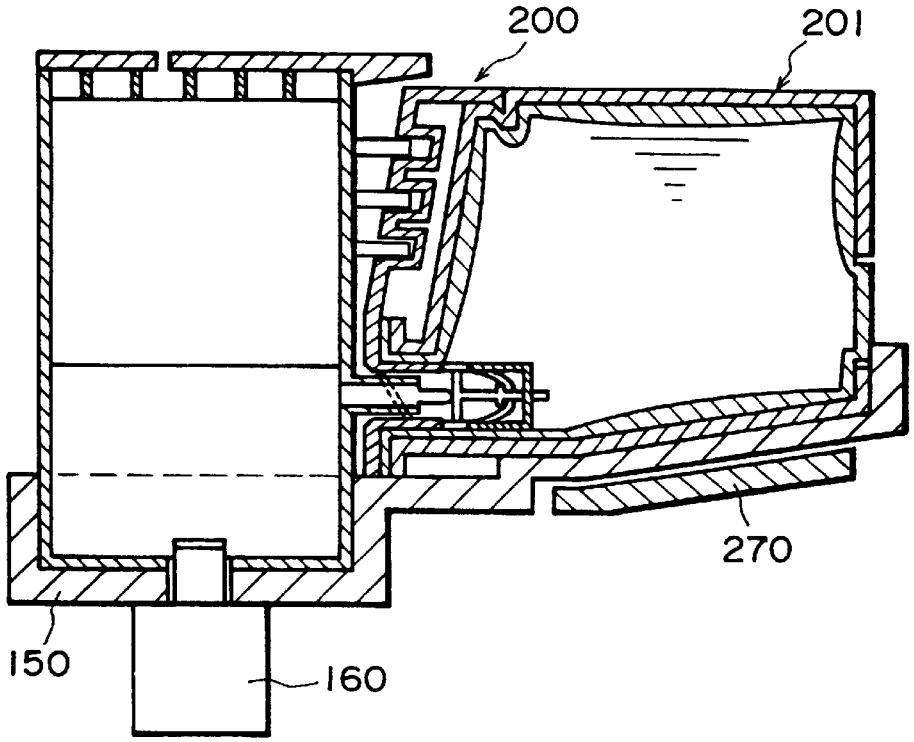
FIG. 32 is a sectional view of an ink jet cartridge illustrating a third modified example according to the present invention.

FIG. 32 shows a state immediately after mounting of a fresh ink container unit 200.

When the ink container 200 is mounted, the pulse voltage is applied between the lower electrode 270 of the holder 150 and the electrode 280 (FIG. 2) provided in the ink jet head unit 160, and it is discriminated whether an ink container unit 200 containing ink has been mounted or not on the basis of the time constant (or gain). If no ink container unit is mounted, or a used-up ink container unit is mounted, a warning is produced to prompt the operator.

Figure 33:
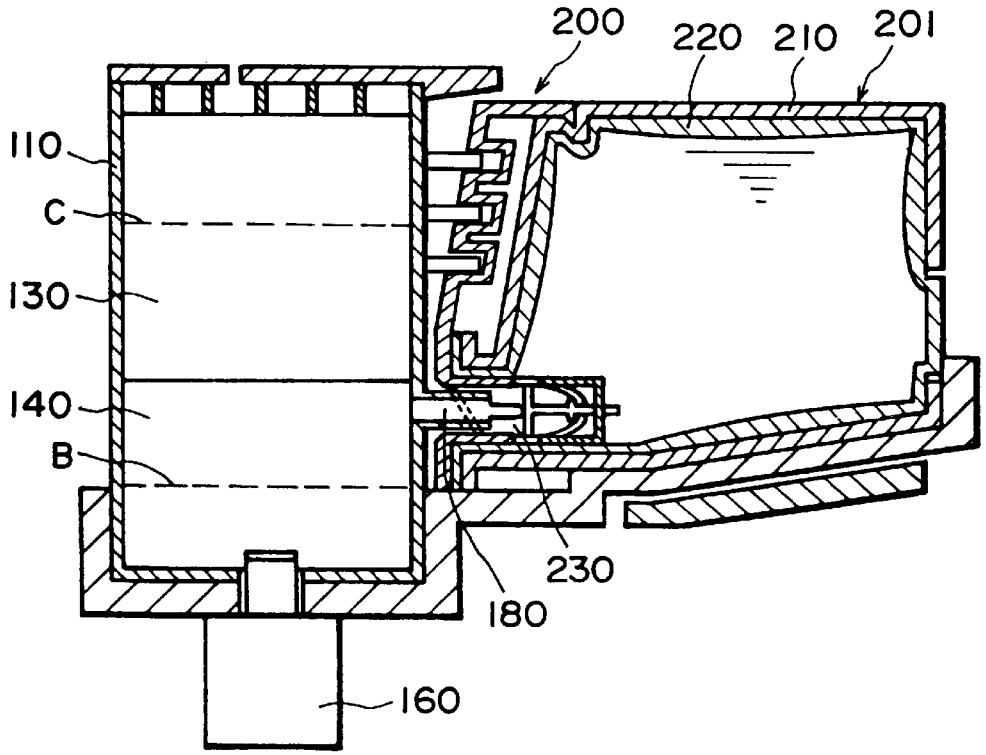
FIG. 33 is a sectional view of an ink jet cartridge illustrating a third modified example according to the present invention.

When the ink container unit 200 is mounted in this manner, as shown in FIG. 33, the ink in the ink reservoir 201 is directly connected to the lower absorbing material 140 through joint opening 230 and the joint pipe 180 and indirectly with the upper part absorbing material 130. The ink in the ink reservoir 201 flows into the negative pressure control chamber container 110 through the joint opening 230 and the joint pipe 180 so as to maintain the balance of the negative pressures in the ink reservoir 201 and the negative pressure control chamber container 101. As a result, the ink interface in the negative pressure control chamber 110 rises from the position B to position C by the absorption of the ink by the upper part absorbing material 130.

With the motion of the ink from the ink reservoir 201 into the negative pressure control chamber container 110, the inner bladder 220 directly containing the ink deforms inwardly in an ink reservoir 201. At this time, the deformation of the inner bladder 220 is mainly occurs at the maximum area sides, and in the separation from the casing 210 is not remarkable in the section shown in FIG. 33.

(3) ink consumption step 1

Figure 34:
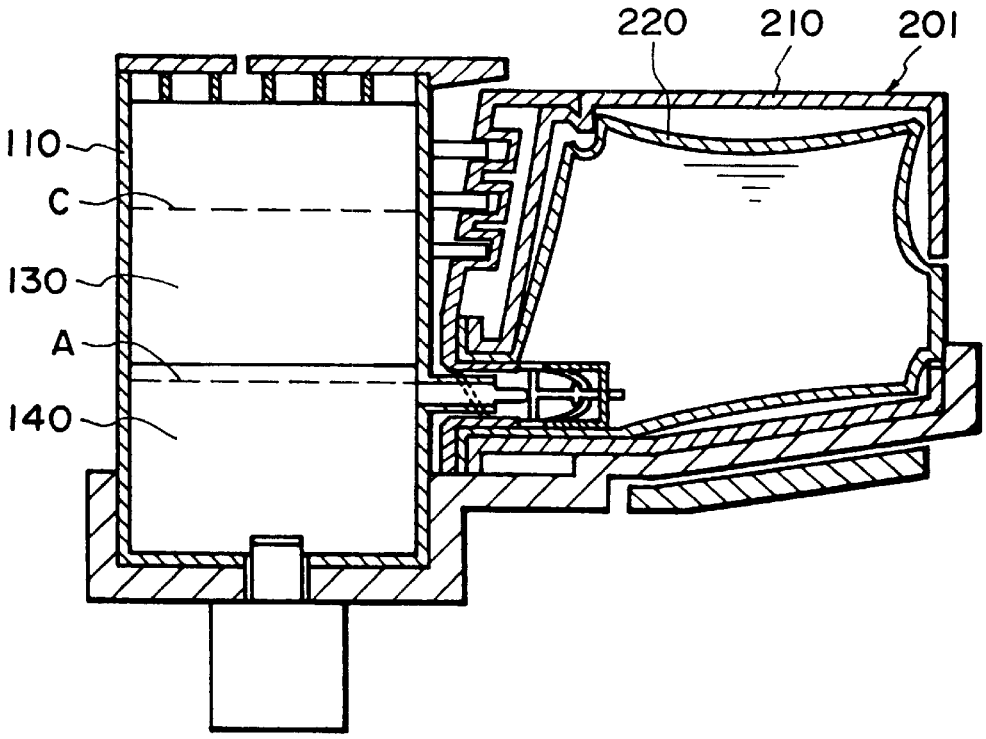
FIG. 34 is a sectional view of an ink jet cartridge illustrating a third modified example according to the present invention.
Figure 35:
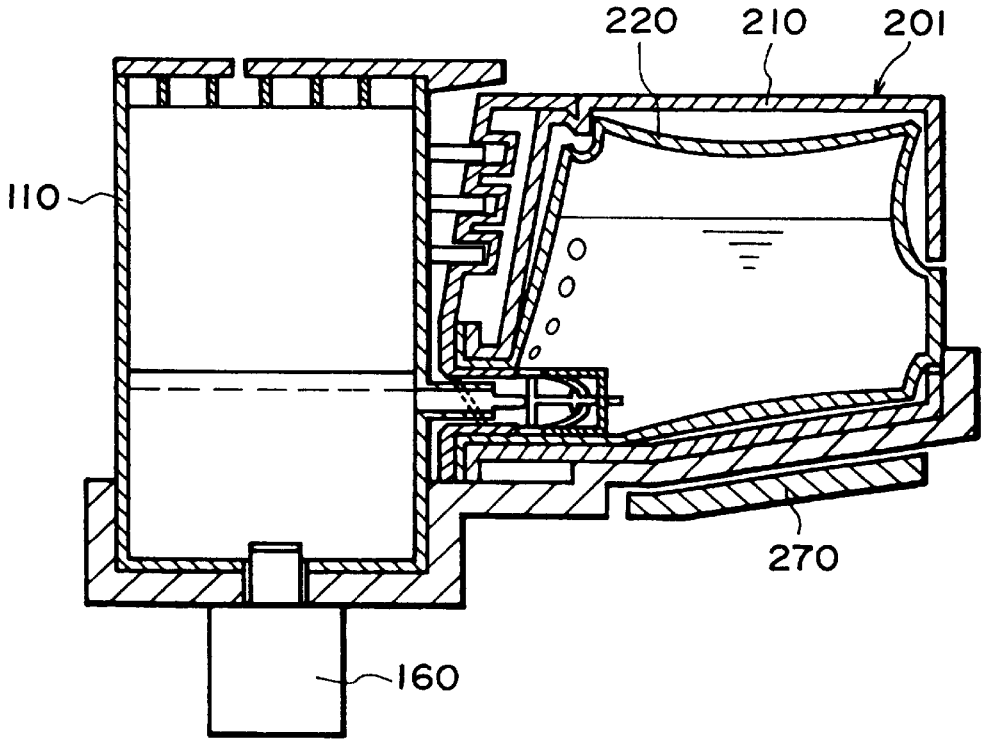
FIG. 35 is a sectional view of a ink jet cartridge illustrating a third modified example of the present invention.

With the supply of the ink to the ink jet head unit 160, the ink is consumed from the negative pressure control chamber container 110, and as shown in FIG. 34, the interface of the ink in the negative pressure control chamber container 110 lowers from the position C which is within the upper part absorbing material 130 to the position A which is within the lower absorbing material 140. Simultaneously, the ink is supplied from the ink reservoir 201, and with a consumption, the inner bladder 220 deforms further inwardly so that sides of the inner bladder 220 other than the maximum area sides start to deform from the casing 210. When the ink interface lowers to the position A, as shown in FIG. 35, the gas-liquid exchanging operation starts so as to maintain the constant negative pressure in the ink reservoir 201. The disengagement of the inner bladder 220 from the casing 210 (more particularly, the disengagement at the bottom surface) can be detected by the ink remaining amount detecting means constituted by the two electrodes 270, 290 (FIG. 2). In the case of the ink reservoir 201 having the deformable inner bladder 220, the distance between the ink and the electrode 270 with the deformation of the inner bladder 220, and then, it is stabilized at the patentably distance because of the balance of the negative pressure reached. By detecting the change of the capacitance due to the change of the distance and the stabilized state thereafter, the occurrence of the gas-liquid exchange is discriminated. On the other hand, when an ink container unit 600 having an ink reservoir 601 not having the inner bladder as shown in FIG. 30 is connected to the negative pressure control chamber container 110, there is no such change of the distance between the electrode 270 and the ink, and therefore, the change of the capacitance resulting from this is not seen, so that it is discriminated that ink container unit of a type different from that of the ink container unit 201 is discriminated.

In an ink supplying system designed for use of ink container units 200 having a deformable inner bladder 220, when such an ink container unit not having the inner bladder, the ink may overflow in the negative pressure control chamber container 110 since the ink container unit per se does not have the buffer effect absorbing the expansion of the air in the ink reservoir portion. Therefore, no proper negative pressure may be generated.

In order to avoid the trouble, if the capacitance does not lower even if a predetermined amount of the ink is consumed, the ink container unit is discriminated as a container unit not having the inner bladder. If the temperature change occurs, the ink is absorbed through the nozzles 163 of the ink jet head unit 160 (FIG. 2), thus discharging additional ink to assure the reliability.

A printer is usually provided with means for detecting an ambient temperature, a detecting means for detecting a temperature of the recording head or the like, which is usable for detecting an ambient temperature indirectly, and therefore, it is usable for detecting the temperature change.

(4) ink consumption step 2

Figure 36:
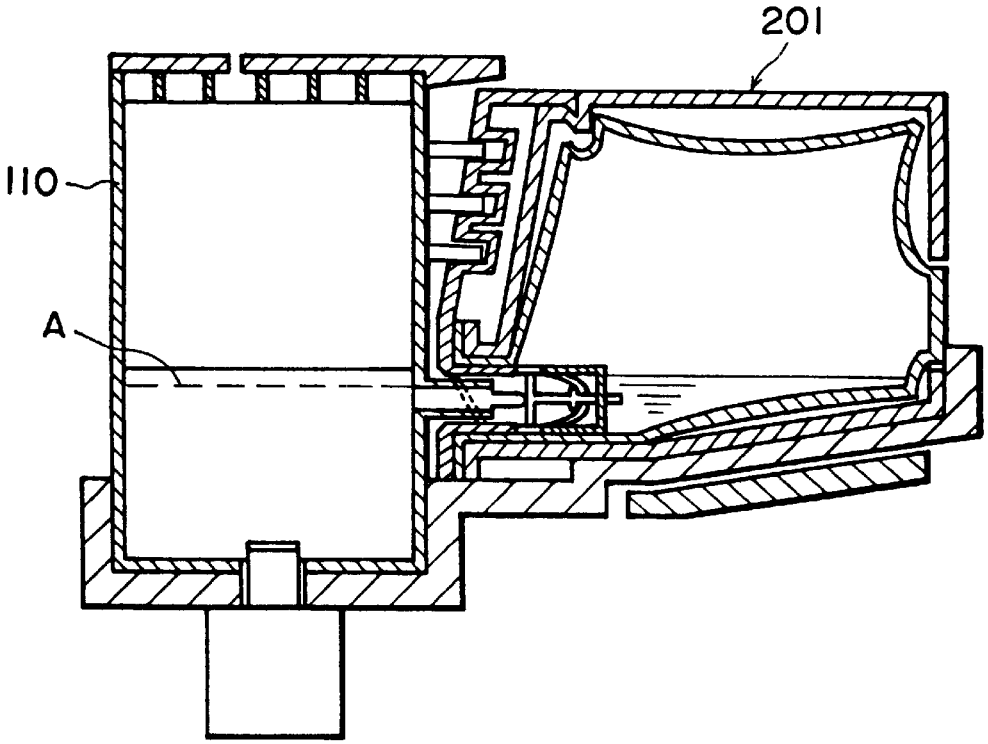
FIG. 36 is a sectional view of an ink jet cartridge illustrating a third modified example according to the present invention.
Figure 37:
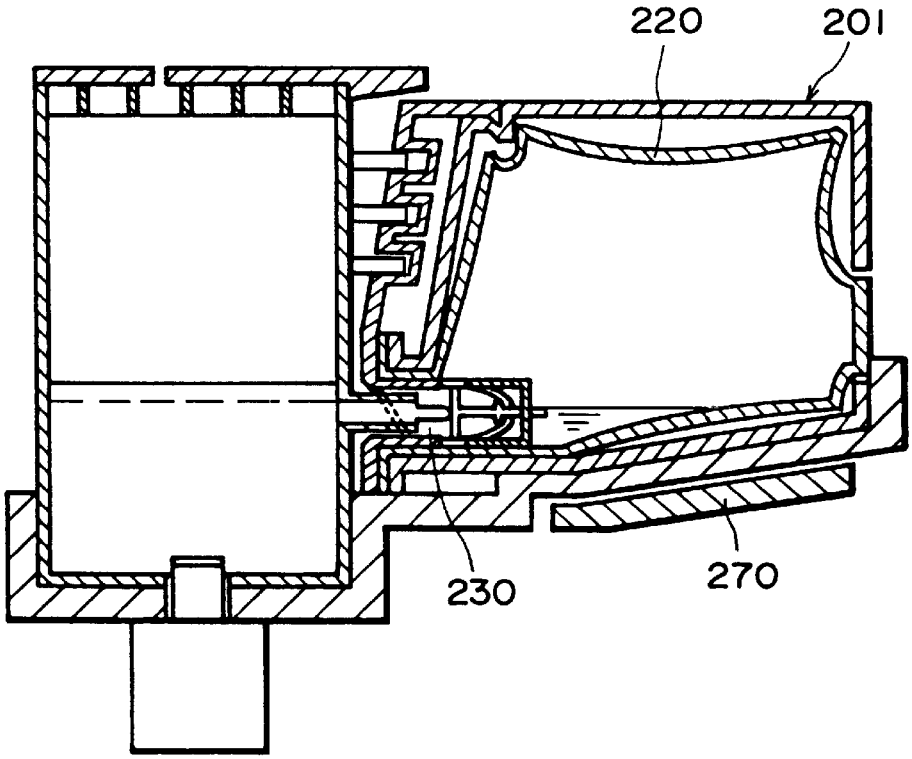
FIG. 37 is a sectional view of an ink jet cartridge illustrating a third modified example of the present invention.

When the ink is consumed while continuing the gas-liquid exchange, the ink is consumed from the ink reservoir 201 with the ink interface is stably at the position A as shown in FIG. 36, the bottom surface of the inner bladder 220 of the ink reservoir 201 gradually appears as shown in FIG. 37. Then, a boundary line between the ink liquid surface in the inner and the bottom surface of the inner bladder moves toward the joint opening 230, by which the area of the ink opposed to the electrode 270 in the ink reservoir 201 decreases. During this period, the capacitance continuously decreases, and therefore, using this, the ink remaining amount in the ink reservoir 201 can be detected as analog data when the ink remaining amount becomes small.

(5) ink consumption step 3

Figure 38:
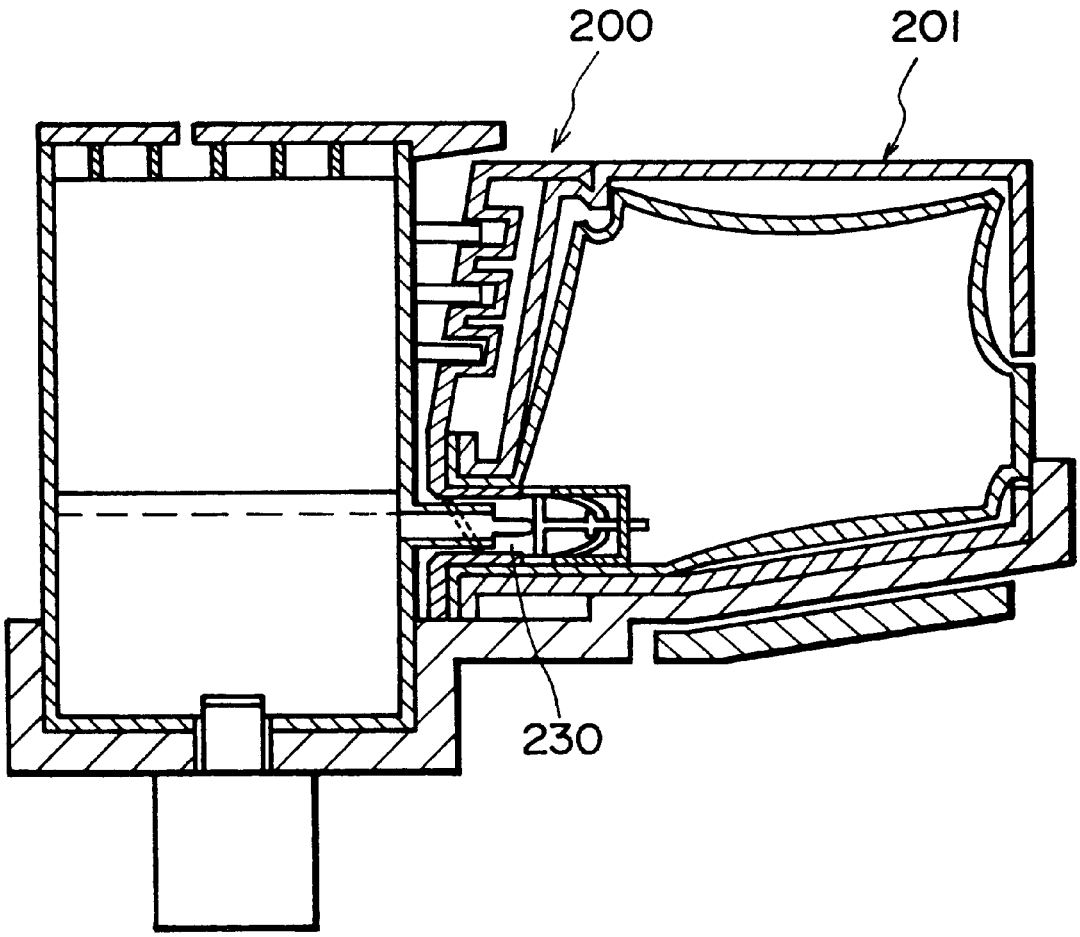
FIG. 38 is a sectional view of an ink jet cartridge illustrating a third modified example of the present invention.

With further consumption of the ink, as shown in FIG. 38, the ink in the ink reservoir 201 exists only at a horizontal portion adjacent the joint opening 230, and when the ink further decreases, the capacitance approaches substantially zero, and the resistance (electric resistance) extremely increases. This is discriminated as use-up of the ink of the ink container unit 200, and notification in some kind is made to the user to promote the container exchange.

(6) ink container unit exchangeable period

When the ink in the ink container unit 200 becomes empty, the inner bladder 220 restores to the original position with which it is contacted to the casing 210. Even if the container is empty, the ink exists in the joint pipe 180, the lower absorbing material 140 and the ink jet head unit 160 which are downstream of the ink container unit 200 with respect to the supply direction of the ink, and therefore, the printing can be continued. If the user exchange the container with a fresh container, the situation is as stated in (2). If an ink container unit still containing the ink is once removed from the removed and then is reset, the situation is the same as (3) or (4).

As described in the foregoing, even if the ink container unit 200 becomes empty, the printing can be continued to a certain extend. However, if the ink interface in the negative pressure control chamber container 110 lowers to such an extent that even if a fresh ink container unit is connected, the continuous ink path from the joint opening 180 to the ink jet head unit 160 cannot be connected (B), the desired ink path is not formed. In order to avoid this, a control can be made in which at the time of completion of step (5), the amount of consumption of the ink is calculated (conversion) on the basis of the number of ink ejections from the nozzle (FIG. 2), and immediately before the arrival of the ink interface in the negative pressure control chamber container 110 at the position B, the printing operation is temporarily stopped to promote the user with the exchange of the container, and the printing operation is not resumed before the ink container unit accommodating the ink is mounted.

FOURTH MODIFIED EXAMPLE

Figure 39:
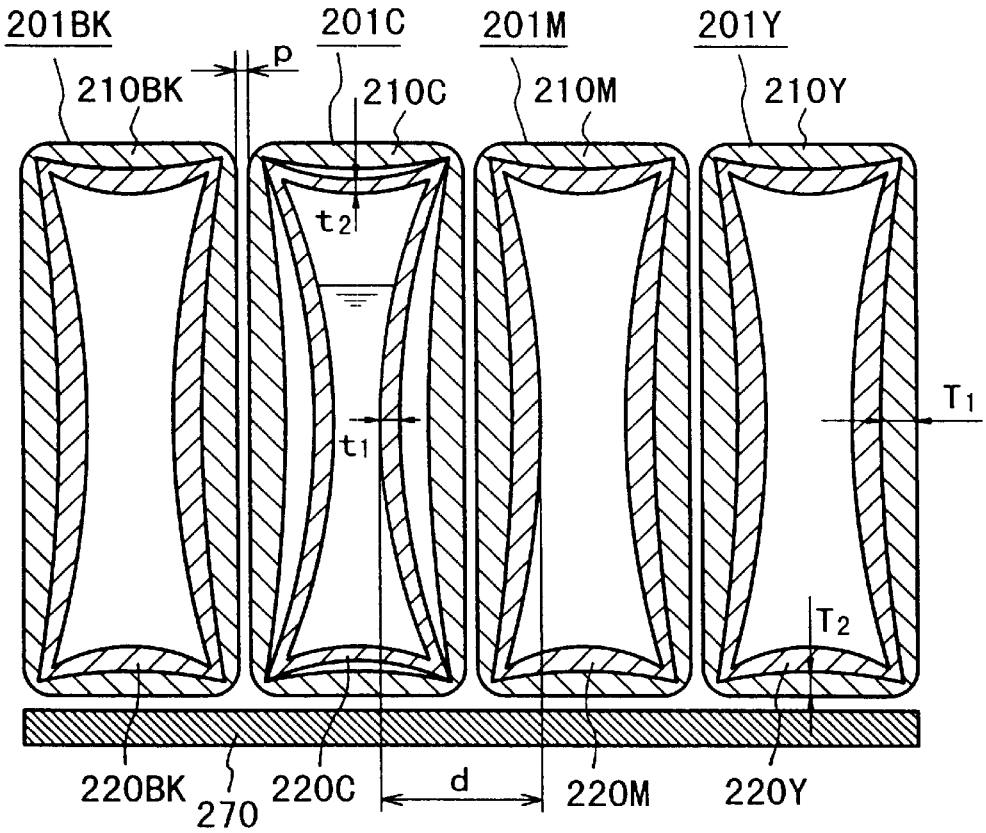
FIG. 39 is a sectional view of an ink jet cartridge illustrating a fourth modified example of the present invention.

FIG. 39 is a sectional view illustrating a fourth modified example. The ink reservoir of the modified example is retained by a holder such as an ink jet head cartridge in the fashion as shown in FIG. 1. FIG. 39 is a sectional view of a plurality of ink reservoirs 201.

More particularly, as shown in FIG. 39, the ink reservoir 201Bk accommodating the black ink, the ink reservoir 201C accommodating the cyan ink, the ink reservoir 201M accommodating the magenta ink and the ink reservoir 201Y accommodating the yellow ink are juxtaposed with clearances p.

If one ink reservoir 201 is singled out, a RC series circuit is constituted between the electrodes 270, 290 as described hereinbefore. However, in the case that ink reservoirs 201Bk, 201C, 201M, 201Y are closely disposed relative to each other, electrostatic capacities C12, C23, C34 are produced between adjacent ink reservoirs in addition to the electrostatic capacities C1–C4 of each of the ink reservoirs as indicated in the equivalent circuit shown in FIG. 41(*a*). The electrostatic capacities C12, C23, C34 between adjacent ink reservoirs vary in accordance with the amount of the ink contained in the adjacent container, so that time constants of the ink remaining amount detection system will be influenced. So, for a further improved detection of the ink remaining amount, it is desired that electrostatic capacities C12, C23 and C34 are made as small as possible to minimize the influence. In the relation between the adjacent ink reservoirs, the electrostatic capacity C between the ink reservoirs is determined by the ink reservoir side area S, the distance between the inner wall surfaces of the ink reservoir (thickness of the side wall of the ink reservoir×2+a gap between the 2 ink reservoirs), the dielectric constant E, as follows:

$$Cab=E(S/d) \qquad \text{Equation (1)}$$

Here, d is not uniform over the entire side area, and is expressed as an integration of dielectric constants of the resin material constituting the reservoir and the air in the clearance P. From the equation (1), it would be considered that in order to reduce the electrostatic capacity C ab between the ink reservoirs, the side surface stacking S is reduced and/or the distance d between the inner walls of the container is made larger. The reduction of the side surface stacking S is not preferable from the standpoint of accommodation efficiency of the ink. In the modified example, the distance d between the inner walls of the container is made larger.

More particularly, as shown in FIG. 39, the thicknesses of the side wall T1, t1, the thicknesses of the bottom wall opposing to the electrode 270 T2 and t2 (capital "T" is a thickness of the casing, and the lowercase "t" is a thickness of the inner bladder) satisfy:

$$T1>T2, t1>t2$$

The dimensions of the ink reservoirs 201Bk, 201C, 201M, 201Y are determined so as to satisfy these. By doing so, the electrostatic capacity C ab between the ink reservoirs can be reduced as compared with the case wherein all the wall thicknesses are made uniform, so that influence of mutual interference can be minimized, and therefore, the ink remaining amount can be detected at high accuracy.

Figure 40:
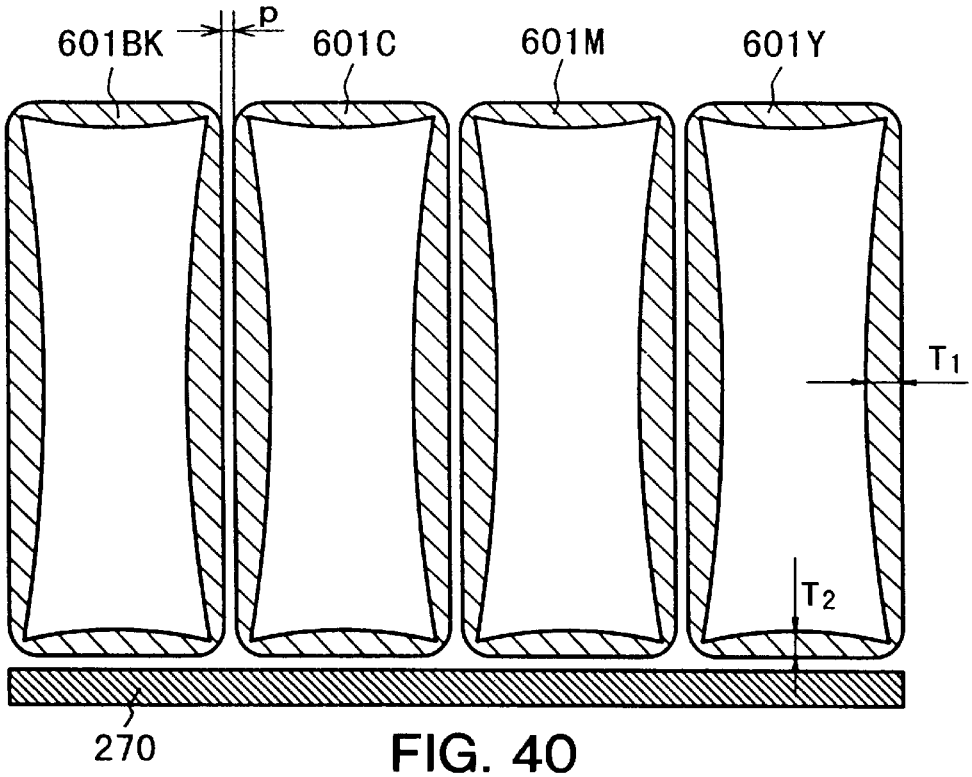
FIG. 40 is a sectional view of an ink jet cartridge illustrating a father modified example of a fourth modified example of the present invention.
Figure 41A:
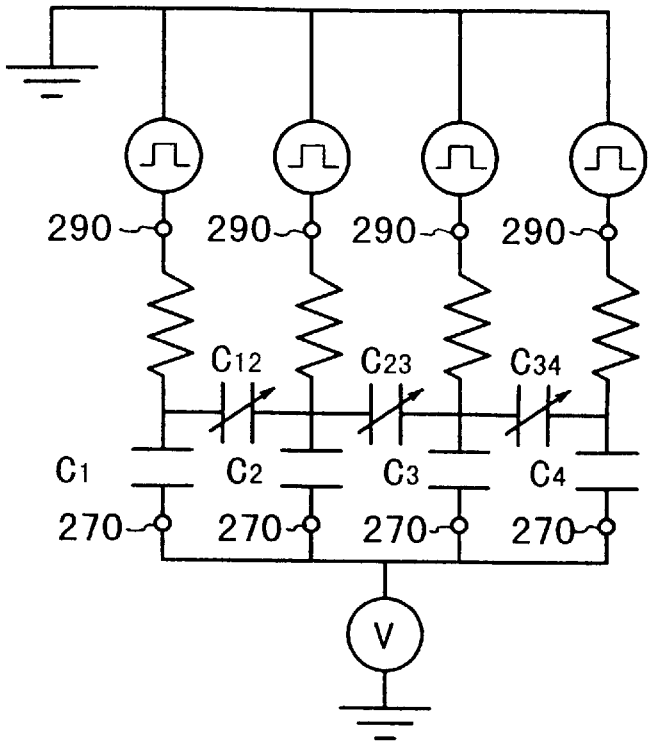
FIGS. 41(*a*) and (*b*) are illustrations of examples of an equivalent circuit in the detection system for detecting ink remaining amount when a plurality of ink reservoirs are juxtaposed.
Figure 41B:
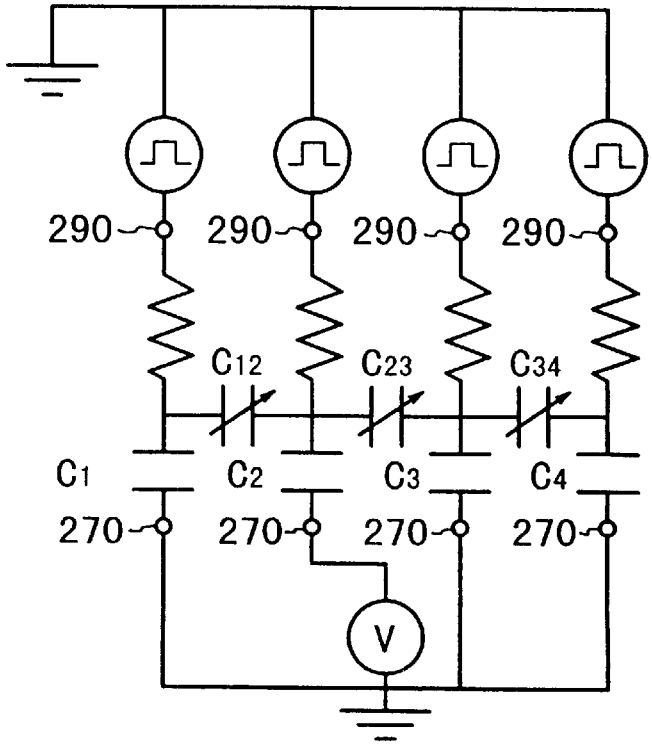

As shown in FIG. 41(*b*), the detecting circuit for other than the ones intended to detect may be electrically grounded by which the mutual buffering can be reduced. In this embodiment, as shown in FIG. 2, the ink reservoir 201 has a dual structure including a casing 210 and an inner bladder 220, and the inner bladder 220 deforms inwardly with discharge of the ink. The deformation is most large at the maximum area sides where the ink reservoir 201 is opposed to the adjacent one or ones. Therefore, with the ink reservoir 201 having the inner bladder 220 provided by this embodiment, the distances d between the inner walls of the container increases with the discharge of the ink. This is desirable, however, the present invention is not limited to the use with such a dual structure type ink reservoir 201, but is applicable to a container not having the inner bladder which deforms with the discharge of the ink. FIG. 40 shows such an example. In FIG. 40, the thickness of the casing of the side wall T1 and the thickness of the casing of the bottom surface T2 satisfy T1>T2, too.

In the foregoing embodiments, the upper wall and the bottom wall of the ink reservoir 201 are parallel with each other, as shown in FIG. 39. More particularly, the bottom wall is parallel with the parallel with respect to the widthwise direction of the ink reservoir 201 in use. The inclination may be provided in the widthwise direction, too, so that area of the ink opposing to the electrode when the ink amount is small may be further reduced.

Figure 42A:
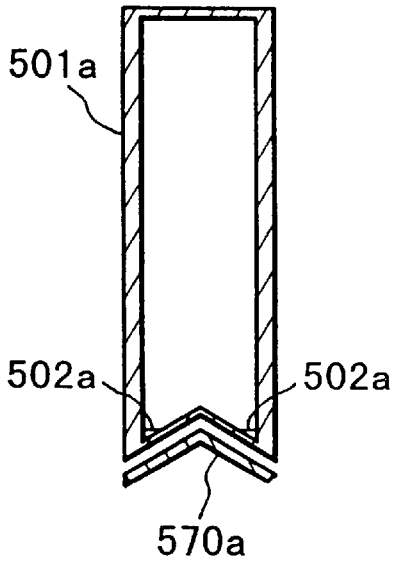
FIGS. 42(*a*) through (*c*) show modified examples of the FIG. 42 in the widthwise direction of the ink reservoir.
Figure 42B:
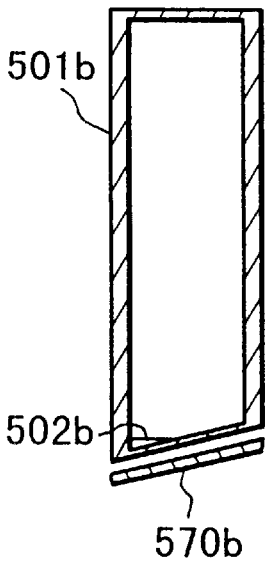
Figure 42C:
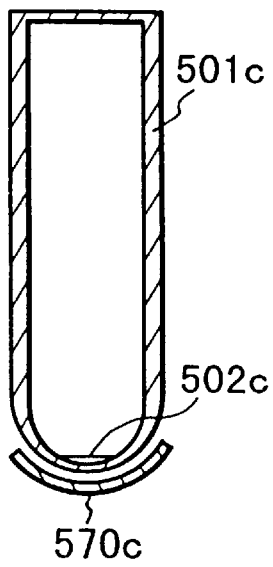

FIGS. 42(*a*) through (*c*) show examples of such an ink reservoir. The ink reservoir 501*a* shown in FIG. 42(*a*) has a bottom wall having a central portion (in the widthwise direction) is inwardly projected. The electrode 570*a* opposed to the bottom wall of the ink reservoir 501*a* has a configuration complementary with the bottom wall of the ink reservoir 501*a*. When the ink remaining amount in the ink reservoir 501*a* becomes small, the ink remains only at the widthwise end portions of the ink reservoir 501*a*. On the other hand, when a sufficient amount of the ink remains, the area in which the ink adjacent the electrode 570*a* are opposed to each other is larger than in the case that bottom wall is flat. Therefore, the ratio of the opposing area with a large amount of the ink and the opposing area with a small amount of the ink is large, so that S/N ratio of the output waveform provided at the electrode 570*a* is large, thus improving the detection accuracy.

Similarly, an ink reservoir 501*b* showing disclose in FIG. 42(*b*) has a bottom wall which uniformly inclines, so that ink 502*b* remains on lateral side, and the electrode 570*b* has a shape matching with the configuration of the bottom wall of the ink reservoir 501*b*. In an example shown in FIG. 42(*c*), an ink reservoir 501*c* has a rounded bottom wall, with which the ink 502*c* remains in the central portion in the widthwise direction, and the electrode 570*c* has a configuration matching the bottom wall of the ink reservoir 501*c*. In FIGS. 42(*a*)–(*c*), the walls of the ink reservoirs 501*a*, 501*b*, 501*c* are of monolayer structure, but it may be of dual structure as shown in FIG. 2 and so on, or it may be constructed by casing only as indicated in the Figure.

FIFTH MODIFIED EXAMPLE

Figure 43:
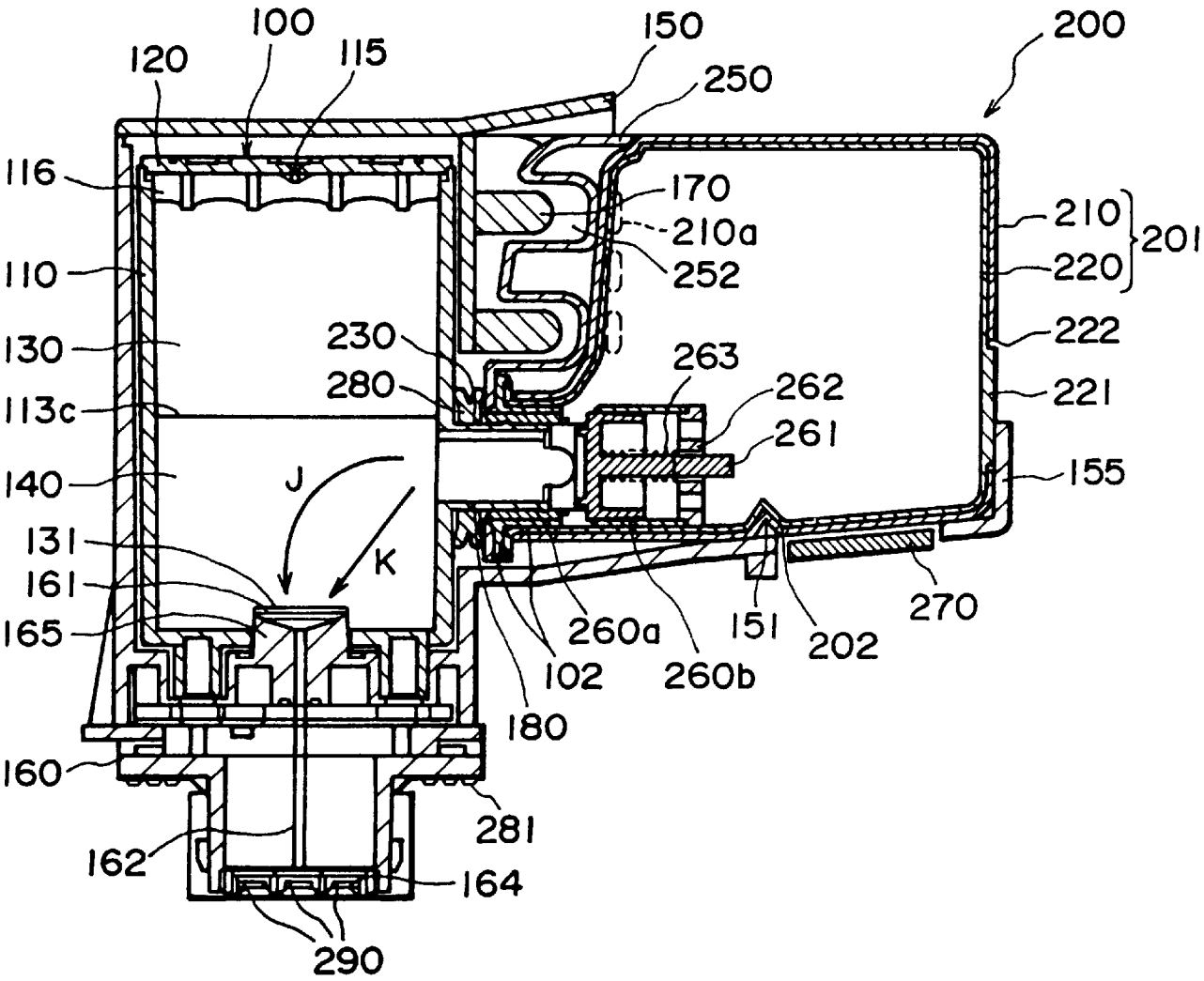
FIG. 43 is a sectional view of an ink jet cartridge illustrating a fifth modified example according to the present invention.
Figure 44:
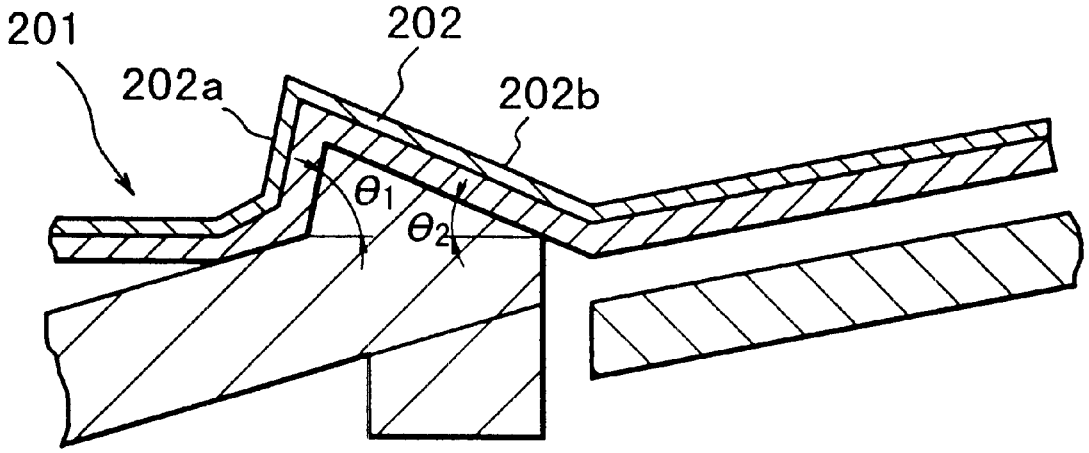
FIG. 44 is a partially sectional view illustrating a protection and a part therearound in the ink reservoir according to fifth modified example of the present invention.

FIGS. 43 and 44 illustrate fifth modified example of the present invention. This modified example is different from the embodiment of FIG. 2 in that inner bottom surface of the ink reservoir 201 is provided with an inward projection 202 extended entirely in the widthwise direction of the ink reservoir 201.

The projection 202 in the container, as shown in FIG. 43, is in front of the position opposing to the electrode 270, that is, at the joint opening 230 side. Since the inner projection 202 is provided in the ink reservoir 201, the surface of the outer wall is recessed at the portion corresponding the inner projection 202 of the ink reservoir 201, and the holder 150 is provided with a holder projection 152 engageable with the recess when the ink container unit 200 is mounted to the holder 150.

Referring to FIG. 44, the description will be made as to a projection 202 in the container. The projection 202 in the container has two inclined surfaces, namely, an inclined surface opposed to the joint opening 230 (first surface) 202*a*, and an inclined surface opposed to the trailing edge surface of the ink container unit 200 (second surface) 202*b*. An angle angle θ1 of the first surface relative to the horizontal plane and an angle θ2 of the second surface relative to the same, satisfy θ1>θ2. More particularly, θ1 is approximately 60 degrees, θ2 is approximately 30 degrees in this embodiment. The apex angle of the holder projection 151 engaged with the projection 202 in the container is approximately 90 degrees in this embodiment.

When the ink in the ink container having such a projection is consumed, and the position of the liquid surface lowers beyond the position of the apex 202*c* (FIG. 44) of the projection 202 in the container, the ink is separated by the inner projection 202 into front and rear parts. Since the angles θ1 and θ2 of the first surface 201*a* and the second surface 201*b* of the projection 201 relative to the horizontal plane satisfy θ1>θ2, the ink at the rear side of the ink reservoir 201 is easily discharged toward the joint opening 230 beyond the inner projection 202 by the swinging motion of the ink in the ink reservoir 201 resulting from the reciprocating motion of the carriage during the recording operation of the printer carrying the ink container unit 200. On the other hand, the ink at the joint opening 230 side does not easily return toward the rear side beyond the projection 202 in the container.

In the case of the foregoing embodiments without the ink reservoir not having the separating function as in the modified example, the ink may remain in the form of film on the bottom portion of the ink reservoir 201 due to the surface tension of the ink when the ink reservoir 201 becomes vacant. In the modified example, the bottom wall of the ink reservoir 201 has an inner projection 202, and therefore, even if the ink remains in the form of film in a region opposed to the electrode 270 at the bottom portion of the ink reservoir 201, the continuity of the ink is separated by the inner projection 202. As a result, the impedance of the electric circuit between the electrode 270 and the ink through the liquid containing portion 201 increases. By detecting the time constant and the change of the gain at this time, the fact that remaining amount of the ink is very small, can be detected.

Since the ink container unit 200 is mounted to the holder 150 with the substantially rotational motion as described in the foregoing, the mounting of the ink container unit 200 is smooth by satisfying the relation θ2>θ1.

In the foregoing modified example, the exemplified ink reservoir 201 has a dual structure having the casing 210 and the inner bladder 220, but the ink reservoir is not limited to the dual type, but it may be constituted only by a casing 210. As for the structure for separating the ink in the region opposed to the electrode 290 from the joint opening 230 side when the ink remaining amount in the ink reservoir decreases to such a level as requires the detection, the projection 202 is provided in the reservoir in this modified example. This is not limiting, and the height of the joint opening 230 may be simply lowered, that is, stepped structure is usable. However, with such a structure, the high portion of the step decreases the ink accommodation capacity, and therefore, the projection structure is desirable.

SIXTH MODIFIED EXAMPLE

FIG. 45(*a*) is a schematic illustration of a sixth modified example according to the present invention. In the modified example, two ink reservoirs 1201 and 1202 containing the same kinds of inks to supply common nozzles of the ink jet head unit 160 through the ink supply path 1100.

In such a system, if the electrodes 270, 290 are provided similarly to FIG. 45(*a*), the absence or presence or remaining amounts of the ink in the two containers are simultaneously detected by the ink detecting means. FIGS. 45(*b*) and (*c*) show examples of detection result provided by the ink detecting means.

In the case of the ink supplying system shown in FIG. 45(*a*), there are generally two modes, in one of which the ink is discharged from both of the ink reservoirs 1201, 1202, and in the other of which the ink is discharged mainly from one of them. FIG. 45(*b*) schematically shows a maximum value VH of the output waveform versus the amount of the ink consumption when the ink is consumed mainly from one of the ink reservoirs 1201 with the pulling addition pulse shown in FIG. 28(*a*) supplied. In FIG. 45(*b*), the sections d1, d2, d3 correspond to (d1), (d2) and (d3) of FIG. 45(*d*). In section d1, VH is nearly equal to V, and in the section d2; section d2 shows a state immediately after VH becomes not equal to V; and in section d3, VH is zero. In section d2, the ink is consumed from only one of the containers, namely, ink reservoir 1201.

On the other hand, FIG. 45(*c*) schematically shows a maximum value VH of the output waveform versus the amount of the ink consumption when the ink is consumed from both of the ink reservoirs 1201 with the pulling addition pulse shown in FIG. 28(*a*) supplied. In FIG. 45(*c*), the sections d1, d2, d3 correspond to (e1), (e2) and (G3) of FIG. 45(*e*). In section e1, VH is nearly equal to V, and in section G3, VH is nearly equal to zero. In this case, both of the ink reservoirs are empty in the section e2 in the section e2 where the VH suddenly changes. In the case that common liquid is supplied from a plurality of containers in such a manner, the electrode 290 is connected with the ink reservoirs 1201 and 1202 through the ink flow path 1100. A comparison with the waveform when both of the containers are vacant is made so that proper ink container exchange is accomplished.

When the ink reservoirs 1201 and 1202 are separable from each other, the results of the detection may be utilized such that when V' continues for a certain period of time, a warning may be produced on the recording device or a control device for controlling the recording device to indicate that one of the ink reservoirs are vacant to promote the user to exchange the reservoir.

The case in which three liquid containers are connected through the fluid communication path will be described. The event that state of VH being nearly equal to ⅔V continues for a certain period of time indicates that one of the three reservoirs is vacant, and the event that state of VH being equal to ⅓ continues for a certain period of time, two of the reservoirs are vacant.

SEVENTH MODIFIED EXAMPLE

Figure 46A:
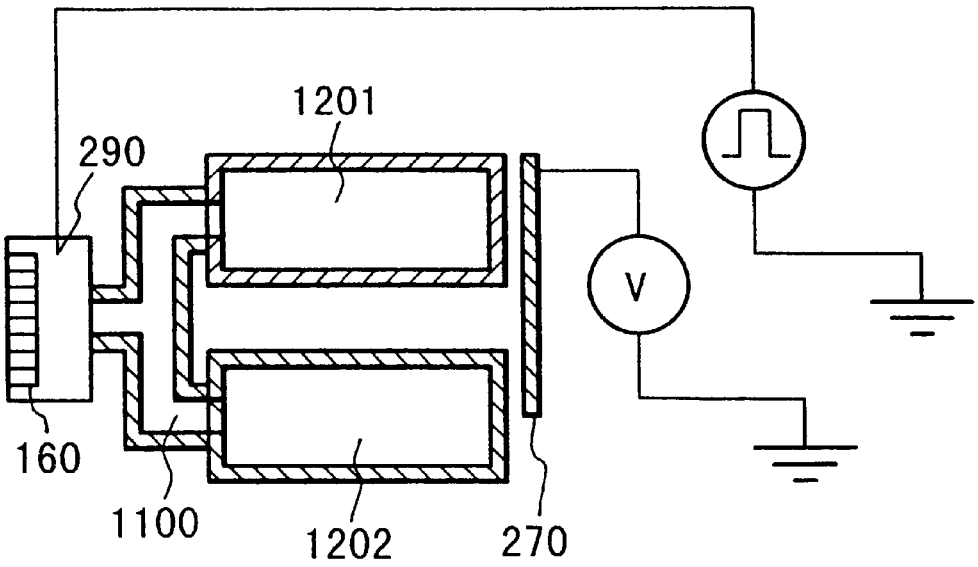
FIGS. 46(*a*) through (*c*) are illustrations of a seventh modified example of the present invention.
Figure 46B:
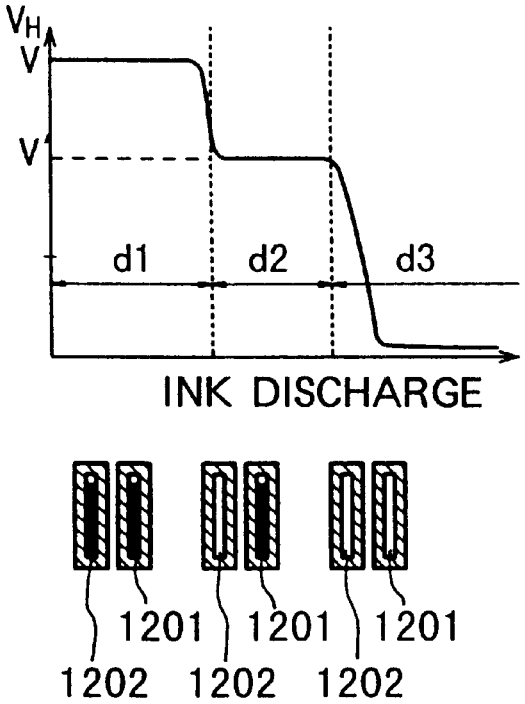
Figure 46C:
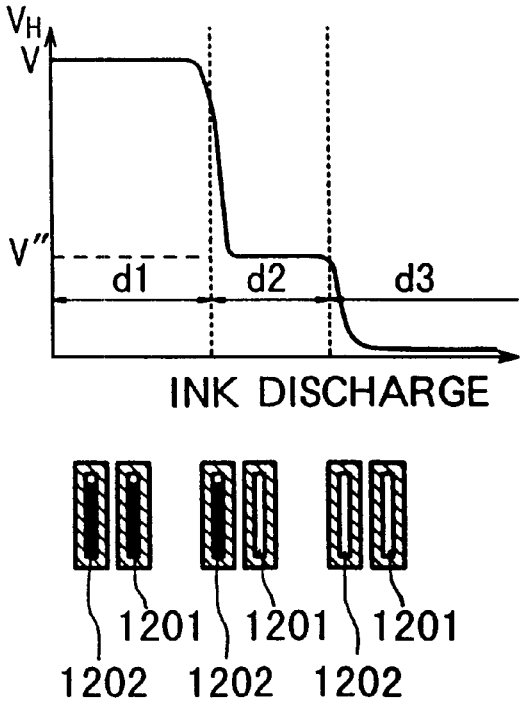

FIG. 46(*a*) schematically illustrates a seventh modified example of the present invention. In the modified example, a ratio of the area of the electrode 270 opposed to the bottom portion of the liquid container 1201 and the area opposed to the container 1202 is different (in this example, it is approximately 2:1), as is different from sixth modified example.

The electrodes 270 and 290 are provided as shown in FIG. 46(*a*).

Then, the presence or absence of the ink (or the remaining amount) of the two containers are simultaneously detected by the ink detecting means. FIGS. 46(*b*) and (*c*) show examples of a detection result of the ink detecting means.

When the ink is consumed first from the container 1202 with which the opposing area of the opposite electrode is relatively smaller, the level VH nearly equal to V' (⅔V) is detected for a certain period of time in section d2, as shown in FIG. 46(*b*). On the other hand, as shown in FIG. 46(*c*), when the ink is consumed first from the container 1202 with which the opposing area of the opposite electrode is relatively larger, the level VH nearly equal to V" (⅓V) is detected for a certain period of time in section d2

In this modified example, as is different from the sixth modified example, it can be notified which one of the containers is vacant.

In the foregoing examples, the case of two containers are taken. When n containers are used, the opposing area ratio of the electrode may be selected to be $2^{n-1}:2^{n-2}\ldots:2^{0}(n\geqq 3)$. In the modified example, the area ratio is made different, but a ratio of the distances between the electrode and the bottom surface of the container is usable in place thereof.

As described in the foregoing, according to the present invention, the bottom surface o the liquid supply container is inclined relative to the horizontal surface, or the liquid containing portion is deformable so as to provide a negative pressure, the shortage of the liquid can be detected using change of the opposing area of the liquid relative to the electrode. When the liquid supply container is separable from the negative pressure producing member accommodating chamber, the liquid can be stably kept supplied to the negative pressure producing member accommodating chamber from the liquid supply container if the liquid supply container is exchanged when the shortage is detected.

By making the thickness of the side walls of the liquid supply container (liquid containing portion) where it is faced to the adjacent wall larger than the thickness of the bottom wall, the influence of the electrostatic capacity can be reduced. As a result, the remaining amount of the liquid in the liquid supply container can be detected with higher accuracy, thus permitting stable supply of the liquid to the outside.

By the provision of a separating structure on a bottom wall which is opposed to the liquid remaining amount detecting use for the liquid supply container (liquid containing portion), the detection of the remaining amount of the liquid is assured even if the liquid remains on the bottom wall in the form of film, so that supply of the liquid to the outside can be stabilized.

The liquid remaining amount (presence or absence) detection of the present invention can be used with the ink reservoir of the liquid supplying system showing disclose in FIG. 2. The exchange of the ink reservoir in accordance with the detection means that ink container is exchanged leaving the negative pressure control chamber unit which retains the ink, as is different from a conventional exchange of the ink container. In the liquid supplying system, the ink in the fresh ink container can be easily contacted to the ink in the negative pressure control chamber unit upon the exchange of the ink container, so that ink supply path can be constituted, so that there is no need of carrying out the recovering operation, in the ink jet head cartridge, for filling the ink supply path with the ink upon the exchange of the container with the fresh one. This can save the ink by the amount required by the refreshing process. In order to assure the advantages, it is important to assure the detection of the ink in the ink container as will be understood.

While the invention has been described with reference to the structures disclosed herein, it is not confined to the details set forth, and this application is intended to cover such modification or changes as may come within the purposes of the improvements or the scope of the following claims.

What is claimed is:

1. A liquid supply system comprising:

a liquid supply container provided with a liquid supply portion for supplying liquid to outside;

detecting means including an electrode for detecting presence or absence of the liquid in said liquid supply container, using an electrostatic capacity between the liquid in said liquid supply container and said electrode;

wherein said electrode is disposed to be parallel with and spaced from a bottom surface of said liquid supply container, and the bottom surface has an inclined portion inclined relative to a horizontal plane from one end to another end of said liquid supply container, and has a connecting portion at a lower side end.

2. A liquid supply system according to claim 1, wherein the bottom surface of said liquid supply container has a horizontal portion extending in a horizontal direction, and said electrode extends from said inclined portion to said horizontal portion.

3. A liquid supply system according to claim 1, wherein said liquid supply container has a casing and a liquid containing portion having an outer surface substantially equivalent to an inner surface of said casing and constituting a space substantially sealed except for said connecting portion, and wherein said liquid containing portion is deformable with discharge of the liquid contained therein, and wherein said detecting means detects a change of an electrostatic capacity resulting from a change of a distance between said electrode and the liquid in said liquid containing portion due to deformation of said liquid containing portion.

4. A liquid supply system according to claim 1, wherein said system includes a plurality of said liquid supply containers which are disposed adjacent one another such that bottom surfaces thereof are opposed said electrode, and wherein each of said plural liquid supply containers has a side wall having a thickness smaller than a thickness of the bottom surface opposed to the electrode.

5. A liquid supply system according to claim 1, wherein said liquid supply container includes a separating structure in a liquid supply portion side region beyond a portion opposed to said electrode, said separating structure for separating the liquid in a region opposed to said electrode from the liquid supply portion side when a remaining amount of the liquid in said liquid supply container is a predetermined amount.

6. A liquid supply system according to claim 1, wherein said system includes a plurality of said liquid supply containers which are disposed adjacent one another such that bottom surfaces thereof are opposed said electrode, with at least a first group of said plural liquid supply containers containing a same kind of liquid and with others containing a different kind of liquid, and further comprising a liquid discharge path for fluid communication between connecting portions of said first group of said liquid supply container.

7. A liquid supply system according to claim 6, wherein remaining amounts in a predetermined number of liquid containers of said plural liquid containers are detected.

8. A liquid supply system according to claim 6, wherein opposing areas between said electrode and said plural liquid containers are different from each other.

9. A liquid supply system according to claim 1, wherein an amount of remaining liquid in said liquid supply container is detected by detecting a change in the electrostatic capacity.

10. A liquid supply system according to claim 1, further comprising a negative pressure producing member accommodating chamber accommodating a negative pressure producing member therein and connected to said liquid supply container through said connecting portion, wherein said negative pressure producing member accommodating chamber has the liquid supply portion for discharging to outside the liquid supplied thereinto through the connecting portion.

11. A liquid supply system according to claim 10, wherein the connecting portion is provided in a side sandwiched by maximum area sides of said liquid supply container, and wherein an angle formed between the bottom surface and a surface opposite from a side having the connecting portion is obtuse.

12. A liquid supply system according to claim 10, wherein said negative pressure producing member accommodating chamber and said liquid supply container are separable at the connecting portion.

13. A liquid supply system comprising:

a negative pressure producing member accommodating chamber accommodating therein a negative pressure producing member and having a liquid supply portion for supplying liquid to outside;

a liquid supply container connected with said negative pressure producing member accommodating chamber through a connecting portion and having a liquid reservoir portion which defines a substantially sealed space except for the connecting portion;

an electrode extended parallel with a bottom surface of said liquid supply container, provided at least below said liquid supply container; and detecting means for detecting an amount of remaining liquid in said liquid containing portion based on an electrostatic capacity between said electrode and liquid in the liquid supply container, wherein another configuration of said liquid reservoir portion is substantially similar to an inner configuration of said liquid supply container, and constructed to provide a negative pressure corresponding to deformation of a part thereof corresponding to the bottom surface of said liquid supply container.

14. A liquid supply system according to claim 13, wherein the system comprises a plurality of said liquid supply containers each having the liquid supply portion;

wherein said liquid supply containers are disposed adjacent to one another, and each of said liquid supply containers has a side wall having a thickness which is smaller than a thickness of the bottom wall opposed to said electrode.

15. A liquid supply system comprising:

a liquid supply container having a liquid supply portion for supplying liquid to outside;

an electrode, disposed below said liquid supply container, for detecting an amount of remaining liquid in said liquid supply container based on an impedance between the liquid and the electrode;

a separating structure, provided in a region of said liquid supply container at a liquid supply portion side beyond a portion opposed the electrode, for separating liquid in a region opposed to said electrode from the liquid supply portion side when a remaining amount of the liquid in said liquid supply container is a predetermined amount.

16. A liquid container comprising:

a liquid containing portion for accommodating liquid;

a liquid discharge portion for discharging the liquid to outside;

wherein said liquid supply container is provided with a bottom surface which is opposed to an electrode disposed below said liquid supply container, said electrode for detecting remaining amount of the liquid in said liquid containing portion based on an electrostatic capacity between said electrode and the liquid;

wherein the liquid supply container is inclined relative to said electrode.

17. A liquid container according to claim 16, wherein said liquid containing portion is deformable and includes an outer casing for protecting the liquid containing portion.

18. A liquid supply container comprising:

a plurality of liquid containing portions for accommodating liquid; and a plurality of liquid discharge portions for discharging the liquid from respective ones of said plurality of liquid containing portions to outside;

wherein said liquid containing portions are disposed adjacent to one another;

wherein said liquid containing portions are each provided with a bottom wall to which an electrode is arranged for detecting a remaining amount of the liquid in said liquid containing portions based on an impedance between the liquid and said electrode; and wherein said liquid containing portions each include a side wall opposed to the liquid containing portion adjacent thereto, said side walls having a thickness larger than that of said bottom walls.

19. A liquid container comprising:

a liquid containing portion for accommodating liquid;

a liquid discharge portion for discharging the liquid to outside;

wherein said liquid containing portion is provided with a bottom wall to which an electrode is arranged for detecting a remaining amount of the liquid in said liquid containing portion based on an impedance between the liquid and said electrode; and a separating structure, provided in a region of said liquid containing portion at a liquid supply portion side beyond a portion opposed the electrode, for separating liquid in a region opposed to said electrode from the liquid supply portion side when a remaining amount of liquid in said liquid containing portion is a predetermined amount.

20. A liquid container according to claim 19, wherein said separating structure includes a projection provided on an inner bottom wall and extending in a direction crossing with a direction from a region opposed to said electrode toward said liquid discharge portion.

21. A liquid container according to claim 20, wherein said projection includes a first surface at a liquid discharging side and a second surface opposed to said electrode, and wherein an angle of the first surface relative to a horizontal plane in use is larger than an angle of the second surface relative to a horizontal plane.

* * * * *

UNITED STATES PATENT AND TRADEMARK OFFICE

CERTIFICATE OF CORRECTION

PATENT NO. : 6,598,963 B1
DATED : July 29, 2003
INVENTOR(S) : Hajime Yamamoto et al.

Figure 7B:
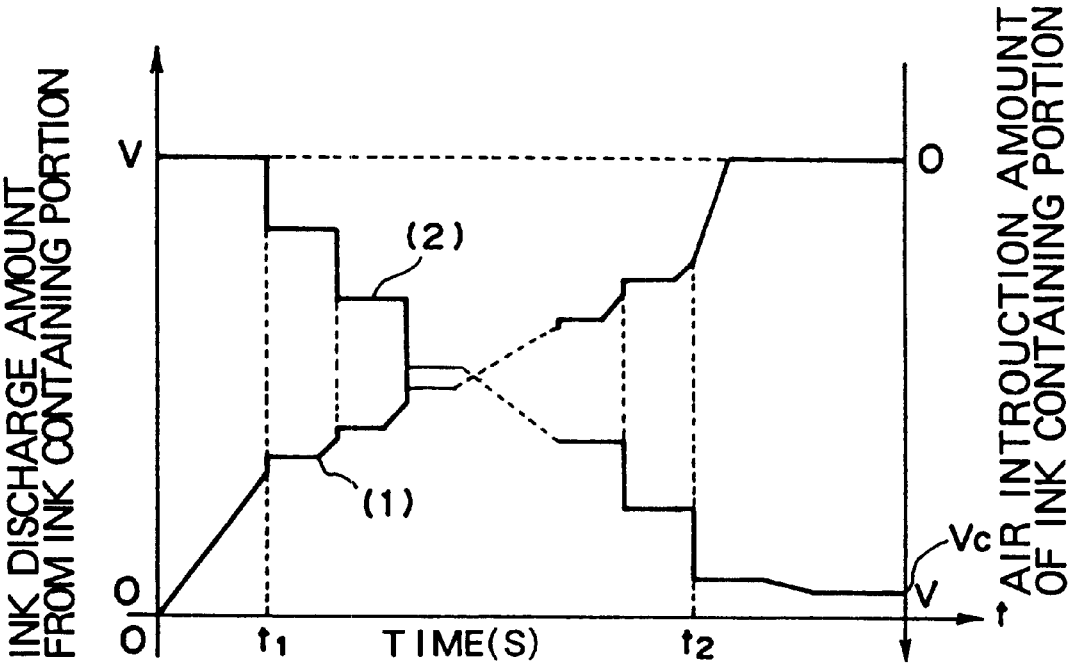

It is certified that error appears in the above-identified patent and that said Letters Patent is hereby corrected as shown below:

Drawings,
Figure 7(b), “INTROUCTION” should read -- INTRODUCTION --.

Column 2,
Line 45, “program,” should read -- problem --.

Column 3,
Line 33, “supply” should read -- supplied --; and
Line 48, “plan” should read -- plane --.

Column 5,
Line 43, “portions” should read -- portion --.

Column 7,
Line 17, “show” should read -- shown --.
Line 29, “to” should read -- to a --; and
Line 60, “father” should read -- further --.

Column 8,
Line 7, “illustrations” should read -- are illustrations --.

Column 18,
Line 34, “primary, direction,” should read -- primary direction, --.

Column 20,
Line 31, “posses” should read -- possess --.

Column 22,
Line 21, “occurs” should read -- occur --.

Column 29,
Line 53, “of the deformation” should be deleted.

Column 33,
Line 66, “flow” should read -- flows --.

Column 38,
Line 31, “that is,” should be deleted.

UNITED STATES PATENT AND TRADEMARK OFFICE

CERTIFICATE OF CORRECTION

PATENT NO. : 6,598,963 B1
DATED : July 29, 2003
INVENTOR(S) : Hajime Yamamoto et al.

It is certified that error appears in the above-identified patent and that said Letters Patent is hereby corrected as shown below:

Column 40,
Line 51, “though” should read -- through --.

Column 51,
Line 2, “value” should read -- valve --.

Column 53,
Line 10, “it” should read -- if --;
Line 14, “an” should be deleted;
Line 39, “capacitance because” should read -- capacitance becomes --;
Line 62, “devise” should read -- device --; and
Line 67, the second occurrence of “ink container” should be deleted.

Column 54,
Line 1, “united 200” should be deleted.

Column 57,
Line 3, “is” should be deleted;
Line 34, “from the removed” should be deleted; and
Line 38, “extend” should read -- extent --.

Column 59,
Line 4, “with the parallel” should be deleted; and
Line 61, “angle angle” should read -- angle --.

UNITED STATES PATENT AND TRADEMARK OFFICE

CERTIFICATE OF CORRECTION

PATENT NO. : 6,598,963 B1
DATED : July 29, 2003
INVENTOR(S) : Hajime Yamamoto et al.

It is certified that error appears in the above-identified patent and that said Letters Patent is hereby corrected as shown below:

Column 61,
Line 20, "in the section e2" should be deleted.

Column 62,
Line 8, "o" should read -- of --.

Signed and Sealed this

Tenth Day of August, 2004

JON W. DUDAS
*Acting Director of the United States Patent and Trademark Office*